US011260261B2

(12) United States Patent
Henniger et al.

(10) Patent No.: US 11,260,261 B2
(45) Date of Patent: Mar. 1, 2022

(54) WEIGHTLIFTING MACHINE

(71) Applicant: Coulter Ventures, LLC., Columbus, OH (US)

(72) Inventors: William Henniger, Columbus, OH (US); Nash Dunahay, Blacklick, OH (US)

(73) Assignee: Coulter Ventures, LLC., Columbus, OH (US)

( * ) Notice: Subject to any disclaimer, the term of this patent is extended or adjusted under 35 U.S.C. 154(b) by 0 days.

(21) Appl. No.: 16/601,337

(22) Filed: Oct. 14, 2019

(65) Prior Publication Data

US 2020/0114195 A1 Apr. 16, 2020

Related U.S. Application Data

(60) Provisional application No. 62/890,419, filed on Aug. 22, 2019, provisional application No. 62/797,048,
(Continued)

(51) Int. Cl.
*A63B 21/00* (2006.01)
*A63B 21/062* (2006.01)
(Continued)

(52) U.S. Cl.
CPC ..... *A63B 21/156* (2013.01); *A63B 21/0428* (2013.01); *A63B 21/0442* (2013.01);
(Continued)

(58) Field of Classification Search
CPC ..... A63B 21/00065; A63B 21/02; A63B 21/00189; A63B 21/04; A63B 21/0407;
(Continued)

(56) References Cited

U.S. PATENT DOCUMENTS 723,625 A 3/1903 Thornley
2,067,403 A 1/1937 Lea
(Continued)

FOREIGN PATENT DOCUMENTS

EP 2345459 A1 7/2011
EP 3295998 A1 3/2018
(Continued)

OTHER PUBLICATIONS

Photo from <https://web.archive.org/web/20170112075250/https://mydynamicfitness.com>, dated Jan. 12, 2017.
(Continued)

*Primary Examiner* — Megan Anderson
*Assistant Examiner* — Kathleen M Fisk
(74) *Attorney, Agent, or Firm* — Banner & Witcoff, Ltd.

(57) ABSTRACT

A weightlifting machine that includes a pulley system and a cable system that attaches to a weight rack frame to allow a user to perform a weightlifting exercise. The pulley system may include a first pulley and a second pulley where the cable system engages each pulley. The cable system may have a first end connected to a grip attachment and a second end attached to a resistance element. The resistance element may include a resistance band, a weight support that holds a weight plate, a set of weight plates, or other type of resistance element. The cable system may extend from the pulley through an opening located one of the frame members that form the frame.

14 Claims, 55 Drawing Sheets

Related U.S. Application Data filed on Jan. 25, 2019, provisional application No. 62/790,324, filed on Jan. 9, 2019, provisional application No. 62/750,690, filed on Oct. 25, 2018, provisional application No. 62/749,972, filed on Oct. 24, 2018, provisional application No. 62/746,909, filed on Oct. 17, 2018, provisional application No. 62/745,838, filed on Oct. 15, 2018, provisional application No. 62/745,127, filed on Oct. 12, 2018, provisional application No. 62/747,953, filed on Oct. 19, 2018.

(51) Int. Cl.
*A63B 21/04* (2006.01)
*A63B 21/055* (2006.01)
*A63B 21/08* (2006.01)
*A63B 21/16* (2006.01)

(52) U.S. Cl.
CPC ..... *A63B 21/0552* (2013.01); *A63B 21/0628* (2015.10); *A63B 21/08* (2013.01); *A63B 21/154* (2013.01); *A63B 21/16* (2013.01); *A63B 21/00065* (2013.01)

(58) Field of Classification Search
CPC ..... A63B 21/0428; A63B 21/0442; A63B 21/055; A63B 21/0552; A63B 21/0557; A63B 21/062; A63B 21/0624; A63B 21/0626; A63B 21/0628; A63B 21/0632; A63B 21/08; A63B 21/15; A63B 21/151; A63B 21/154; A63B 21/156; A63B 21/16; A63B 21/4033; A63B 21/4035; A63B 21/023; A63B 21/025; A63B 21/026; A63B 21/028; A63B 21/05; A63B 21/0555; A63B 2071/009; A63B 2225/093; A63B 2225/10
See application file for complete search history.

(56) References Cited

U.S. PATENT DOCUMENTS 3,716,231 A 2/1973 Martin
4,188,029 A * 2/1980 Brower ..... A63B 21/154 248/636
4,252,314 A * 2/1981 Ceppo ..... A63B 21/00181 482/104
4,257,590 A * 3/1981 Sullivan ..... A63B 21/154 482/133
4,286,782 A 9/1981 Fuhrhop
4,339,125 A 7/1982 Uyeda et al.
4,492,375 A 1/1985 Connelly
4,582,320 A 4/1986 Shaw
4,634,127 A 1/1987 Rockwell
4,635,934 A 1/1987 Roethke
4,697,809 A 10/1987 Rockwell
4,826,153 A * 5/1989 Schalip ..... A63B 21/06 482/94
4,856,775 A 8/1989 Colledge et al.
4,907,798 A * 3/1990 Burchatz ..... A63B 21/06 482/104
4,951,943 A * 8/1990 Farenholtz ..... A63B 69/004 482/102
4,955,604 A 9/1990 Pogue
5,050,868 A 9/1991 Pearson
5,116,297 A 5/1992 Stonecipher
5,135,453 A 8/1992 Sollenberger
5,184,992 A 2/1993 Banks
5,205,803 A * 4/1993 Zemitis ..... A63B 21/0552 482/121
D358,623 S 5/1995 Macasieb
5,529,558 A 6/1996 Koenig
5,569,133 A 10/1996 Vittone
5,688,216 A 11/1997 Mauriello
5,722,922 A 3/1998 Watterson et al.
5,800,321 A 9/1998 Webber
5,951,444 A 9/1999 Webber
5,971,897 A 10/1999 Olson et al.
D439,292 S 3/2001 Webber et al.
6,202,263 B1 * 3/2001 Harker ..... B62J 7/08 114/230.2
6,217,483 B1 4/2001 Kailassy
6,238,323 B1 5/2001 Simonson
6,261,205 B1 7/2001 Elefson
6,394,935 B1 5/2002 Lake
6,447,430 B1 9/2002 Webb et al.
6,482,139 B1 11/2002 Haag
6,508,743 B1 1/2003 Fortin
6,527,683 B2 3/2003 Tolles
D489,601 S 5/2004 Meeker
D512,113 S 11/2005 Carter
D517,134 S 3/2006 Panatta et al.
7,192,389 B2 * 3/2007 Allison ..... A63B 21/0552 482/104
D550,790 S 9/2007 Staten
D550,791 S 9/2007 Rogers et al.
D550,792 S 9/2007 Rogers et al.
D551,306 S 9/2007 Rogers et al.
7,488,277 B1 2/2009 Knapp
7,549,950 B1 6/2009 Lundquist et al.
7,601,105 B1 10/2009 Gipson, III et al.
7,727,129 B1 6/2010 Goddard
7,981,010 B1 7/2011 Webber et al.
7,998,037 B2 8/2011 Luquette
7,998,040 B2 8/2011 Kram et al.
8,057,368 B1 11/2011 Lyszczarz
8,096,926 B1 1/2012 Batea
8,172,733 B1 5/2012 Batca
8,337,370 B2 12/2012 Rogers et al.
D679,764 S 4/2013 Alessandri et al.
8,827,875 B2 9/2014 Schiano
9,011,301 B2 4/2015 Balandis et al.
9,028,381 B2 5/2015 Mestemaker
9,067,100 B2 6/2015 Habing
9,289,638 B2 3/2016 Towley, III et al.
9,302,139 B2 4/2016 Habing et al.
9,421,413 B2 8/2016 Staten et al.
D769,991 S 10/2016 Thomas
D772,356 S 11/2016 Gregory
D781,452 S 3/2017 Bokros
9,656,116 B2 5/2017 Giannelli et al.
9,802,075 B2 10/2017 Gvoich
D806,808 S 1/2018 Gregory
D808,475 S 1/2018 Meredith et al.
D815,305 S 4/2018 Alvarado et al.
D830,481 S 10/2018 Yang
10,265,572 B2 4/2019 Bach et al.
D849,160 S 5/2019 Lau
D855,720 S 8/2019 Kuka
10,384,094 B1 * 8/2019 Newman ..... A63B 71/0054
2003/0100413 A1 5/2003 Huang
2003/0115955 A1 6/2003 Keiser
2003/0134723 A1 7/2003 Greenland
2004/0018920 A1 1/2004 Simonson
2005/0054493 A1 3/2005 Skilken et al.
2005/0202941 A1 9/2005 Vaes
2006/0035765 A1 2/2006 Smith
2006/0040799 A1 2/2006 Pompile
2006/0183607 A1 8/2006 Collias
2006/0252615 A1 11/2006 Melcer
2007/0037674 A1 2/2007 Finn et al.
2007/0054785 A1 3/2007 Drechsler
2007/0093365 A1 4/2007 Batea
2007/0155595 A1 7/2007 Rogers et al.
2007/0155596 A1 7/2007 Rogers et al.
2007/0238583 A1 * 10/2007 Cunningham ..... A63B 23/0423 482/52
2008/0113852 A1 5/2008 Caldwell
2009/0143203 A1 6/2009 Knapp
2009/0170675 A1 7/2009 Giannelli et al.
2010/0016129 A1 1/2010 Chou
2010/0216610 A1 8/2010 Gedeon-Janvier

(56) References Cited

U.S. PATENT DOCUMENTS

| | | | | |
|---|---|---|---|---|
| 2010/0292057 | A1 | 11/2010 | Dunn | |
| 2012/0289384 | A1 | 11/2012 | Staten et al. | |
| 2012/0329613 | A1 | 12/2012 | Schiano | |
| 2013/0035220 | A1 | 2/2013 | Adams | |
| 2013/0109543 | A1 | 5/2013 | Reyes | |
| 2013/0274075 | A1 | 10/2013 | Habing et al. | |
| 2013/0296143 | A1 | 11/2013 | Staten et al. | |
| 2013/0296146 | A1 | 11/2013 | Staten et al. | |
| 2014/0087928 | A1 | 3/2014 | Luedeka | |
| 2014/0256517 | A1 | 9/2014 | Poppinga | |
| 2015/0016919 | A1 | 1/2015 | Tambornino et al. | |
| 2015/0051054 | A1 | 2/2015 | Barnhill | |
| 2015/0083681 | A1 | 3/2015 | Childs | |
| 2015/0126335 | A1 | 5/2015 | Gilson et al. | |
| 2015/0141221 | A1 | 5/2015 | Delgado | |
| 2015/0182773 | A1 | 7/2015 | Olson et al. | |
| 2015/0246258 | A1 | 9/2015 | Hockridge | |
| 2015/0290488 | A1 | 10/2015 | Hopperstad et al. | |
| 2015/0352395 | A1 | 12/2015 | Gregory | |
| 2016/0023035 | A1 | 1/2016 | Meyer | |
| 2016/0213967 | A1 | 7/2016 | Habing et al. | |
| 2017/0007877 | A1 | 1/2017 | Leipheimer | |
| 2017/0056705 | A1 | 3/2017 | Zha et al. | |
| 2017/0189736 | A1 | 7/2017 | Martin | |
| 2017/0246496 | A1 | 8/2017 | Nelson et al. | |
| 2017/0246504 | A1 | 8/2017 | Simmons | |
| 2018/0036573 | A1 | 2/2018 | Lennox et al. | |
| 2018/0243597 | A1 | 8/2018 | Schlegel | |
| 2019/0240521 | A1 | 8/2019 | Staten | |
| 2019/0240525 | A1* | 8/2019 | Leipheimer ..... | A63B 21/075 |
| 2019/0275363 | A1 | 9/2019 | Jones et al. | |
| 2020/0155889 | A1* | 5/2020 | Leipheimer ..... | A63B 21/156 |

FOREIGN PATENT DOCUMENTS

| | | | |
|---|---|---|---|
| FR | 2630652 | A1 | 11/1989 |
| GB | 2346808 | A | 8/2000 |
| KR | 200466889 | Y1 | 5/2013 |
| KR | 20140060130 | A | 5/2014 |
| WO | 9842411 | A1 | 10/1998 |
| WO | 201893699 | A1 | 5/2018 |
| WO | 2018208772 | A1 | 11/2018 |

OTHER PUBLICATIONS

Screenshots from <https://www.youtube.com/watch?v=A4xv8OhVbzl>, dated May 17, 2018.

Product promotional materials for Dynamic Fitness Ultra Pro Rack Series from <https://web.archive.org/web/20170112075250/https://mydynamicfitness.com> dated Jan. 12, 2017.

Product listing for Rogue Monster Lever Arms from <https://web.archive.org/web/20160529110340/http://www.roguefitness.com/monster-lever-arms>, dated May 29, 2016.

Product listing for Rogue Monster Lever Arms from <https://web.archive.org/web/20161111082206/http://www.roguefitness.com/monster-lever-arms>, dated Nov. 11, 2016.

Jul. 23, 2019—(WO) International Search Report & Written Opinion—App PCT/US2019/021017.

Sorinex Exercise Equipment: "Base camp jammer arms adjustable attachment point", Feb. 27, 2018 (Feb. 27, 2018), pp. 1-3, Retrieved from the Internet: URL:https:www.facebook.com/sorinex.strength/videos/base-camp-jammer-arms-adjustabl e-attachment-point/10158262519208647/.

Mar. 31, 2020—(WO) ISR and WO—App PCT/US2019/056130.

Product listing for Rogue Spud Inc Pulley Systems<http://web.archive.org/web/20170102063310/https:/www.roguefitness.com/spud-inc-pulley-systems>, dated Jan. 2, 2017.

Product listing for Rogue Monster Lat Pulldown/Low Row (Rack Mounted) <http://web.archive.org/web/20190828224237/https://www.roguefitness.com/lat-pulldown-low-row-rackmounted >, dated Aug. 28, 2019.

* cited by examiner

WEIGHTLIFTING MACHINE

CROSS-REFERENCE TO RELATED APPLICATIONS

This application claims priority to U.S. Provisional Application No. 62/745,127 filed on Oct. 12, 2018; U.S. Provisional Application No. 62/745,838 filed on Oct. 15, 2018; U.S. Provisional Application No. 62/746,909 filed on Oct. 17, 2018; U.S. Provisional Application No. 62/747,953 filed on Oct. 19, 2018; U.S. Provisional Application No. 62/749,972 filed on Oct. 24, 2018; U.S. Provisional Application No. 62/750,690, filed on Oct. 25, 2018; U.S. Provisional Application No. 62/790,324 filed on Jan. 9, 2019; U.S. Provisional Application No. 62/797,048 filed on Jan. 25, 2019; and U.S. Provisional Application No. 62/890,419 filed on Aug. 22, 2019; all of which above referenced applications are incorporated by reference in their entireties.

TECHNICAL FIELD

This disclosure relates to weightlifting machines for use with weight rack assemblies, and more specifically, to weightlifting machines including components and features configured for connecting a cable-based weightlifting machine to a traditional weight rack assembly.

BACKGROUND

Various different types of weightlifting machines exist, which provide users the ability to perform a weightlifting exercise where the resistance element providing the resistance to the user for the weightlifting exercise moves in a controlled manner. In many cases, the weightlifting machine may alter the movement direction of the resistance element to be different from the direction of the force exerted by the user. For instance, a weightlifting machine may utilize a pulley and a cable to redirect the movement of a resistance element to move upwards when a user pushes downward on a grip member, such as a weightlifting machine for doing a lat pulldown exercise. These types of weightlifting machines may often be limited so a user can only perform a limited number of exercises with them, yet these machines may take up valuable space on a gym floor. This is a significant concern for small gyms and in-home gyms, where space may be extremely limited. Additionally, a cable-based weightlifting machine that is configured either as a standalone machine or a component to be connected to a weight rack requires significant financial expenditure and may present difficulties with shipping and assembly. Accordingly, a need exists for a weightlifting machine with this type of resistance element movement that can be integrated with an existing weight rack structure, to provide a user the ability to perform multiple exercises in a reduced space, with cost efficiency and simple installation.

BRIEF SUMMARY

Aspects of this disclosure may relate to a weight rack system that includes a frame formed from an arrangement of a plurality of vertical frame members that are connected together with a plurality of lateral frame members extending between the plurality of vertical frame members. Each lateral frame member and each vertical frame member may include a rectangular metal tube having four side surfaces defining a hollow interior with a plurality of holes on at least one of the side surfaces of each lateral and vertical frame member. The rack system may also include a pulley assembly mounted on the frame, where the pulley assembly includes a first pulley connected to the frame at a first location and a second pulley connected to a first lateral frame member of the plurality of lateral frame members at a second location such that the second pulley is spaced from the first pulley, and a cable connected at one end to a movable connection configured for engaging a resistance element and at an opposite end to a grip attachment. The cable may extend from the grip attachment to the first pulley and engages the first pulley to redirect the cable, where the cable further extends from the first pulley to the second pulley and engages the second pulley to redirect the cable. The cable may extend from the second pulley to the movable connection by extending through a first hole of the plurality of holes on an upper surface of the first lateral frame member, through the hollow interior of the first lateral frame member, and through a second hole of the plurality of holes on a lower surface of the first lateral frame member. The cable may extend directly from the first pulley to the second pulley, and in some embodiments, the first hole and the second hole may be aligned with each other.

Still other aspects of this disclosure may relate to a weight rack having a pulley assembly and cable where a first protector is received in the first hole and the cable extends through an aperture of the first protector and a second protector is received in the second hole and the cable extends through an aperture of the second protector. The first protector may be formed from a polymer material. In addition, the first pulley may be located outside a perimeter of the frame, where the pulley assembly further includes a mount removably connected to the frame and rotatably supporting the first pulley, the mount including a mounting structure with a first side mounting plate arranged on a first side of the first pulley and a second side mounting plate arranged on a second side of the first pulley opposite the first side, and where the first side mounting plate and the second side mounting plate are connected to opposite sides of the first lateral frame member. The mount also includes a front mounting plate connected to a vertical frame member adjacent the first lateral frame member. The mount further may rotatably support the second pulley, and where the first side mounting plate is arranged on a first side of the second pulley, and the second side mounting plate is arranged on a second side of the second pulley opposite the first side. The plurality of holes on the lateral frame members may be evenly spaced apart from one another along at least a portion of a length of each frame member.

Additional aspects of this disclosure may relate to a method of arranging a weight rack assembly, including: providing a frame having a plurality of vertical frame members and a plurality of lateral frame members, where the lateral frame members connect to the vertical frame members, and each lateral frame member and each vertical frame member may include a rectangular metal tube having four side surfaces defining a hollow interior with a plurality of holes on at least one of the side surfaces of each lateral and vertical frame member. The method may also include mounting a pulley assembly to the frame, where the pulley assembly includes a first pulley connected to the frame at a first location and a second pulley connected to a first lateral frame member of the plurality of lateral frame members at a second location such that the second pulley is spaced from the first pulley. In addition, the method includes connecting a cable with the pulley assembly, where the cable is configured for engaging a resistance element and the cable extends from a grip attachment at a first end of the cable and engages the first pulley to redirect the cable and the cable further extends from the first pulley to the second pulley and engages the second pulley to redirect the cable. The cable may extend through a first hole of the plurality of holes located in an upper surface of the first lateral frame member, through the hollow interior of the first lateral frame member, and through a second hole of the plurality of holes on a lower surface of the first lateral frame member. The method may also include securing a first protector in the first hole in the upper surface of the first lateral frame member, where the cable extends through an aperture of the first protector, and securing a second protector in the second hole in the lower surface of the first lateral frame member, where the cable extends through an aperture of the second protector. The method may further include: connecting a second end of the cable to a movable connection; connecting a first end of a resistance band to a fixed connection attached to a second lateral frame member, where the second lateral frame member is spaced apart from the first lateral frame member; and connecting a second end of a resistance band to the movable connection such that the movable connection stretches the resistance band when the grip attachment is moved in a direction away from the first pulley.

Yet other aspects of this disclosure may relate to a weight rack system including a frame having an arrangement of a plurality of vertical frame members that are connected together with a plurality of lateral frame members extending between the plurality of vertical frame members, where each lateral frame member includes a rectangular metal tube having fours side surfaces defining a hollow interior with a plurality of holes on at least one of the side surfaces of each frame lateral and vertical member, a pulley assembly attached to the frame, where the pulley assembly includes a first pulley and a mount connected to the frame, wherein the first pulley is rotatably mounted on the mount. The rack may further include a cable connected at a first end to a movable connection and connected at a second end to a grip attachment, where the cable extends from the grip attachment to the first pulley and engages the first pulley to redirect the cable, and the cable further extends from the first pulley to the movable connection. A resistance band may be attached to the movable connection, where the resistance band is further attached to a fixed connection connected to the frame and spaced apart from the moveable connection, such that resistance band extends between the moveable connection and the fixed connection in tension. The movable connection may be configured to move away from the fixed connection to stretch the resistance band when the grip attachment is moved in a direction away from the first pulley, via the cable. The weight rack may further include a sheath completely encircling at least a portion of a length of the resistance band, where the sheath includes a flexible tubular body with an internal passage receiving the resistance band therein, and where the tubular body is connected to the fixed connection and to the movable connection such that the sheath is configured to extend when the movable connection is moved away from the fixed connection. The sheath may encircle an entire length of the resistance band. The tubular body includes a first connecting structure on a first end of the tubular body directly connected to the fixed connection and a second connecting structure on a second end of the tubular body directly connected to the movable connection. The first and second connecting structures may be loops that are attached to the first and second ends of the tubular body. The sheath may be formed from a nylon-based fabric.

Still further aspects of the disclosure may relate to a weight rack system, including a frame including an arrangement of a plurality of vertical frame members that are connected together with a plurality of lateral frame members extending between the plurality of vertical frame members, and a pulley assembly attached to the frame, where the pulley assembly includes a first pulley and a mount connected to the frame, and where the first pulley is rotatably mounted on the mount. The rack system may include a cable connected at a first end to a movable connection and at a second end to a grip attachment, where the cable extends from the grip attachment to the first pulley and engages the first pulley to redirect the cable. The cable may further extend from the first pulley to the movable connection. The rack may further include a weight support attached to the movable connection, where the weight support includes a support plate with a shaft extending upward from the support plate, wherein the weight support is configured to support one or more weight plates such that the one or more weight plates rest on the support plate, and the shaft is configured to extend through a hole in each of the one or more weight plates. The movable connection may be configured to raise the weight support when the grip attachment is moved in a direction away from the first pulley, via the cable. The weight rack may further include a resistance band, where the weight support further has a connection beneath the support plate, and where the resistance band is attached to the connection and to a fixed connection attached to the frame. The resistance band may extend between the connection beneath the support plate and the fixed connection in tension, and where the resistance band is configured to be stretched when the weight support is raised via movement of the grip attachment. A base support may be attached to a first vertical frame member of the plurality of vertical frame members, where the base support includes a mounting structure configured to releasably attach to the first vertical frame member and a support member configured to engage and support the weight support at an elevated position. The support member of the base support may extend into a movement path of the weight support defined by a range of motion of the cable, such that the support member of the base support is configured to engage and support the weight support at the elevated position within the movement path of the weight support. The support member may include two legs extending from a base portion thereby creating a space between the two legs, where the two legs extend away from each other. The resistance band attached to the weight support and the frame extends between the weight support and the frame, and where the resistance band extends between the space between the two legs. The mounting structure of the base support may further include a bridge member connected to the two legs, where each leg has a height that tapers from a first end proximate the base portion and a second proximate a distal end.

Other aspects of this disclosure may relate to a weightlifting assembly including: a weight rack that includes a first vertical frame member, a second vertical frame member spaced from the first vertical frame member, a first lateral frame member connected to the first vertical frame member at a first location and connected to the second vertical frame member at a second location, where the first lateral frame member includes a plurality of holes arranged along a top surface and a bottom surface, and a second lateral frame member connected to the first vertical frame member and connected to the second vertical frame member, where the second lateral frame member is spaced apart from and below the first lateral frame member. The weightlifting assembly may further include a pulley assembly attached to the weight rack, where the pulley assembly includes a first pulley and a mount connected to the frame, where the first pulley is rotatably mounted on the mount. A cable may have a first end connected to a grip attachment and a second end opposite the first end, where the cable extends from the grip attachment to the first pulley and engages the first pulley to redirect the cable. A weight plate assembly may be releasably connected to the weight rack, where the weight plate assembly includes a top mount releasably connected to the first lateral frame member, where the top mount includes an opening and the cable extends through the opening, a bottom mount releasably connected to the second lateral frame member, and a plurality of weights arranged in a stack between the top mount and the bottom mount and also between the first vertical frame member and the second vertical frame member. Each weight of the plurality of weights may have a first aperture that is aligned with the opening of the top mount and a second aperture that is offset from the first aperture. The weight plate assembly may also include a first guide fixedly connected to the top mount and the bottom mount and extending vertically and linearly from the top mount to the bottom mount, where the first guide extends through the second aperture of each weight of the plurality of weights, a weight engaging member connected to the cable, where the weight engaging member is an elongated member that extends through the first aperture of each weight, and a removable pin that engages a first weight of the plurality of weights and also engages the weight engaging member such that lifting the weight engaging member is configured to lift the first weight and any additional weights of the plurality of weights stacked on top of the first weight. A first hole of the plurality of holes in the first lateral frame member may be aligned with the opening of the top mount, where the cable extends through the first hole and the opening. A first protector may be secured in the first hole of the plurality of holes in the first lateral frame member, and a second protector may be secured in a second hole on a bottom surface of the plurality of holes in the first lateral frame member, where the first hole and the second hole are aligned with each other and with the opening of the top mount. The first lateral frame member of the frame may have a hollow interior, and the first hole may be positioned on a top surface of the first lateral frame member. The cable may extend through an aperture in the first protector, extends across the hollow interior of the first lateral frame member, and extends through a second aperture in the second protector. The weight plate assembly may also include a second guide fixedly connected to the top mount and the bottom mount and extending vertically and linearly from the top mount to the bottom mount, wherein the second guide extends through a third aperture in each weight of the plurality of weights, wherein the third aperture is spaced from the second aperture.

Still other aspects of this disclosure may relate to a method of modifying a weight rack that includes providing the weight rack in a configuration for performing a first weightlifting exercise, where the weight rack includes a plurality of interconnected frame members. Each frame member may be a rectangular metal tube having four side surfaces defining a hollow interior with a plurality of holes arranged along at least a portion of a length of each frame member on at least two of the side surfaces thereof. The plurality of frame members may include a first vertical frame member, a second vertical frame member spaced from the first vertical frame member, a first lateral frame member connected to the first vertical frame member at a first location and connected to the second vertical frame member at a second location, where the first lateral frame member includes the plurality of holes arranged along at least a top surface and a bottom surface, and a second lateral frame member connected to the first vertical frame member and connected to the second vertical frame member, where the second lateral frame member is spaced apart from and below the first lateral frame member. The method may also include attaching a pulley assembly to the weight rack, where the pulley assembly comprises a first pulley and a mount connected to the frame and where the first pulley is rotatably mounted on the mount, and connecting a weight plate assembly to the weight rack, where the weight plate assembly includes a top mount releasably connected to the first lateral frame member, where the top mount includes an opening and a bottom mount releasably connected to the second lateral frame member. The weight rack may also include a plurality of weights arranged in a stack between the top mount and the bottom mount and also between the first vertical frame member and the second vertical frame member, where each weight of the plurality of weights has a first aperture that is aligned with the opening of the top mount and a second aperture that is offset from the first aperture, a first guide fixedly connected to the top mount and the bottom mount and extending vertically and linearly from the top mount to the bottom mount, where the first guide extends through the second aperture of each weight of the plurality of weights, a weight-engaging member comprising an elongated member that extends through the first aperture of each weight, and a removable pin that engages a first weight of the plurality of weights and also engages the weight-engaging member such that lifting the weight-engaging member is configured to lift the first weight and any additional weights of the plurality of weights stacked on top of the first weight. The method may further include routing a cable system through the pulley assembly such that the cable system engages the first pulley to redirect the cable system, and the cable system further extends through two holes of the plurality of holes in the first lateral frame member and through the opening of the top mount, connecting a first end of a cable system to a grip, such that the cable system extends from the grip to the first pulley, and connecting a second end of the cable system to the weight engaging member. As another option, the method may include securing a protector into the two holes of the plurality of holes prior to routing the cable system through the two holes. The weight rack may be configured for performing a second weightlifting exercise that is different from the first weightlifting exercise, such that the second weightlifting exercise is performed by pulling on the grip to raise the weight-engaging member, the first weight, and any additional weights stacked on top of the first weight, via movement of the cable system.

Yet other aspects of this disclosure may relate to a weight rack assembly including a frame including a plurality of interconnected vertical frame members and lateral frame members, a pulley assembly connected to the frame, where the pulley assembly includes a first pulley and mount rotatably supporting the first pulley, and where the pulley assembly is attached to the frame by attaching the mount to the frame. The weight rack assembly may have a cable engaged with the pulley assembly, where the cable engages the first pulley to redirect the cable, where a first end of the cable is attached to a weight support. The weight support may include a support plate with a shaft extending upward from the support plate, where the weight support is configured to support one or more weight plates such that the one or more weight plates rest on the support plate and the shaft is configured to extend through a hole in each of the one or more weight plates. Other aspects of the weight rack assembly may include a second end of the cable may be connected to a grip attachment, a base support attached to a first vertical frame member of the vertical frame members, where the base support is configured to hold the weight support, a first end of a resistance band connected to the weight support, and a second end of the resistance band connected to the frame at a location spaced from the weight support, such that the resistance band extends between the weight support and the frame in tension. The base support may include a mounting structure that is releasably attached to the first vertical frame member and a support member configured to engage and support the weight support at an elevated position, where the support member of the base support extends into a movement path of the weight support defined by a range of motion of the cable, such that the support member of the base support is configured to engage and support the weight support at the elevated position within the movement path of the weight support. The support plate may include a lower connection on a bottom surface that attaches to the first end of the resistance band. The base support may also include a mounting structure configured to releasably attach to the first vertical frame member and a support member configured to engage and support the weight support at the elevated position. The support member includes two legs extending from a base portion thereby creating a space between the two legs, where the resistance band extends between the space between the two legs. The cable may extend through a hole located in an upper surface of the first lateral frame member, and a first protector may be secured in the hole in the upper surface of the first lateral frame member, wherein the cable extends through an aperture of the first protector.

DESCRIPTION OF THE DRAWINGS

To allow for a more full understanding of the present disclosure, it will now be described by way of example, with reference to the accompanying drawings in which.

DETAILED DESCRIPTION

Figure 1:
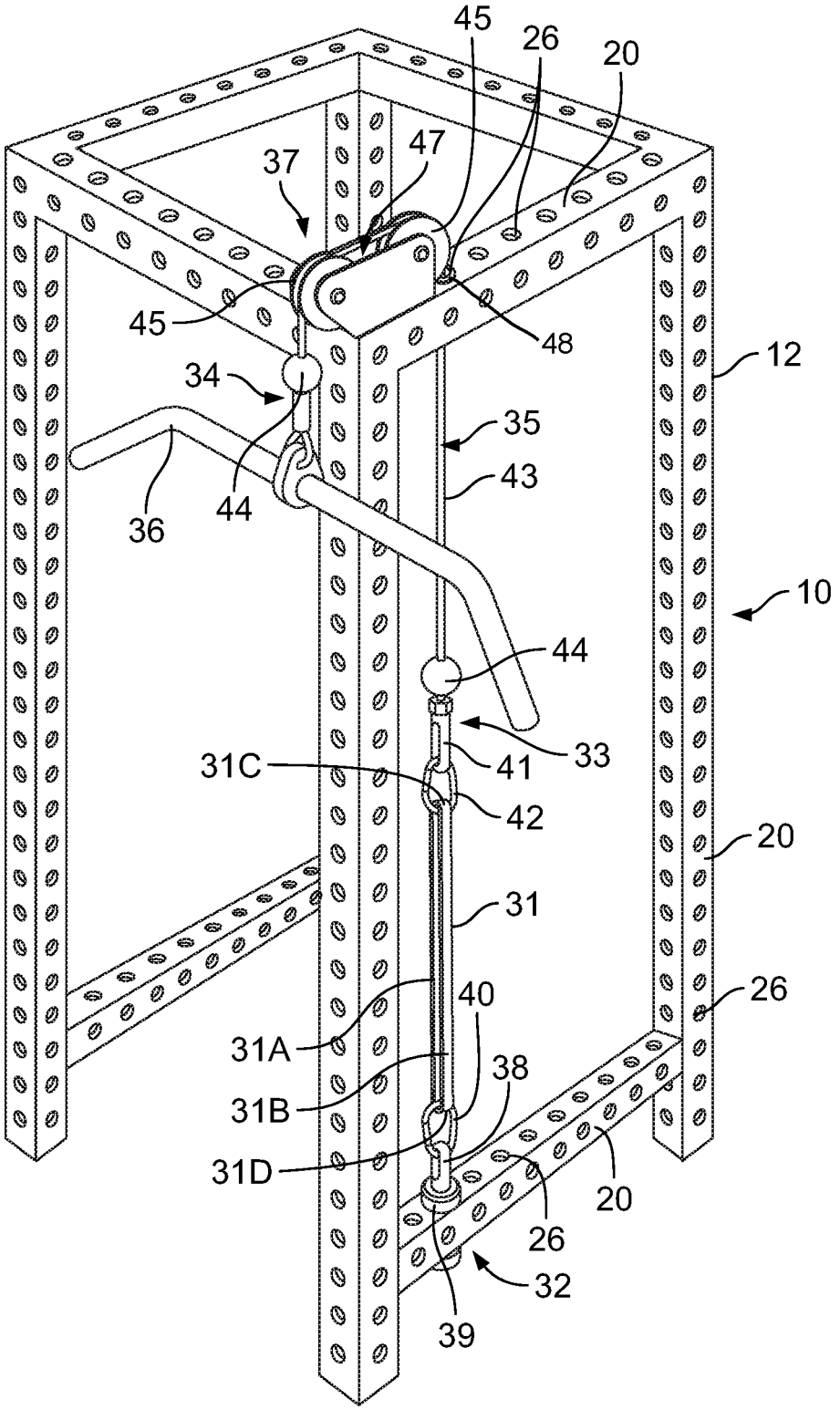
FIG. 1 illustrates a perspective view of one embodiment of a weightlifting machine connected to a weight rack assembly, in accordance with aspects of the disclosure.
Figure 2:
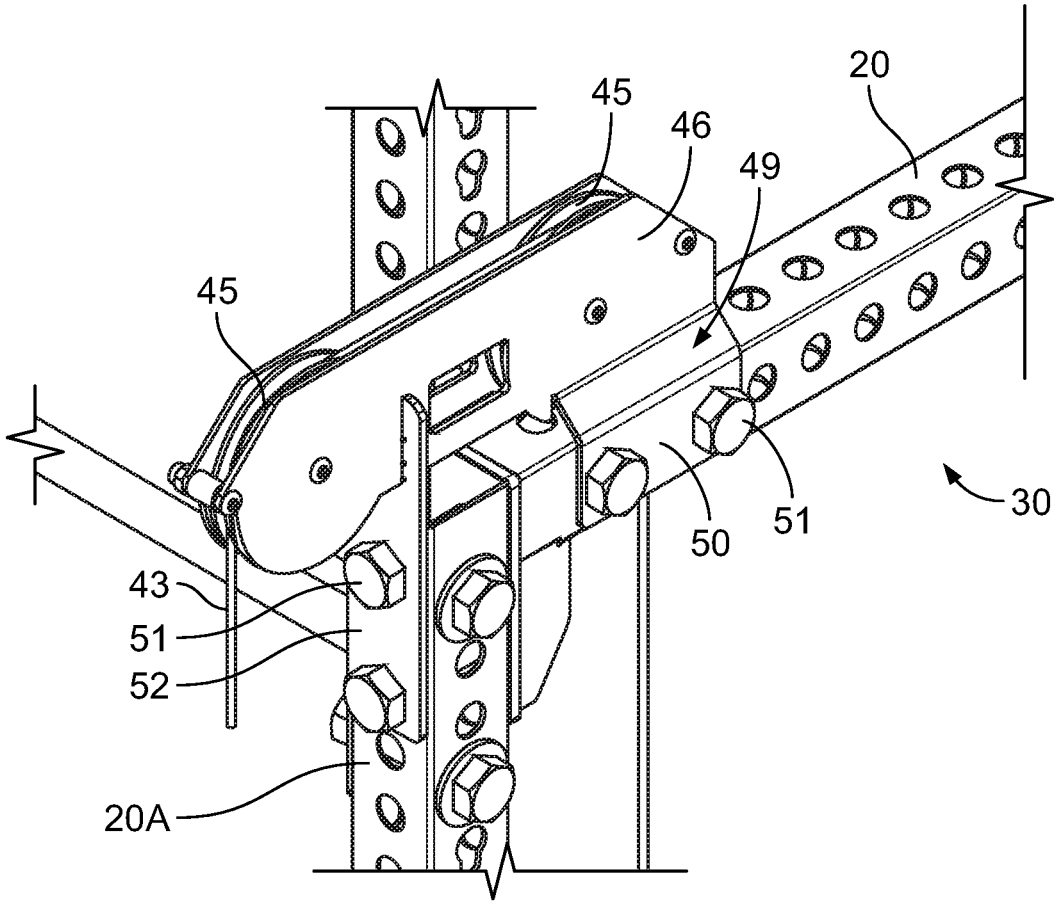
FIG. 2 illustrates a perspective view of a portion of another embodiment of a weightlifting machine connected to a weight rack assembly, in accordance with aspects of the disclosure.
Figure 3:
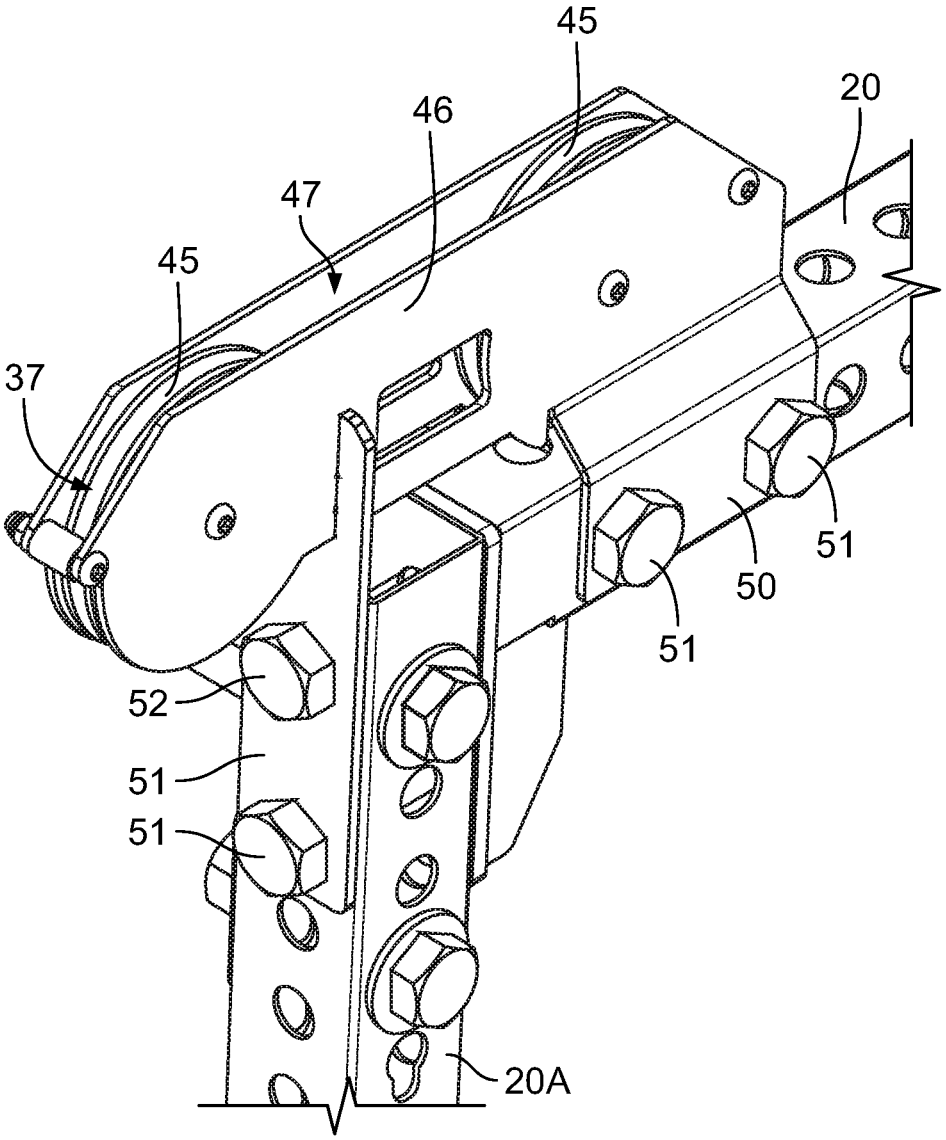
FIG. 3 illustrates a perspective view of the pulley assembly of the weightlifting machine of FIG. 2 with some components removed from the weight rack assembly, in accordance with aspects of the disclosure.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Also, while the terms "top," "bottom," "front," "back," "side," "rear," "distal," and the like may be used in this specification to describe various example features and elements of the invention, these terms are used herein as a matter of convenience, e.g., based on the example orientations shown in the figures or the orientation during typical use. Nothing in this specification should be construed as requiring a specific three-dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Plurality," as used herein, indicates any number greater than one, either disjunctively or conjunctively, as necessary, up to an infinite number.

"Integral joining technique" or means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto. Pieces joined with such a technique are described as "integrally joined."

"Substantially parallel" means that a first line, segment, plane, edge, surface, etc. is approximately (in this instance, within 5%) equidistant from with another line, plane, edge, surface, etc., over at least 50% of the length of the first line, segment, plane, edge, surface, etc.

In general, this disclosure relates to a weightlifting machine that attaches to a weight rack assembly, where the weightlifting machine includes a pulley assembly that mounts to a weight rack.

Figure 4:
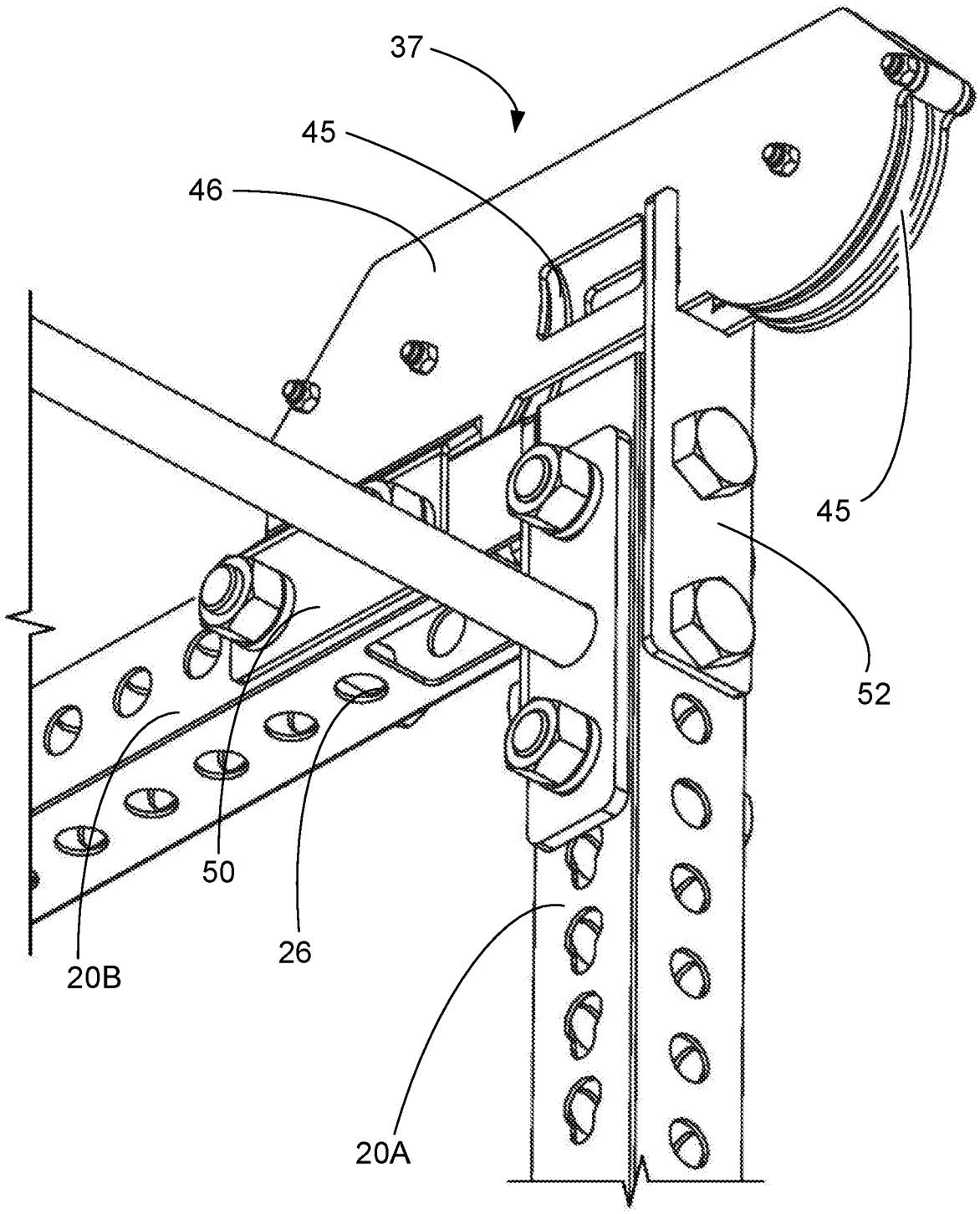
FIG. 4 illustrates a front perspective view of the weightlifting machine of FIG. 3, in accordance with aspects of the disclosure.
Figure 5:
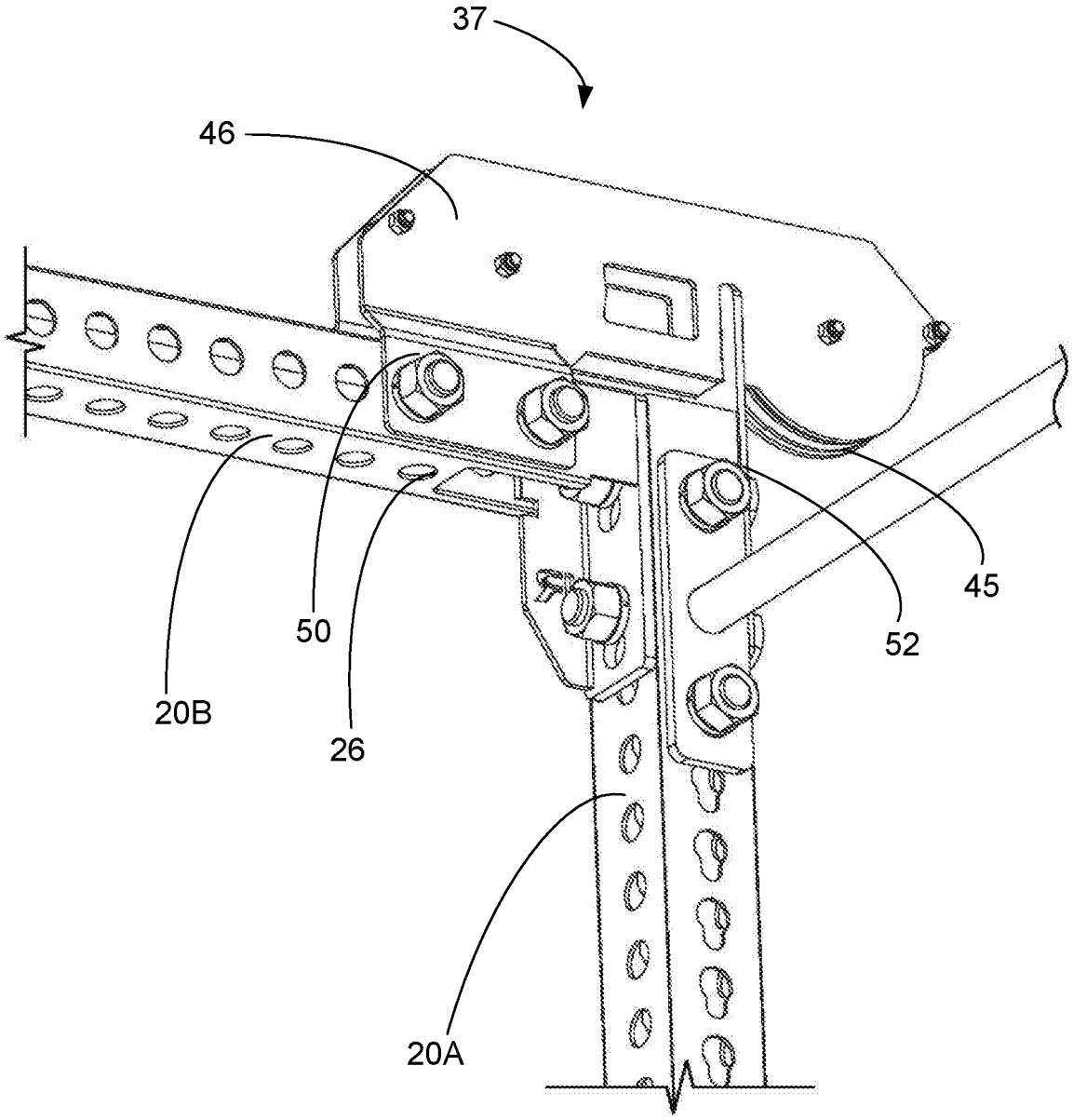
FIG. 5 illustrates a rear perspective view of the weightlifting machine of FIG. 3, in accordance with aspects of the disclosure.
Figure 6:
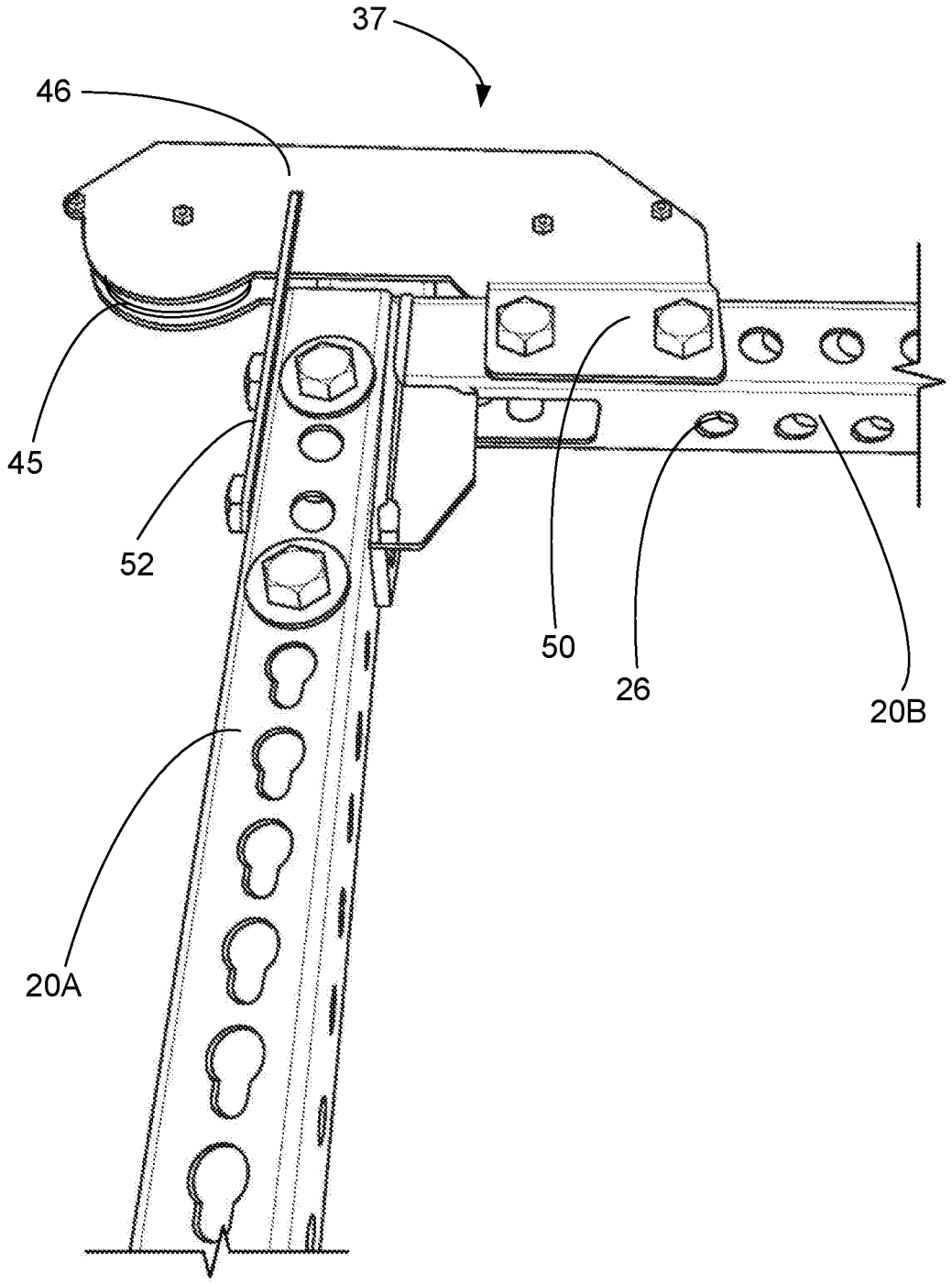
FIG. 6 illustrates a side perspective view of the weightlifting machine of FIG. 3, in accordance with aspects of the disclosure.
Figure 7:
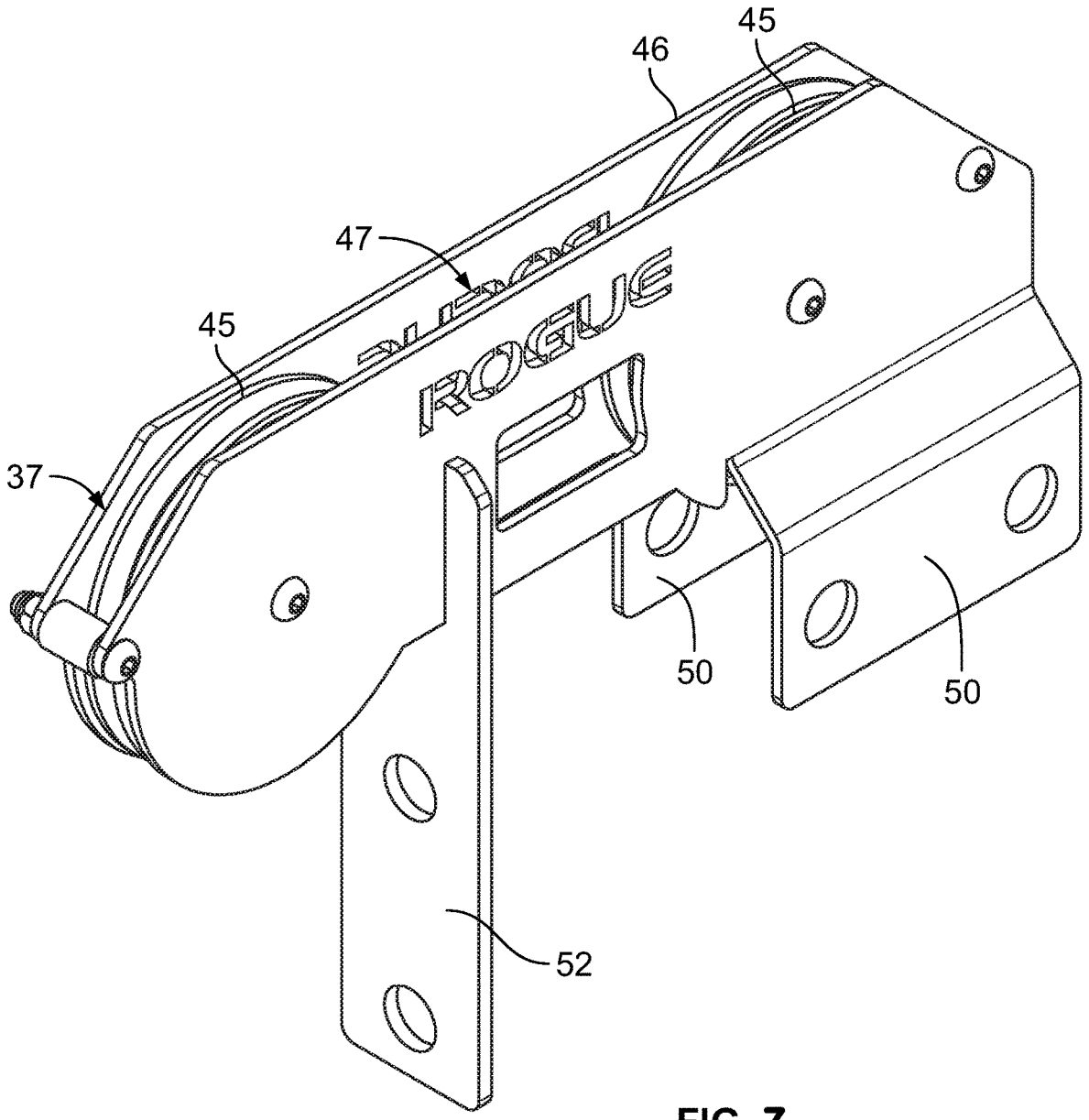
FIG. 7 illustrates a perspective view of the pulley assembly of the weightlifting machine of FIG. 2, in accordance with aspects of the disclosure.
Figure 8:
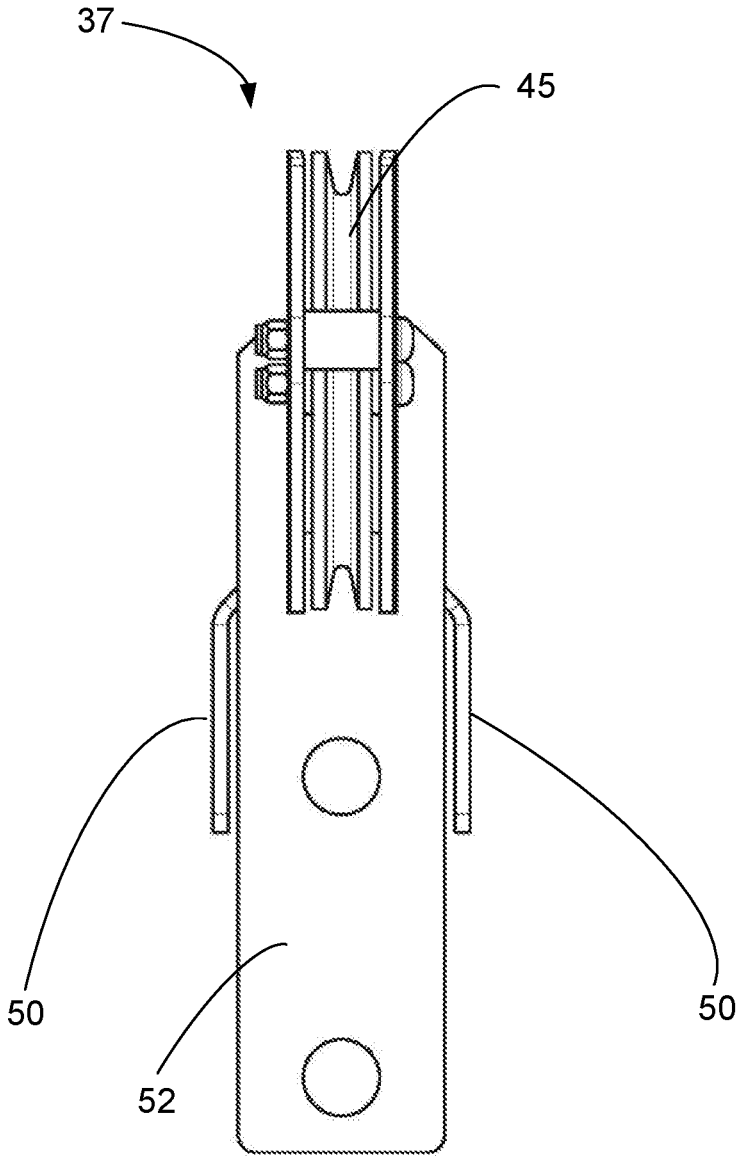
FIG. 8 illustrates a front view of the pulley assembly of the weightlifting machine of FIG. 2, in accordance with aspects of the disclosure.
Figure 9:
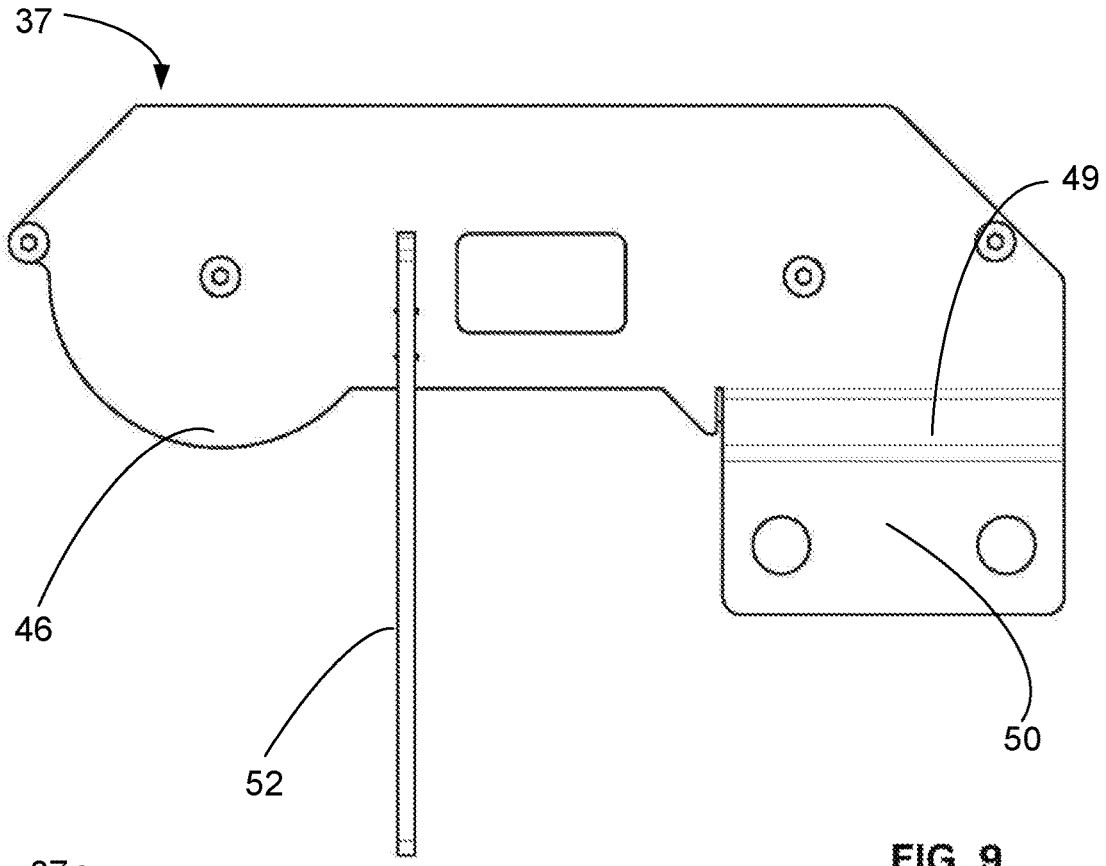
FIG. 9 illustrates a right side view of the pulley assembly of the weightlifting machine of FIG. 2, in accordance with aspects of the disclosure.
Figure 10:
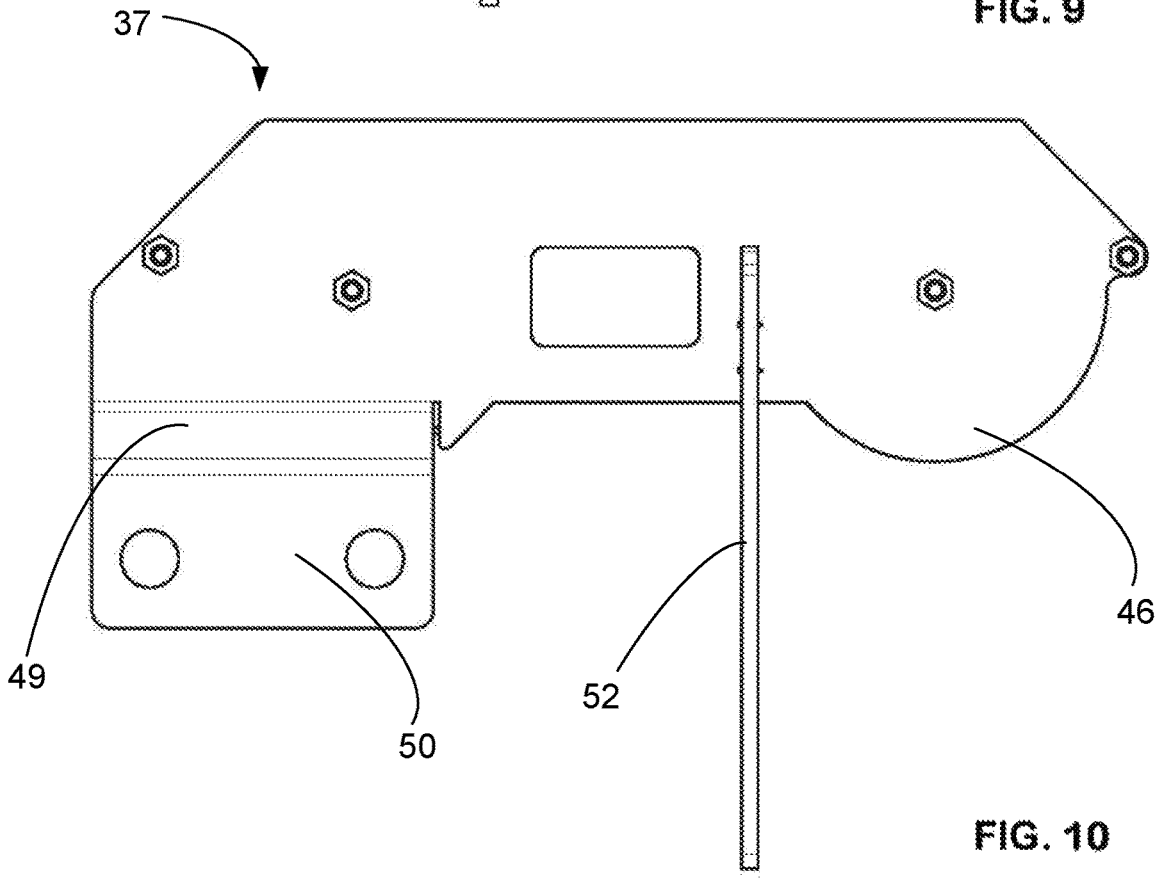
FIG. 10 illustrates a left side view of the pulley assembly of the weightlifting machine of FIG. 2, in accordance with aspects of the disclosure.
Figure 11:
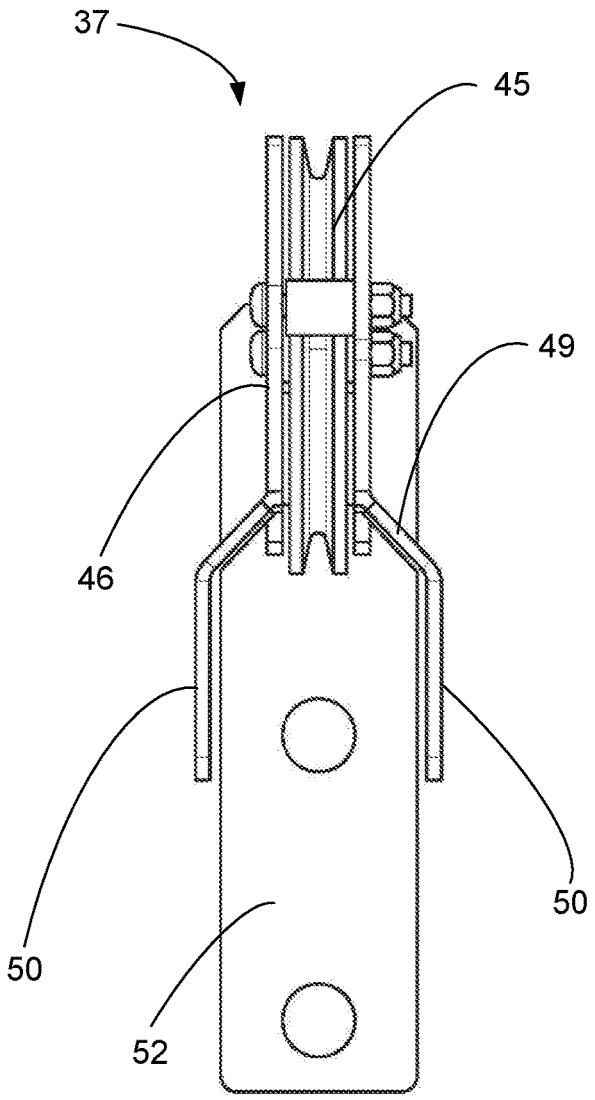
FIG. 11 illustrates a rear view of the pulley assembly of the weightlifting machine of FIG. 2, in accordance with aspects of the disclosure.
Figure 12:
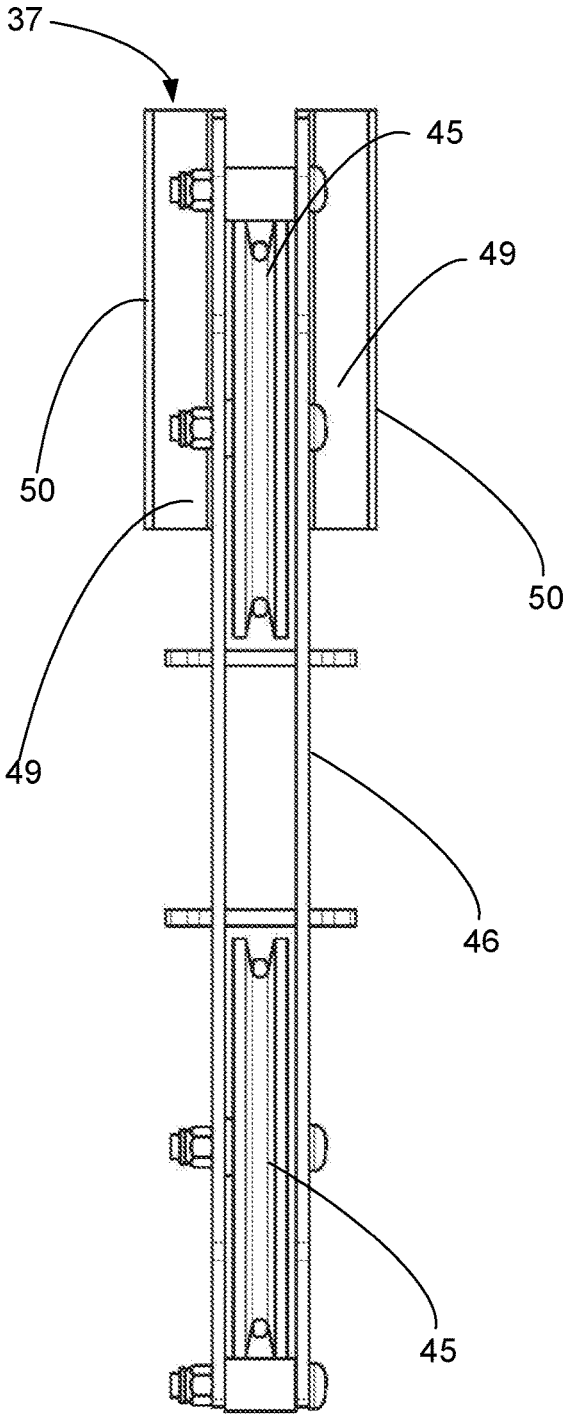
FIG. 12 illustrates a top view of the pulley assembly of the weightlifting machine of FIG. 2, in accordance with aspects of the disclosure.
Figure 13:
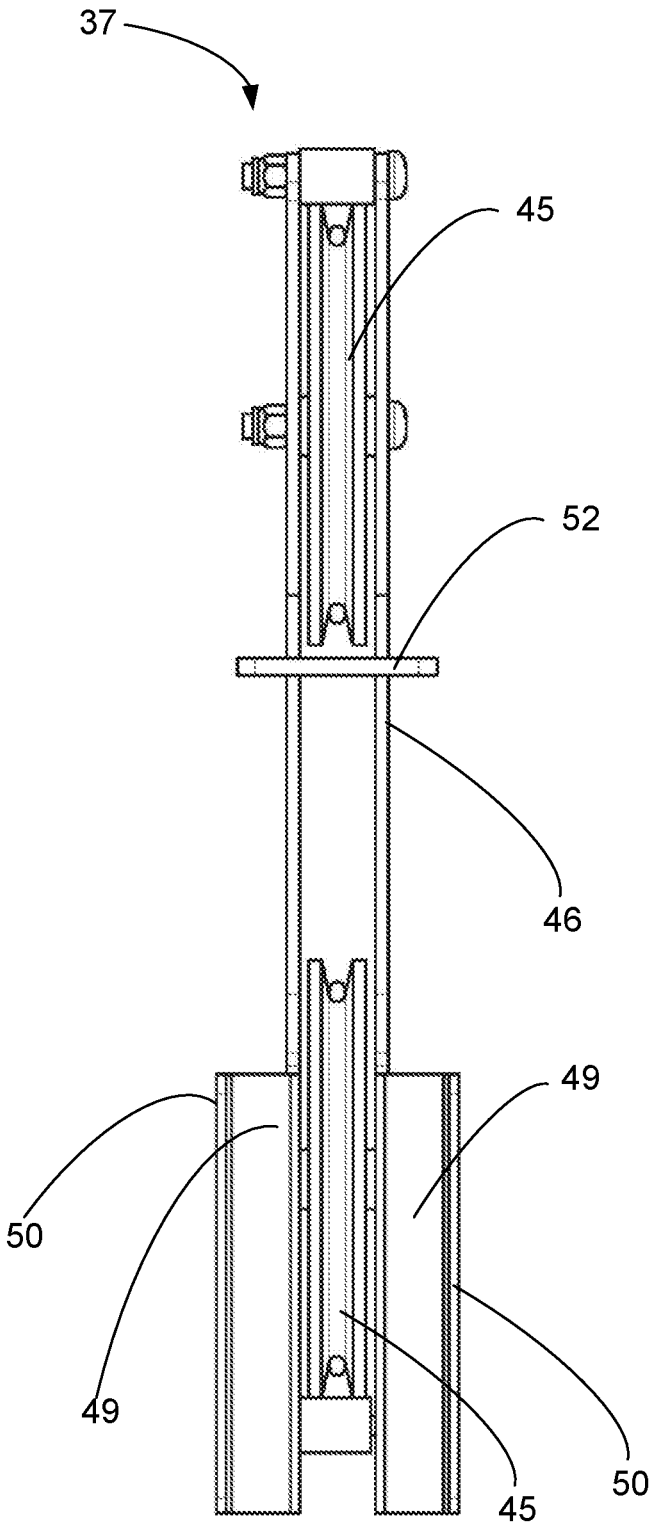
FIG. 13 illustrates a bottom view of the pulley assembly of the weightlifting machine of FIG. 2, in accordance with aspects of the disclosure.

FIG. 1 illustrates an example embodiment of a weight rack assembly 10 that includes a frame 12 and one or more weightlifting structures connected to and/or supported by the frame 12, including one or more shelves, barbell racks, and body weight exercise supports (e.g., bars, handles, and other structures for use in body weight exercises such as chin-ups, climbing, and others), and weightlifting accessories and mechanisms. The frame 12 may include an arrangement of frame members 20, including a plurality of vertical frame members 20A that are connected together with a plurality of lateral frame members 20B extending between the plurality of vertical frame members 20A. For example, the frame 12 in the embodiment of FIG. 1 is primarily formed by a plurality of structural support members or frame members 20 in the form of metal bars, which may be arranged and connected to each other as vertical beams, horizontal or lateral crossbeams, and angular beams to support the various structures of the rack assembly 10. The frame 12 may also include connectors in the form of brackets or other connecting structures for connecting the frame members 20 together to form the frame 12. The vertical and lateral frame members 20 as shown in FIG. 1 may be formed as rectangular metal tubes having four side surfaces defining a hollow interior, where at least one of side surfaces may include a plurality of openings or fastener holes 26 arranged at regular intervals along the lengths of frame member 20. As known to one skilled in the art, a rectangular tube may have either a square cross-sectional shape where each side surface has the same width or rectangular cross-sectional shape where a first side surface may have a different width than its adjacent side surface. Additionally, the plurality of holes 26 may be identical in shape and size as well as evenly spaced apart from one another along at least a portion of a length of each frame member. In some configurations, the holes 26 on each surface may be the same shape, such as circular openings, while in other configurations, the holes 26 may not be the same shape on each surface. For example, as shown in FIGS. 4-6, the vertical frame member 20A has holes 26 on a first surface and a plurality of circular and elongated holes 26 spaced along a second surface that is adjacent to the first surface. A single surface of a frame member 20 may include a mixture of different types of holes 26 in one embodiment. It is understood that opposing holes 26 (i.e., located directly across from each other) may be axially aligned along the length of the frame member 20 and have the same shapes. Alternatively, in some embodiments, the frame members 20 may include an L-shape or U-shaped structure with a plurality of holes 26 arranged along the length of each surface. This arrangement of fastener holes 26 permits fasteners (not shown) to extend into or through each frame member 20 in two transverse directions for connection of various components to any side of each frame member 20, including weightlifting structures, other frame members 20, and other structures. Suitable fasteners include pins (including cotter pins or other locking pins), bolts and other threaded connectors, clamps, and other types of fasteners. The rack assembly 10 and frame 12 structured in the manner illustrated in FIG. 1 and described herein permits construction in a modular manner to provide a wide variety of configurations as desired, including customizable sizes, layouts, and supported weightlifting structures. It is understood that the rack assembly 10 and frame 12 of FIG. 1 are depicted in a simple form, which may be larger and more complex, with multiple weightlifting structures connected thereto.

The various embodiments of weightlifting machines 30 disclosed herein may be configured for use with an existing weight rack assembly 10, by connection to typical and existing frame members 20 such as those described herein and shown in the FIGS. Connection of the weightlifting machines to such a weight rack assembly 10 may be done without the use of specialized frame members 20 or with minimal use of such specialized frame members 20.

The weight rack assembly 10 in FIG. 1 may include a weightlifting machine 30 for use with a resistance band 31 to provide resistance for a weightlifting exercise. The weightlifting machine 30 generally includes a fixed connection 32 fixedly attached to one of the frame members 20, a movable connection 33, a grip attachment 34, a cable system 35 connecting the movable connection 33 to the grip attachment 34, a grip 36 connected to the grip attachment 34, and a pulley system 37 guiding the cable system 35.

As seen in FIG. 1, the band 31 may be formed as a complete loop in one embodiment, such that two substantially parallel segments 31A, 31B extend between the attachment 40 and the connector 42 and are joined at the ends 31C, 31D of the band 31.

The fixed connection 32 and the movable connection 33 are both attached to the resistance band 31 such that movement of the movable connection stretches the resistance band 31 to provide resistance for the weightlifting exercise. The fixed connection 32 in FIG. 1 includes a base 38, a base connector 39 (e.g., a fixable and removable pin) fixedly connecting the base 38 to the frame member 20, and an attachment, or connector, 40 (e.g., a karabiner) connected to the base 38 for removable attachment to the resistance band 31. The movable connection 33 in FIG. 1 includes a base 41 connected to the cable system 35 and a connector 42 (e.g., a karabiner) connected to the base 41 for removable attachment to the resistance band 31. Either or both of the fixed and removable connections 32, 33 may be configured for free rotation, e.g., by having internal bearings.

The grip attachment 34 may be connected to the cable system 35 and also attached to a grip 36 for engagement by the user to perform the weightlifting exercise. The grip 36 in FIG. 1 is a lat pull grip configured for gripping by the user's hands, but other grips may be used in other embodiments. It is understood that the grip attachment 34 may also be connectable to other user engagement devices, such as a belt or harness. The grip attachment 34 may include a removable connector for attachment to different grips 36 or other devices, such as a karabiner. The grip attachment 34 may be configured for free rotation, e.g., by having internal bearings.

Figure 33:
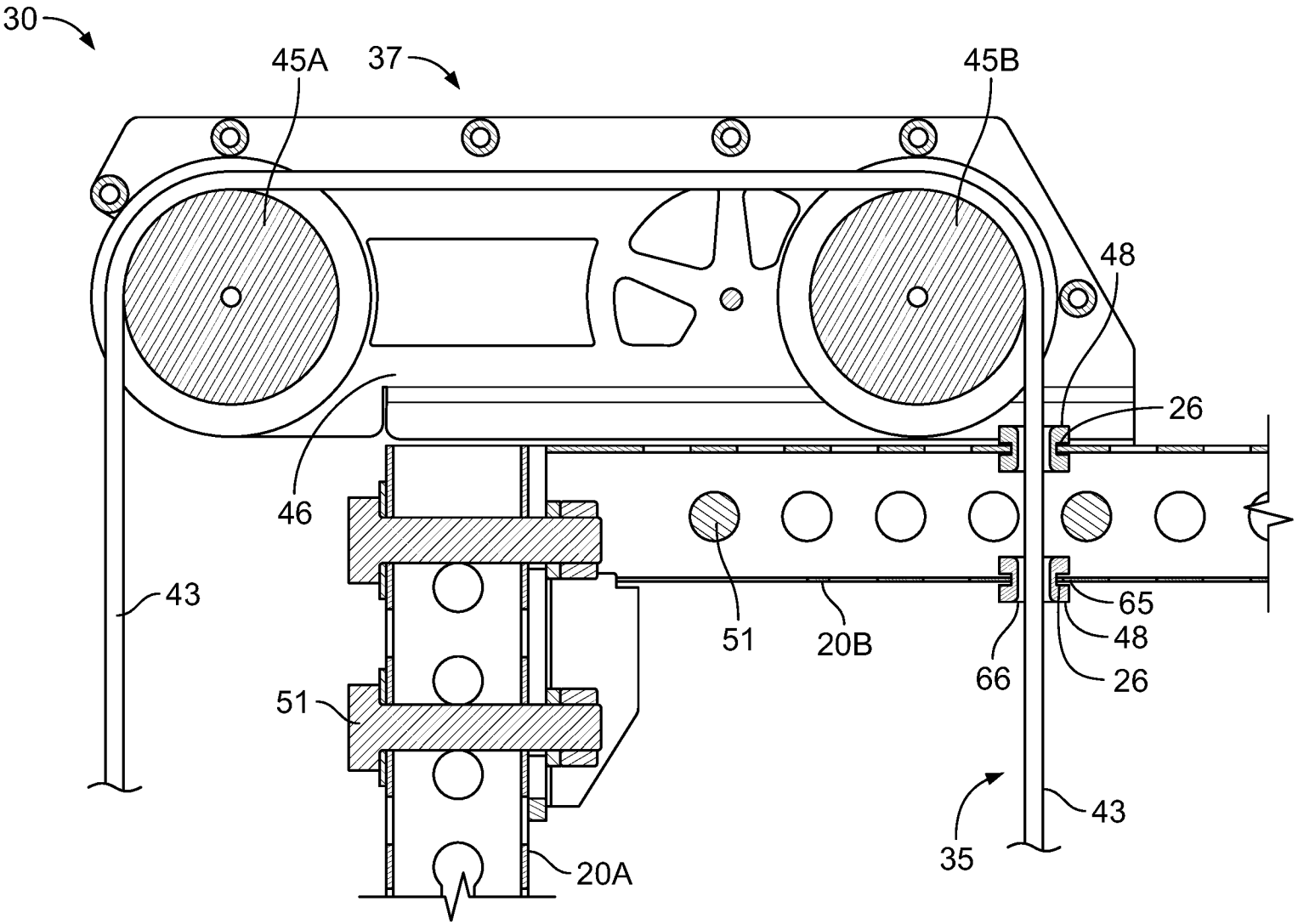
FIG. 33 illustrates a side cross-sectional view of the weightlifting machine of FIG. 24, in accordance with aspects of the disclosure.

The cable system 35 in FIG. 1 includes a single cable 43 connected at one end to the movable connection 33 and at the other end to the grip attachment 34. The cable system 35 may include multiple cables 43 in another embodiment. Additionally, the cable system 35 may include stops 44 to limit movement of the cable(s) 43. The cable system 35 may be configured so that the cable(s) 43 passes through one or more of the frame members 20, such as through one or more fastener holes 26 and/or through the central passage of the frame member(s) 20. The cable 43 in FIG. 1 passes through one of the frame members 20 transversely to the frame member 20 (i.e., passing vertically through a horizontal frame member 20B) by entering one of the fastener holes 26, through the hollow interior of the horizontal frame member 20B, and exiting through another fastener hole 26 on the opposite side of the lateral frame member 20B. In some embodiments, the fastener hole 26 on the top surface of the lateral frame member 20B and the fastener hole 26 on the lower surface of the lateral frame member 20B may be aligned with each other. While the bottom fastener hole 26 is not shown in FIG. 1, the bottom fastener hole 26 is depicted in FIG. 33, which illustrates a similar embodiment. In addition, one skilled in the art would readily recognize its presence and location.

Figure 64:
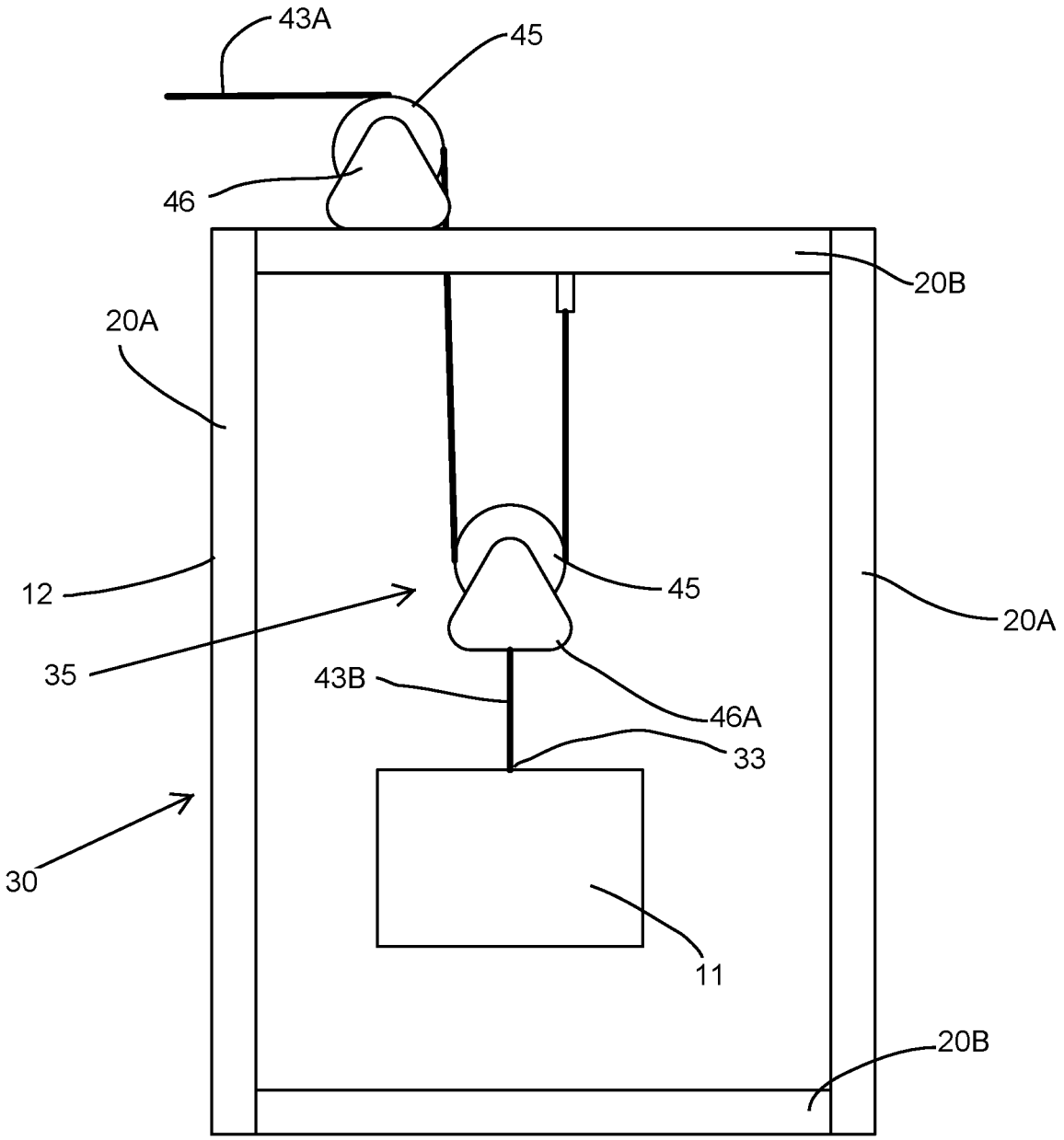
FIG. 64 illustrates a schematic side view of another embodiment of a weightlifting machine in accordance with aspects of the disclosure.
Figure 65:
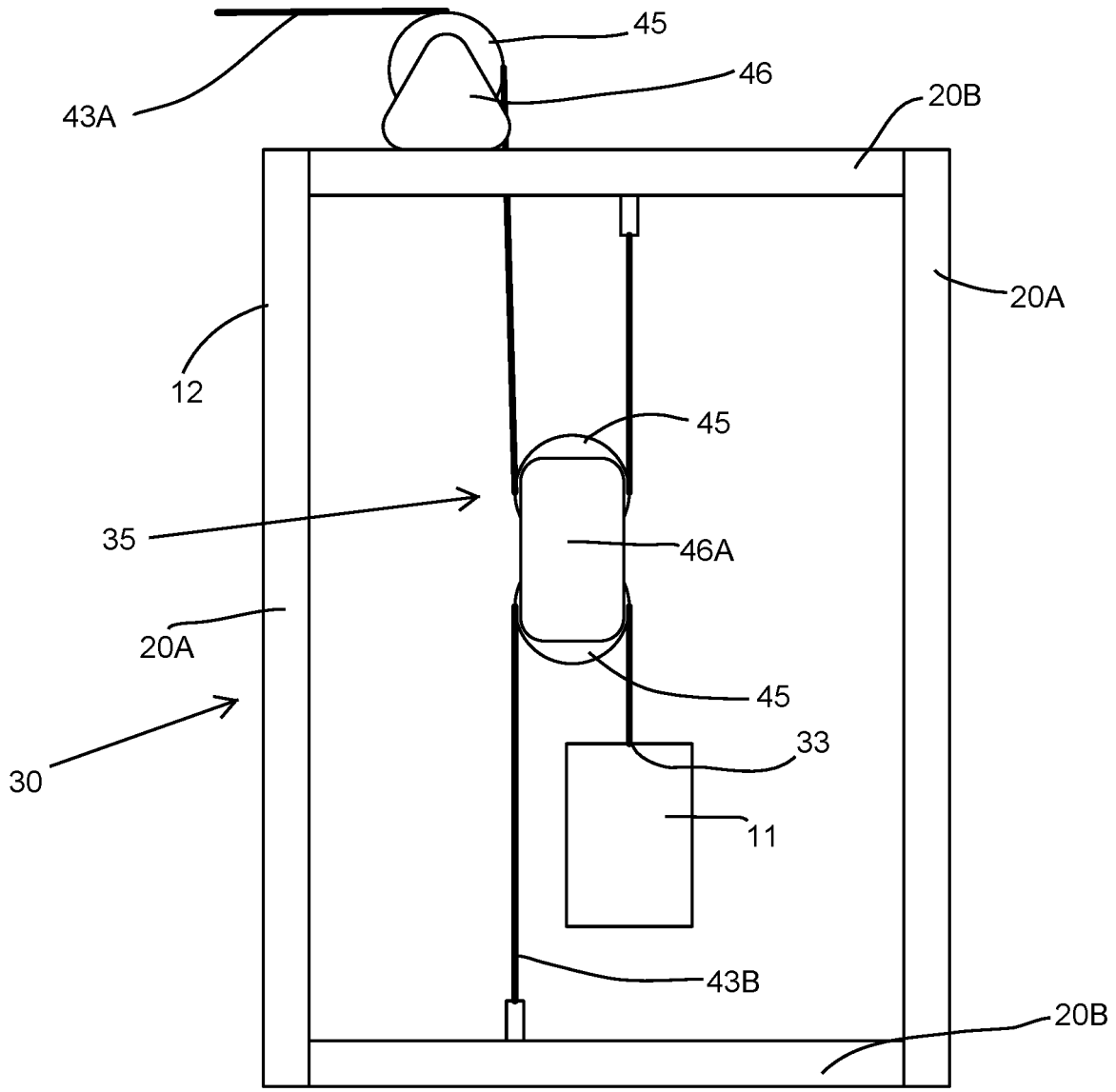
FIG. 65 illustrates a schematic side view of another embodiment of a weightlifting machine in accordance with aspects of the disclosure.

The pulley system 37 may include one or more pulleys 45 configured to guide and, in some cases, redirect the cable(s) 43 of the cable system 35. For example, the pulley system 37 may include a first pulley 45A mounted to the frame 12 at a first location and a second pulley 45B mounted to the frame at a second location spaced from the first pulley. The pulley system 37 in FIG. 1 includes two pulleys 45, such that the cable 43 extends directly from the first pulley 45A to the second pulley 45B where each pulley 45 redirects the cable 43 as needed. The pulley system 37 may engage a resistance element that provides a resistance force opposing the movement of the cable. The resistance element may include a free weight such as a weight plate, a resistance band, a machine or constrained weight, and/or combination of resistance elements or other similar arranged element. For example in the embodiment of FIG. 1, the cable 43 may be engaged at the movable connection 33 to a resistance band 31 such that a user may pull the grip 36 away from the forward pulley 45A or pull vertically (or substantially vertically) downward on the grip 36 moving the cable 43 which creates a vertically upward movement of the movable connection 33 stretching the resistance band 31. In another embodiment, the pulley system 37 may also be configured to create a mechanical advantage in a weightlifting exercise, such as through incorporation of travelling pulleys and additional cables 43, as shown in FIGS. 64-65 and described herein. The pulley system 37 also includes one or more mounts 46 configured for mounting the pulley(s) 45 to the frame 12. In the embodiment of FIG. 1, the pulley system 37 includes a single mount 46 that is removably connected to a horizontal or lateral frame member 20B or a vertical frame member 20A by fasteners (not shown) such as pins (including cotter pins or other locking pins), bolts and other threaded connectors, clamps, and other types of fasteners. The mount 46 may rotatably support both pulleys 45 at opposite ends of the mount 46, and the mount 46 includes a central slot 47 that receives a portion of both pulleys 45.

The weightlifting machine 30 may also include one or more protectors 48 to protect the cable 43 against abrasion when passing through a frame member 20 as shown in FIG. 33. The weightlifting machine 30 in FIG. 1 includes a protector 48 in the form of a grommet or bushing received in one of the fastener holes 26 of the frame member 20 where the cable may extend through an aperture 66 in the protector 48 to protect the cable 43 against abrasion during movement through the fastener hole. The protector 48 may be made from a polymer material in one embodiment, such as rubber or other durable polymer, but may be made from other materials in other embodiments. The material of the protector 48 may include properties such as low friction and/or resiliency, and may have edges that are rounded, beveled, or otherwise configured to reduce abrasion. The weightlifting machine 30 in FIG. 1 may include a second protector 48 received in the opposite fastener hole 26 on the underside of the frame member 20. In another embodiment, the protector 48 may be in the form of a sleeve or other tubular structure that extends through the frame member 20 and is received in both of the fastener holes 26. In some embodiments, the protector 48 may have a groove 65 or other retention feature on an exterior surface that engages the wall of the frame member 20 to secure the protector 48 to the frame member 20, such as shown in FIG. 33. It is understood that any embodiment herein of a weightlifting machine in which a cable 43 passes through a frame member 20 may include one or more protectors 48 as described herein, although protectors 48 are not illustrated in connection with all embodiments.

The weightlifting machine 30 in the embodiment of FIG. 1 is configured for use as a lat pull mechanism, but it is understood that the weightlifting machine 30 can be modified for use with other weightlifting exercises, such as through attachment of a different grip, re-arrangement of components, and/or addition of additional pulleys 45 to the pulley assembly 37.

Figure 14:
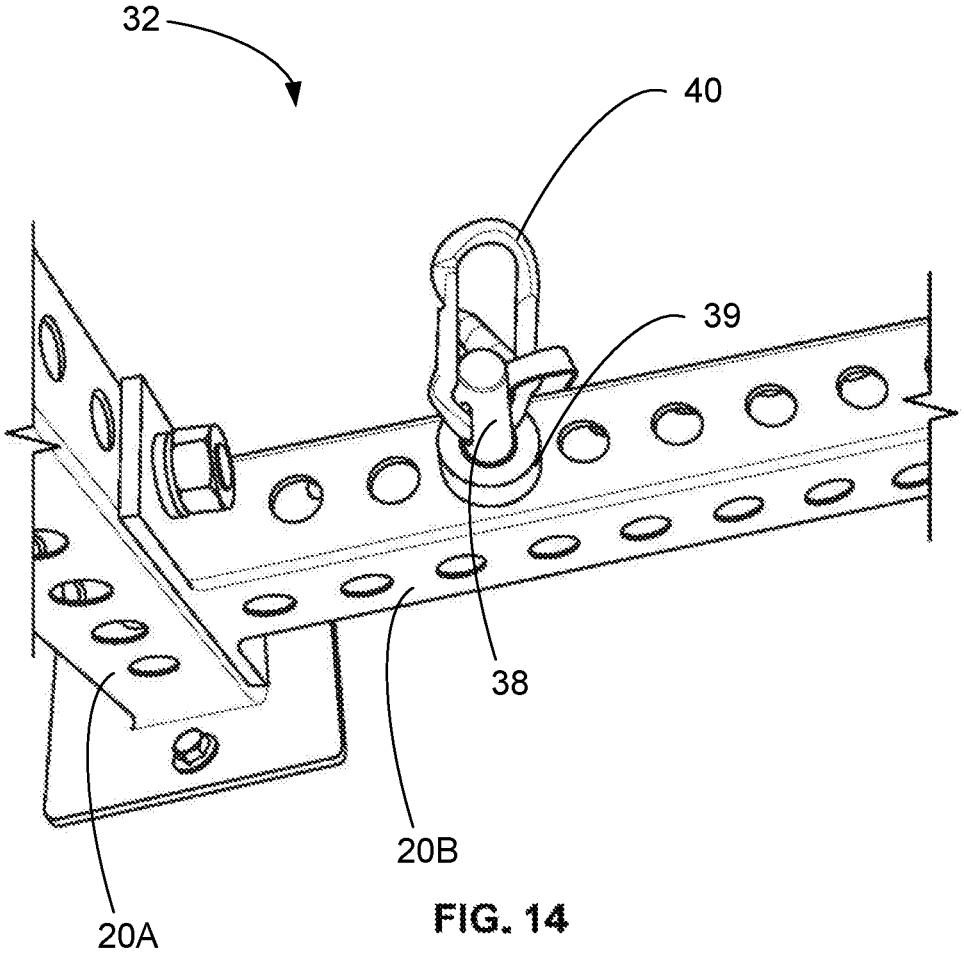
FIG. 14 illustrates a perspective view of a fixed connector of the weightlifting machine, in accordance with aspects of the disclosure.
Figure 15:
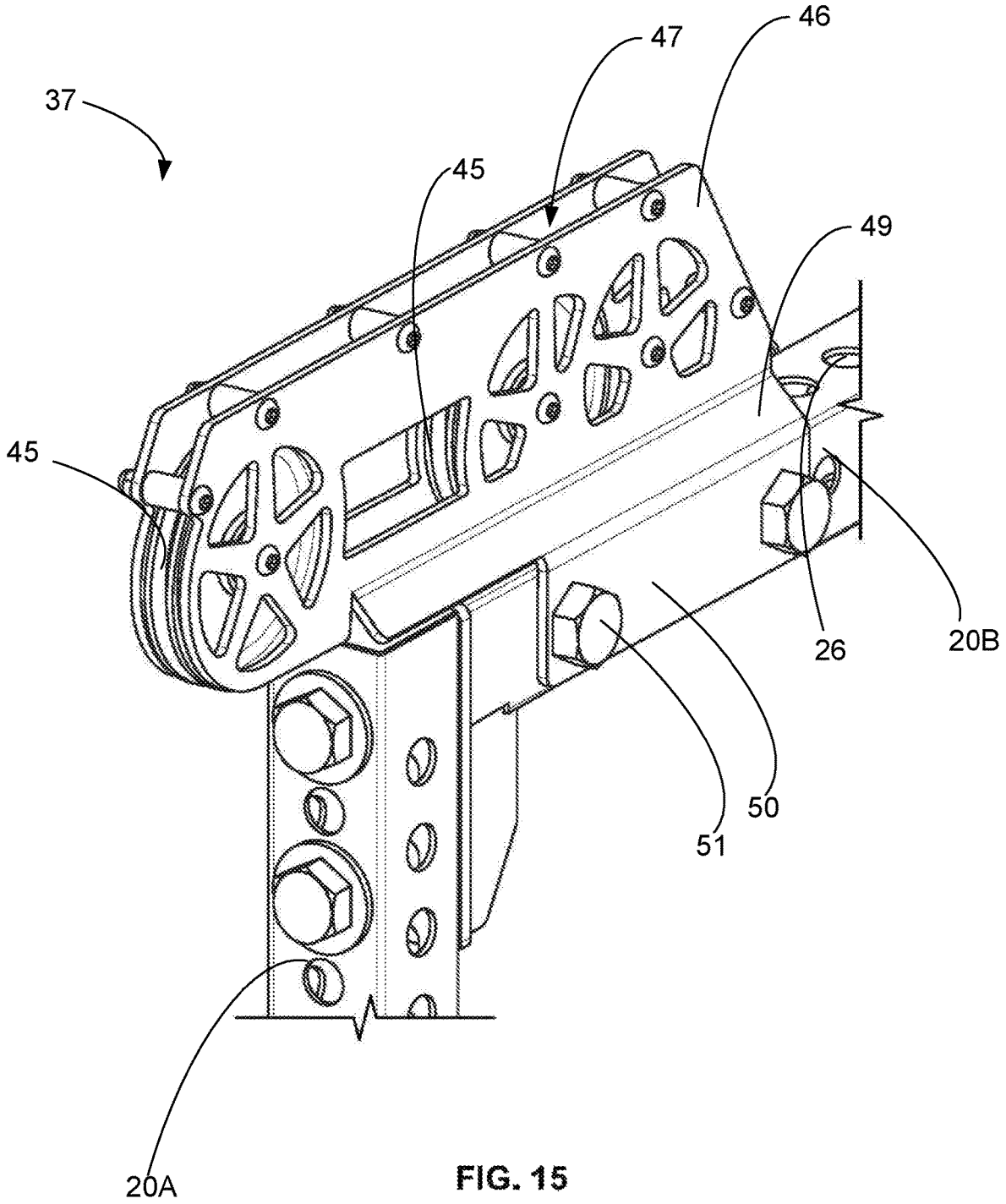
FIG. 15 illustrates a front perspective view of another the pulley assembly of a weightlifting machine attached to a weight rack assembly, in accordance with aspects of the disclosure.
Figure 16:
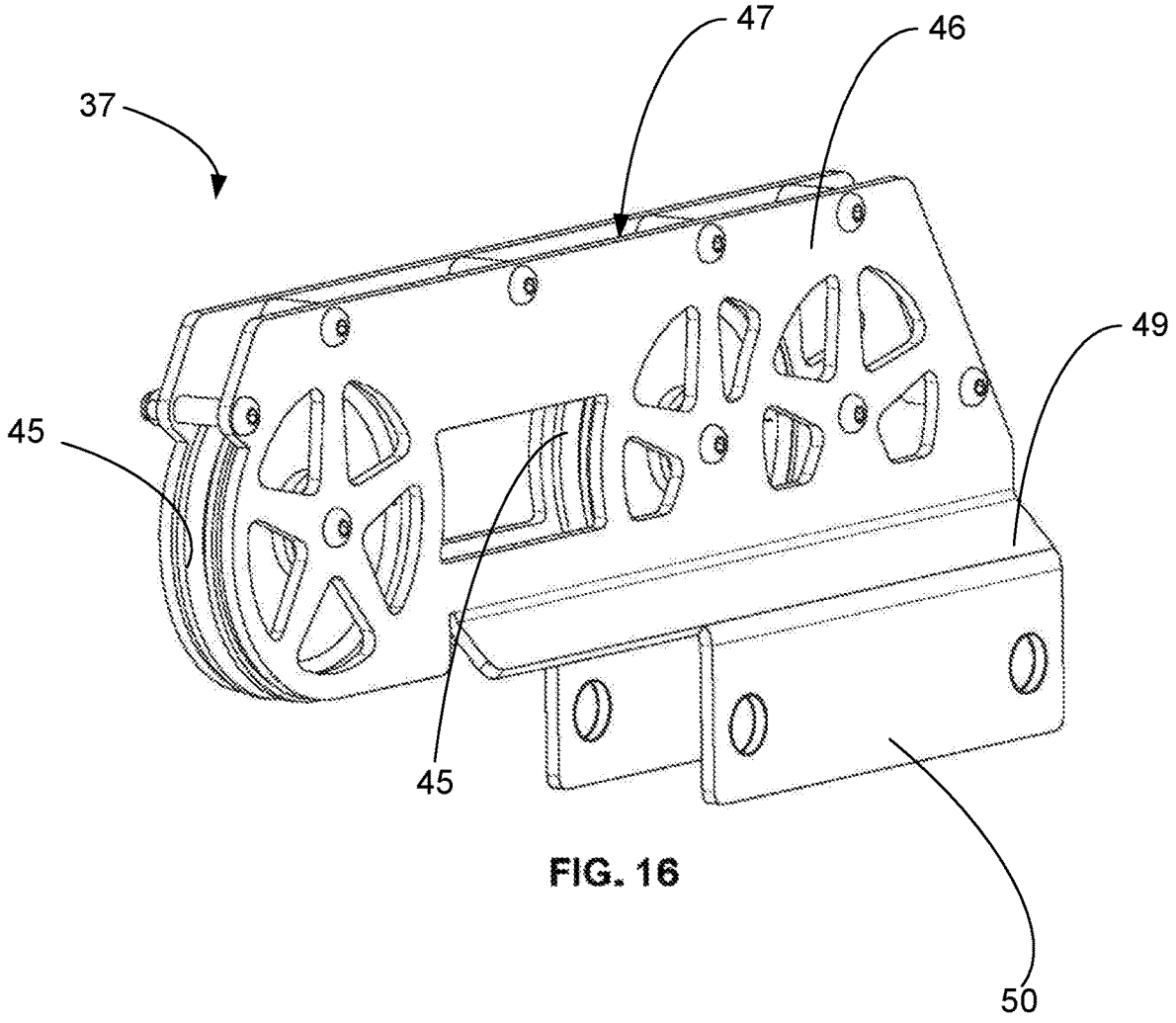
FIG. 16 illustrates a front perspective view the pulley assembly of FIG. 15, in accordance with aspects of the disclosure.
Figure 17:
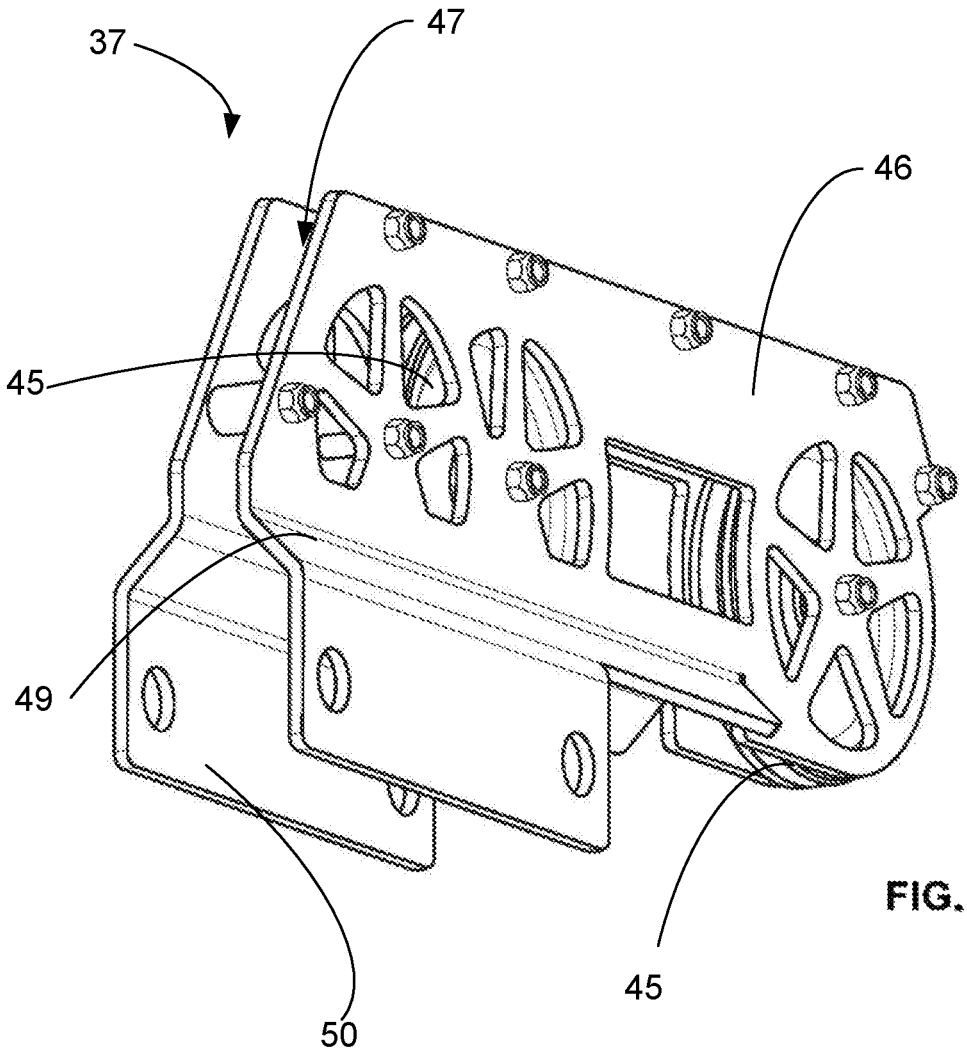
FIG. 17 illustrates a rear perspective view of the pulley assembly of the weightlifting machine of FIG. 16, in accordance with aspects of the disclosure.
Figure 18:
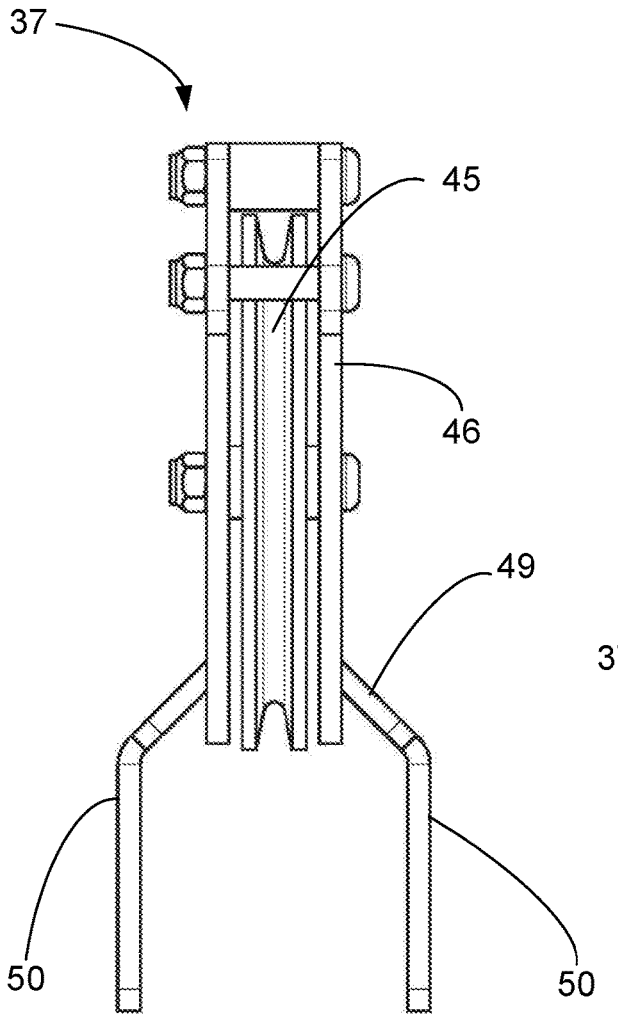
FIG. 18 illustrates a front view of the pulley assembly of the weightlifting machine of FIG. 16, in accordance with aspects of the disclosure.
Figure 19:
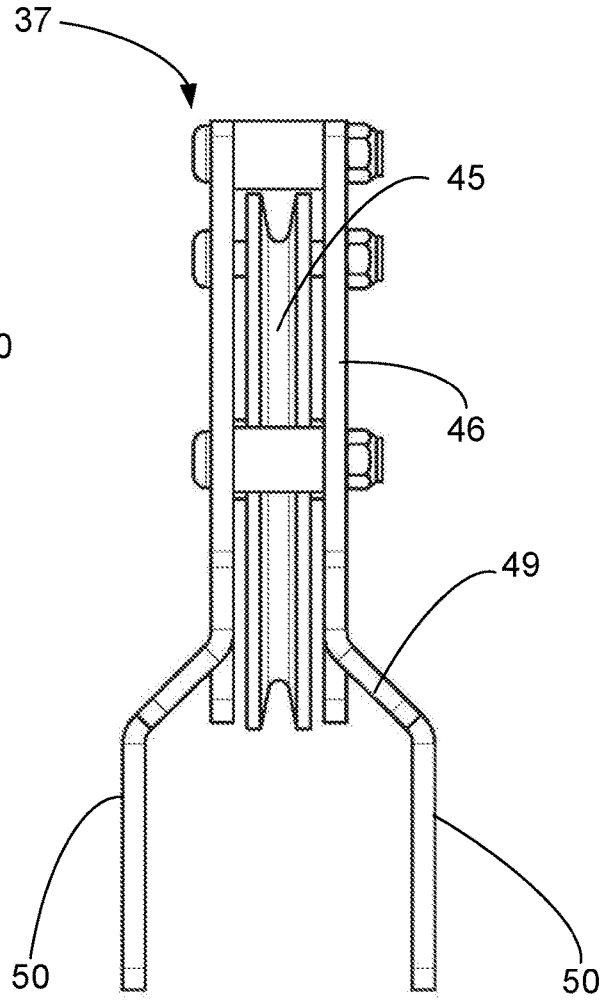
FIG. 19 illustrates a rear view of the pulley assembly of the weightlifting machine of FIG. 16, in accordance with aspects of the disclosure.
Figure 20:
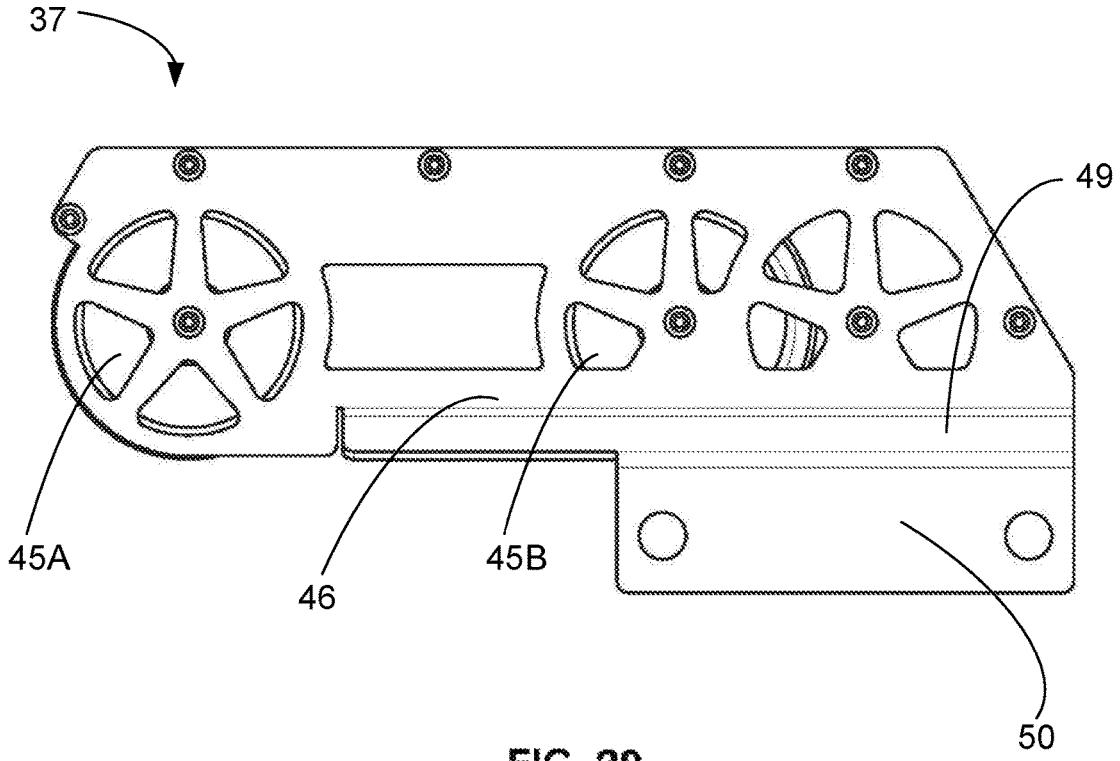
FIG. 20 illustrates a right side view of the pulley assembly of the weightlifting machine of FIG. 16, in accordance with aspects of the disclosure.
Figure 21:
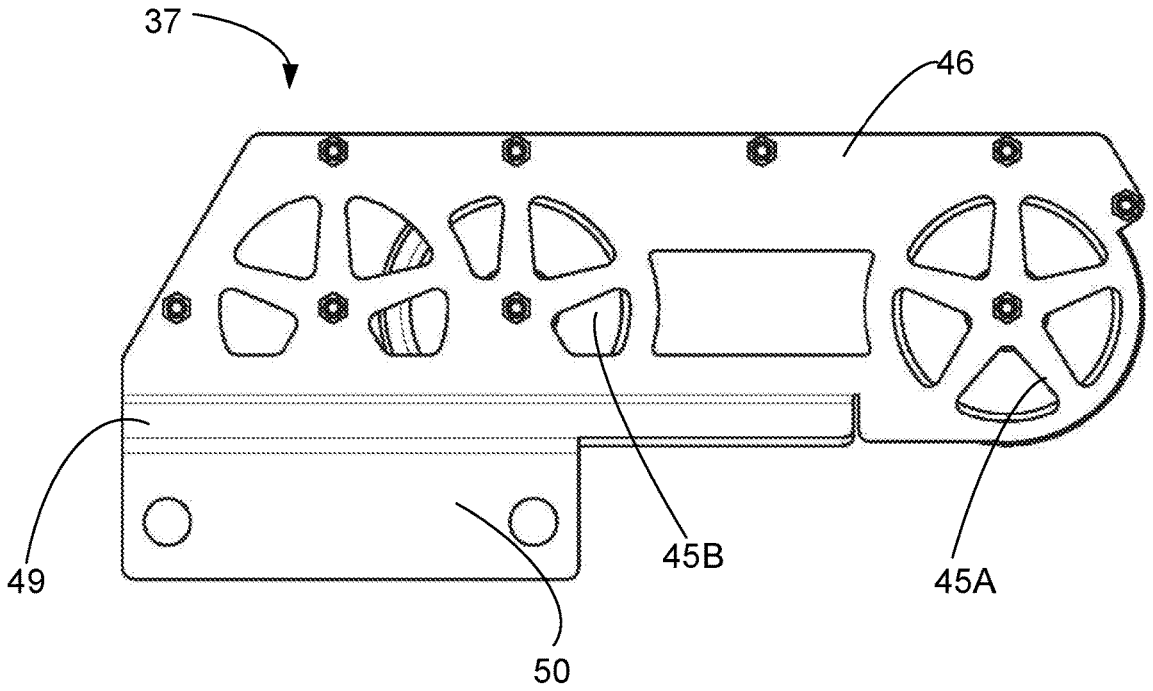
FIG. 21 illustrates a left side view of the pulley assembly of the weightlifting machine of FIG. 16, in accordance with aspects of the disclosure.
Figure 22:
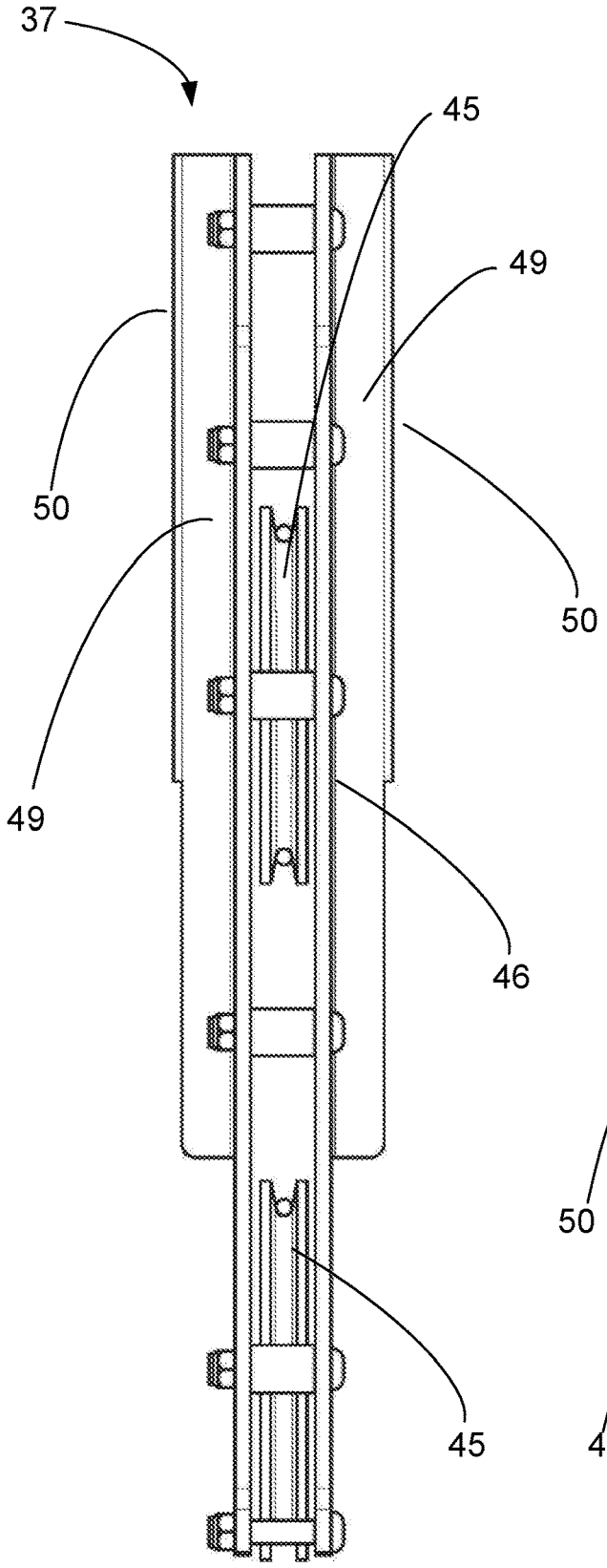
FIG. 22 illustrates a top view of the pulley assembly of the weightlifting machine of FIG. 17, in accordance with aspects of the disclosure.
Figure 23:
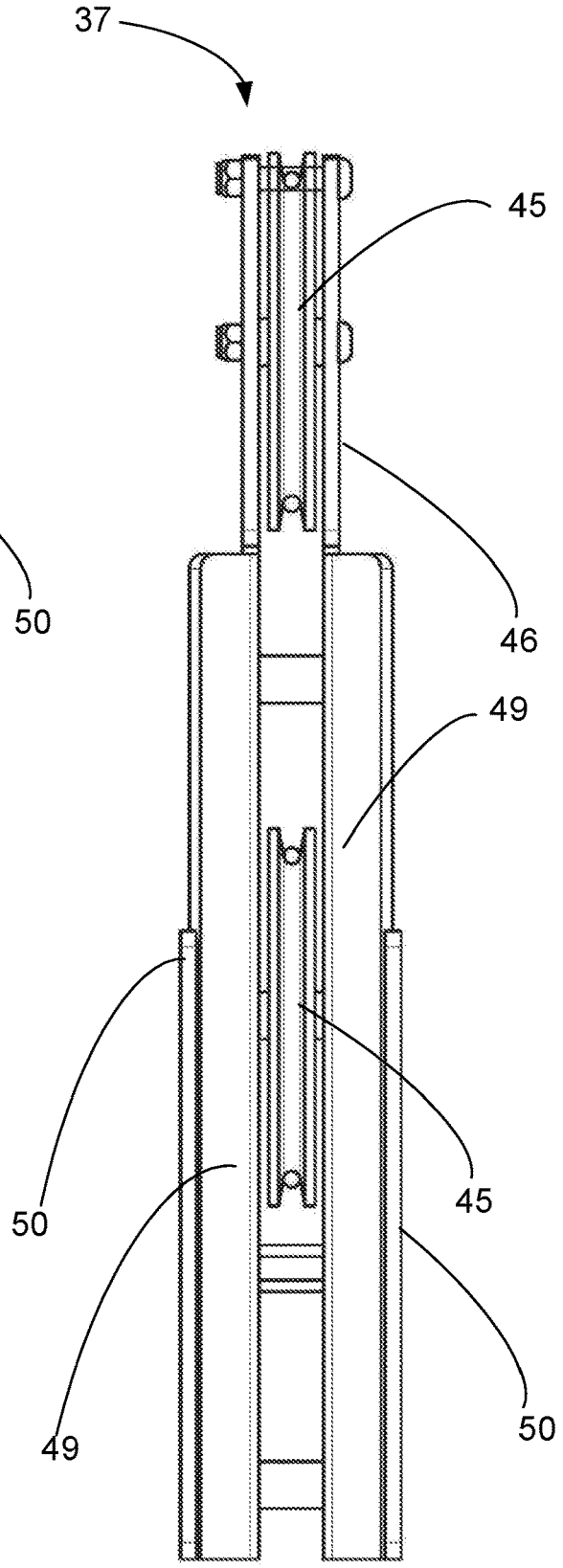
FIG. 23 illustrates a bottom view of the weightlifting machine of FIG. 17, in accordance with aspects of the disclosure.
Figure 24:
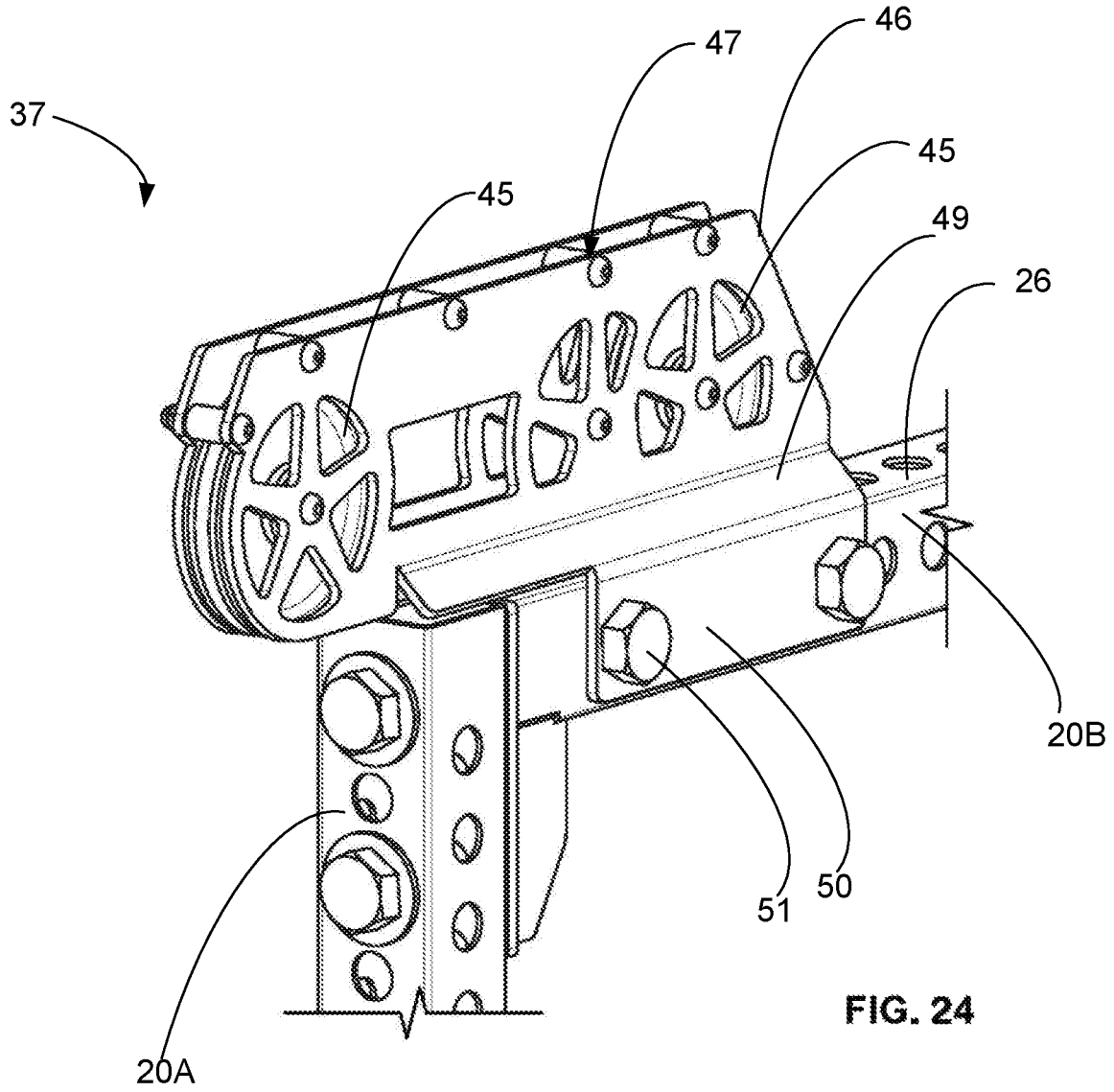
FIG. 24 illustrates a front perspective view of another pulley assembly of a weightlifting machine attached to a weight rack assembly, in accordance with aspects of the disclosure.
Figure 25:
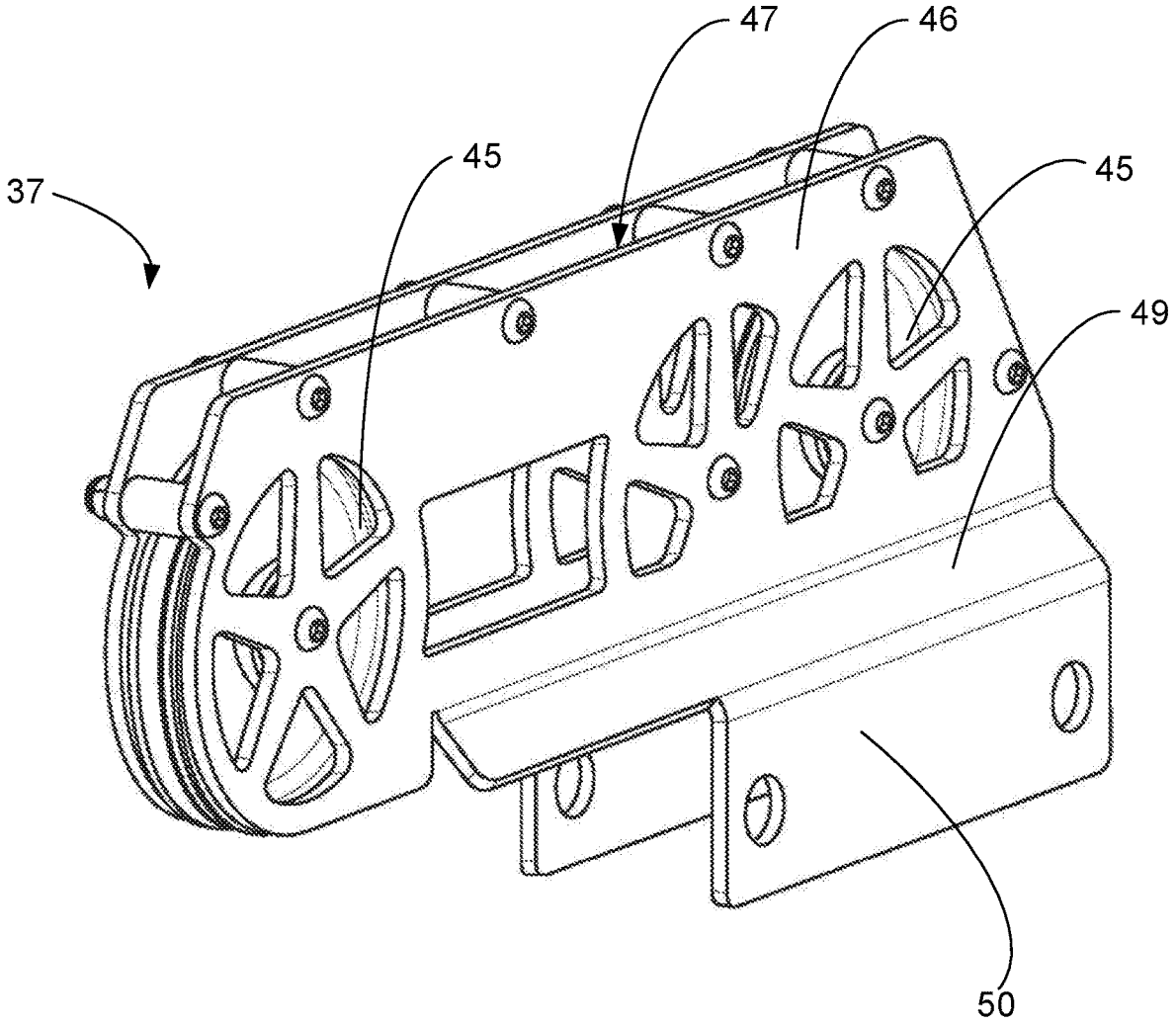
FIG. 25 illustrates a front perspective view of the pulley assembly of FIG. 24, in accordance with aspects of the disclosure.
Figure 26:
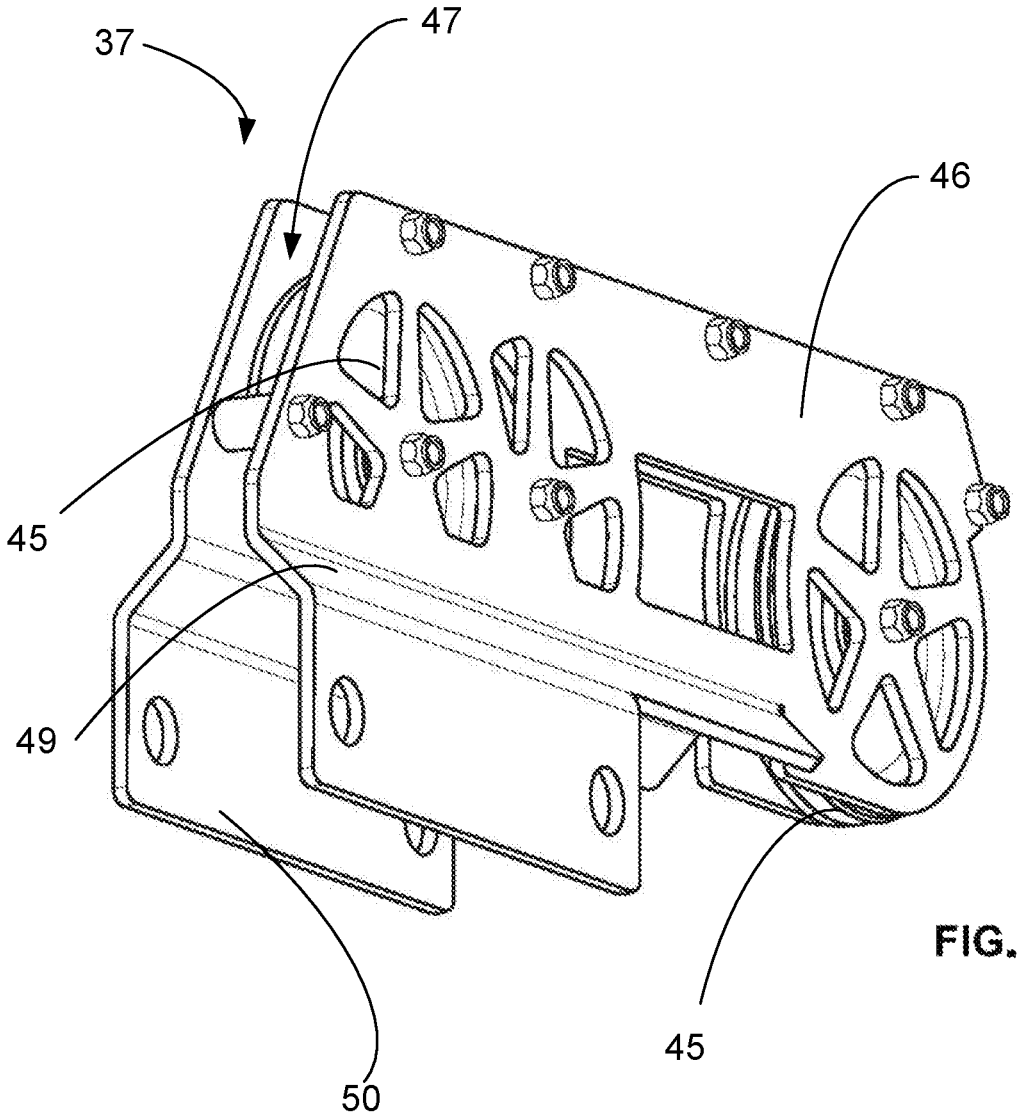
FIG. 26 illustrates a rear perspective view of the pulley assembly of FIG. 24, in accordance with aspects of the disclosure.
Figure 27:
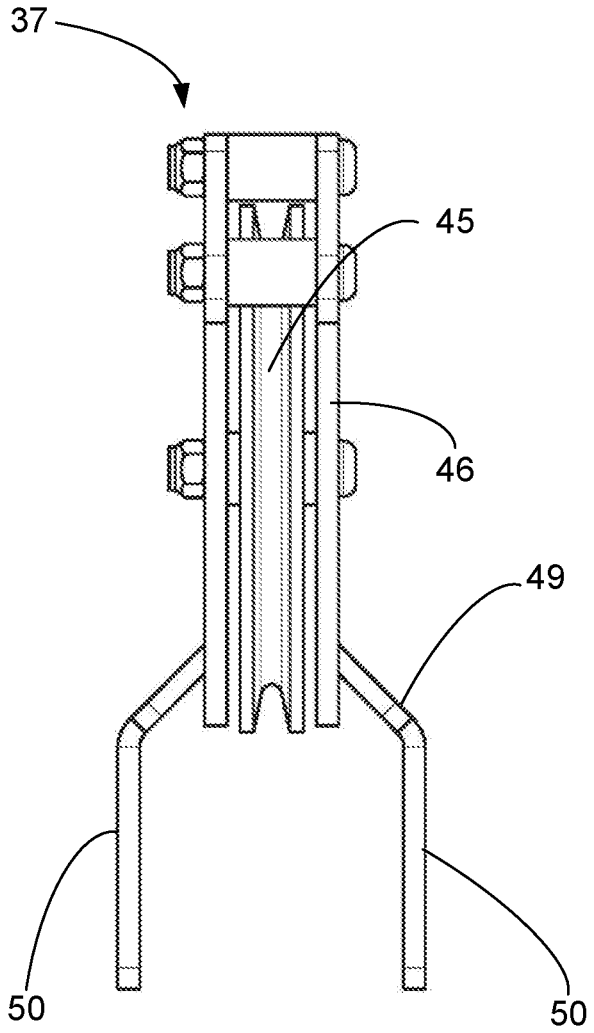
FIG. 27 illustrates a front view of the pulley assembly of the weightlifting machine of FIG. 24, in accordance with aspects of the disclosure.
Figure 28:
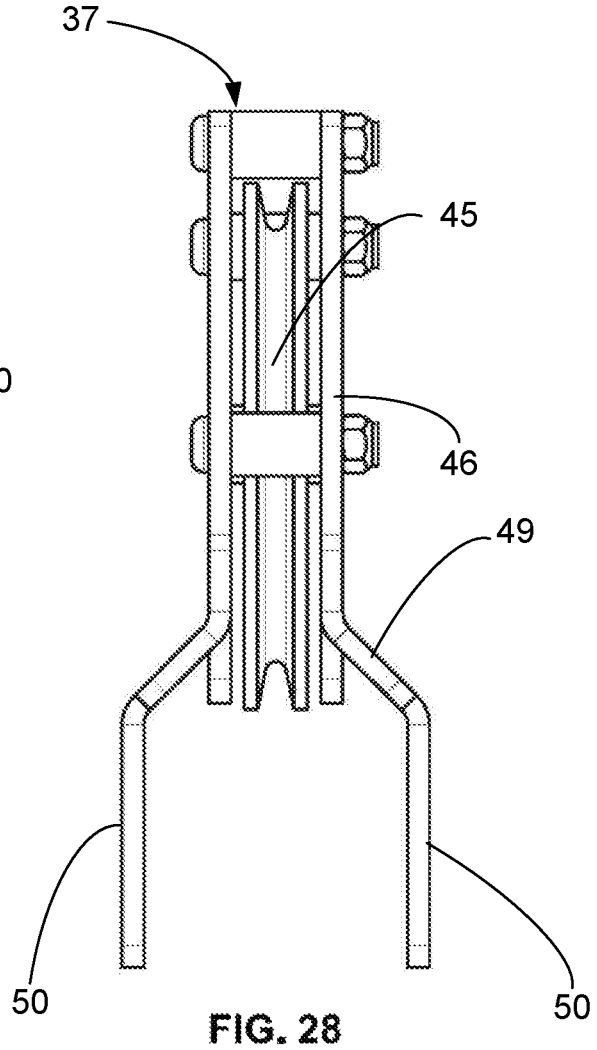
FIG. 28 illustrates a rear view of the pulley assembly of the weightlifting machine of FIG. 24, in accordance with aspects of the disclosure.
Figure 29:
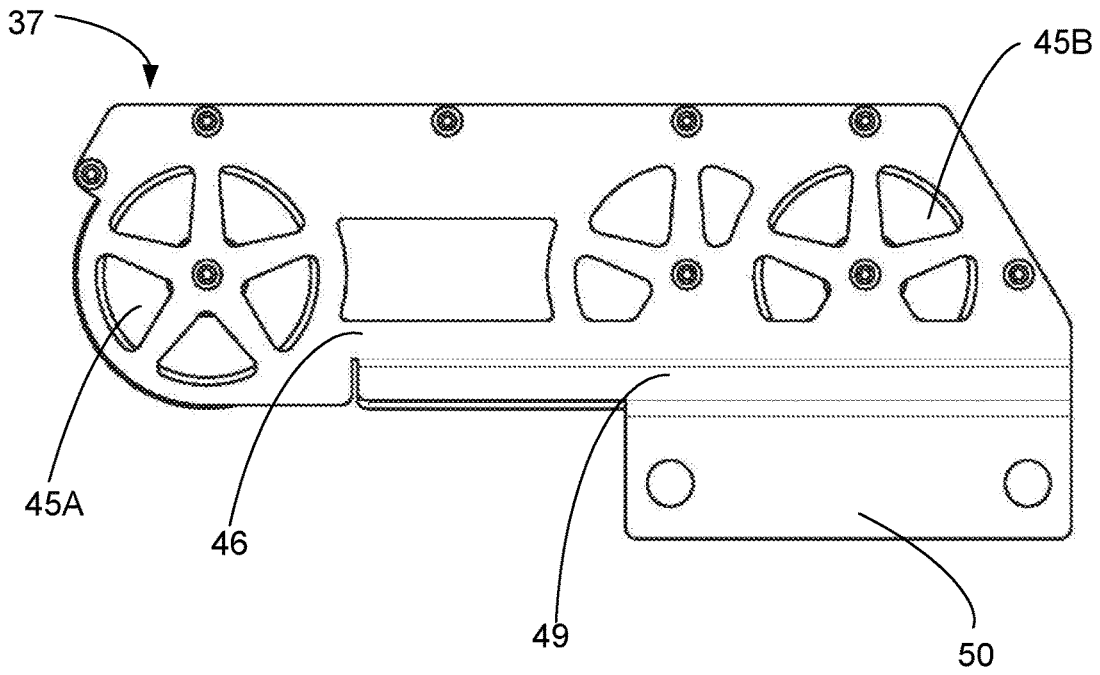
FIG. 29 illustrates s a right side view of the pulley assembly of the weightlifting machine of FIG. 24, in accordance with aspects of the disclosure.
Figure 30:
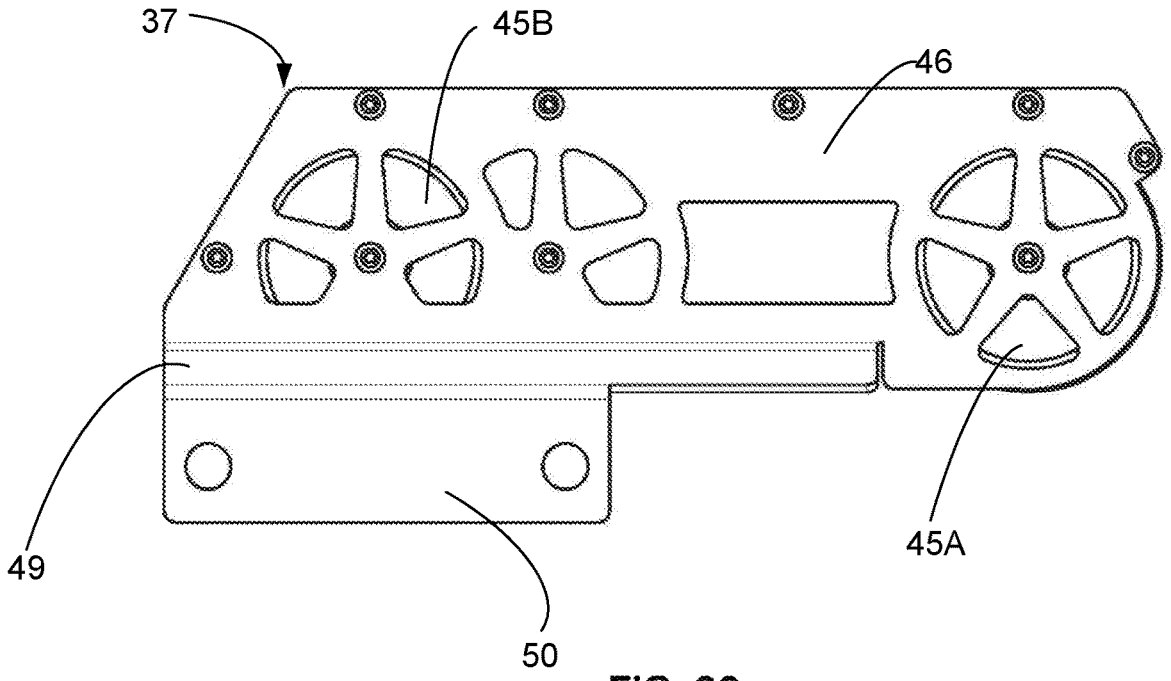
FIG. 30 illustrates a left side view of the pulley assembly of the weightlifting machine of FIG. 24, in accordance with aspects of the disclosure.
Figure 31:
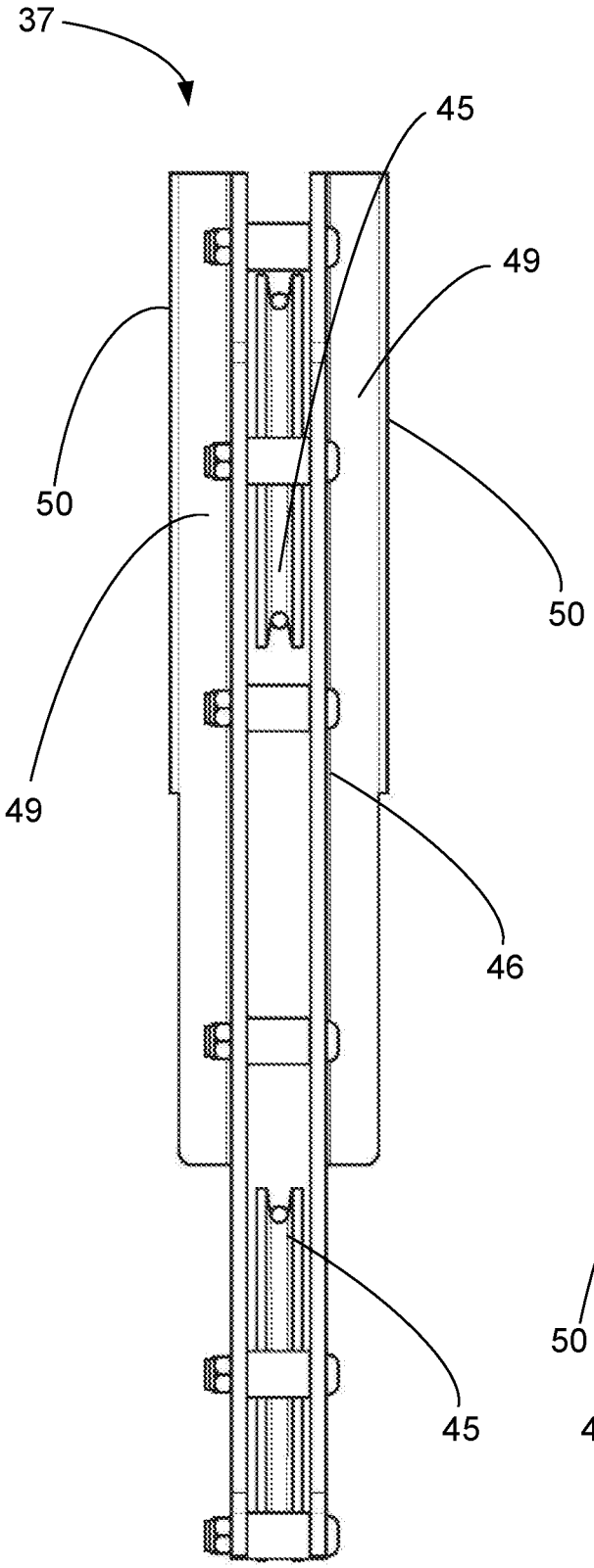
FIG. 31 illustrates a top view of the pulley assembly of the weightlifting machine of FIG. 24, in accordance with aspects of the disclosure.
Figure 32:
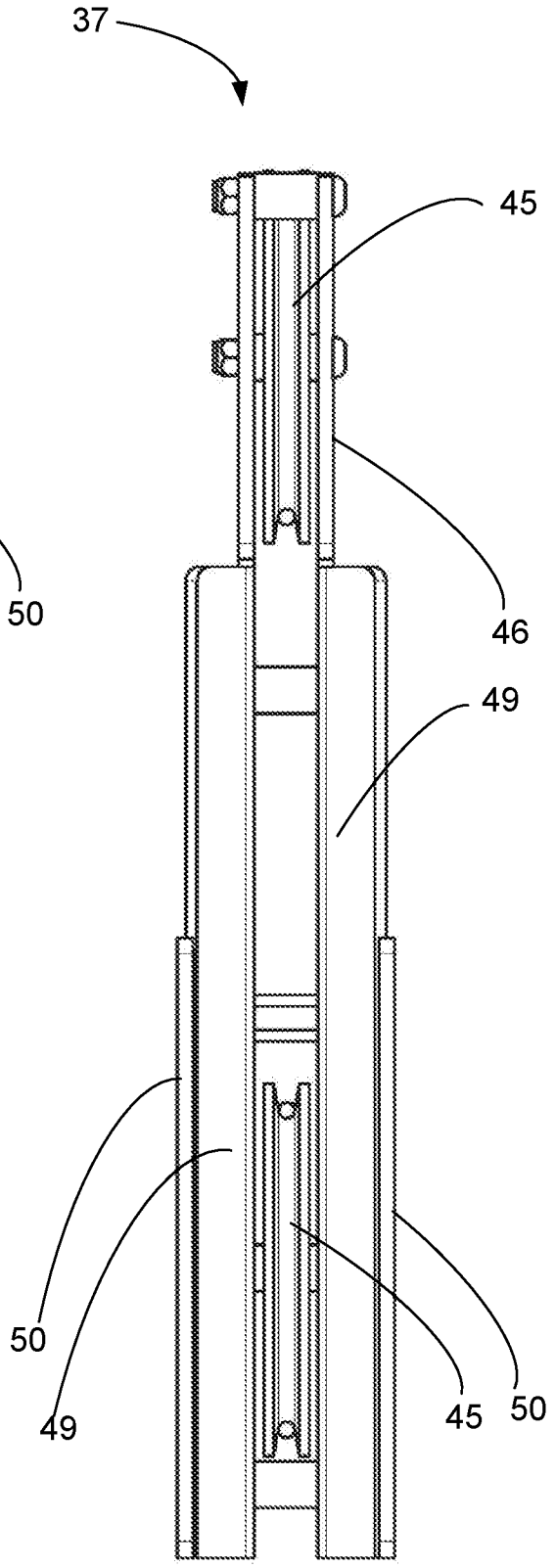
FIG. 32 illustrates a bottom view of the weightlifting machine of FIG. 24, in accordance with aspects of the disclosure.

FIGS. 2-13 illustrate another embodiment of a weightlifting machine 30 that includes many features of the weightlifting machine 30 of FIG. 1. The pulley mount 46 in this embodiment includes a mounting structure 49 that includes two side mounting plates 50 extending on opposite sides of each pulley 45 where the each side mounting plate connects to opposite sides of the lateral frame member 20B to receive the lateral frame member 20B between them. The mounting structure 49 is connected to the frame member 20 by receiving fasteners 51 connected to both mounting plates 50 and extending through the frame member 20. The mounting plates 50 both extend outward at an angle to the mount 46, and then vertically downward for connection to and engagement with the lateral frame member 20B. A third or forward, mounting plate 52 is connected to an adjacent vertical frame member 20A by fasteners 51 in this configuration, to support the front of the mount 46. The third mounting plate 52 is perpendicular to the mounting plates 50 in this configuration. The protector 48 may be positioned below the mount 46 and between the mounting plates 50 in this configuration. In addition, the forward pulley 45A may be located forward of the forward mounting plate 52 such that the forward pulley 45A is entirely outside of a perimeter of the frame 12 to easily allow a user to grasp the grip 36. FIGS. 7-13 illustrate additional views and depictions of the weightlifting machine 30 of FIG. 2 and the pulley system 37 and the mount 46 thereof. FIG. 14 illustrates a view of the fixed connection 32 located along a second lateral frame member 20B.

FIGS. 15-33 illustrate another embodiment of the weightlifting machine 30 where the pulley assembly 37 includes a forward pulley 45A and a rear pulley 45B, where the rear pulley 45B may be positioned in a plurality of locations. For example, FIGS. 15-23 illustrate a pulley assembly 37 where the rear pulley in a first position that is closer to the forward pulley 45A, whereas FIGS. 24-33 illustrate the weightlifting machine 30 with the rear pulley 45B in a second position that is spaced a greater distance from the forward pulley 45A. This adjustable rear pulley location helps the weightlifting machine 30 to accommodate frames 12 with different holes spacing and allows the weightlifting machine 30 to mount onto multiple weight racks 10.

The weightlifting machine 30 may be utilized to retrofit an existing frame 12 into a functioning weightlifting machine. As discussed above, the pulley assembly 37 may be connected to a first lateral frame member 20B of the frame 12. The pulley assembly 37 may include a pair of pulleys 45A, 45B. A first protector 48 may be secured into one of the holes on the upper surface of the first lateral frame member 20B, and a second protector 48 may be also be secured in one of the holes on the lower surface of the first lateral frame member 20B that is aligned with the hole 26 on the upper surface that has the protector 48. Next, a cable system 35 may be installed onto the pulley where the cable 43 may engage each pulley 45A, 45B in both a vertical orientation and a horizontal orientation to redirect the cable 43, where the cable 43 may extend through one of the holes 26 located in an upper surface of the first lateral frame member 20B and also extend through an aperture(s) 66 in one (or both) of the protectors 48. A first end of the cable may be connected to a movable connection 33, while a second end of the cable 43 may be attached to a grip attachment 34. Next, the first end 31C of the resistance band 31 may be connected to a second lateral frame member 20B that is spaced apart from the first lateral frame member 20B using a fixed connection 32, and the opposite end 31D of the resistance band 31 may be connected to the movable connection 33.

Figure 34:
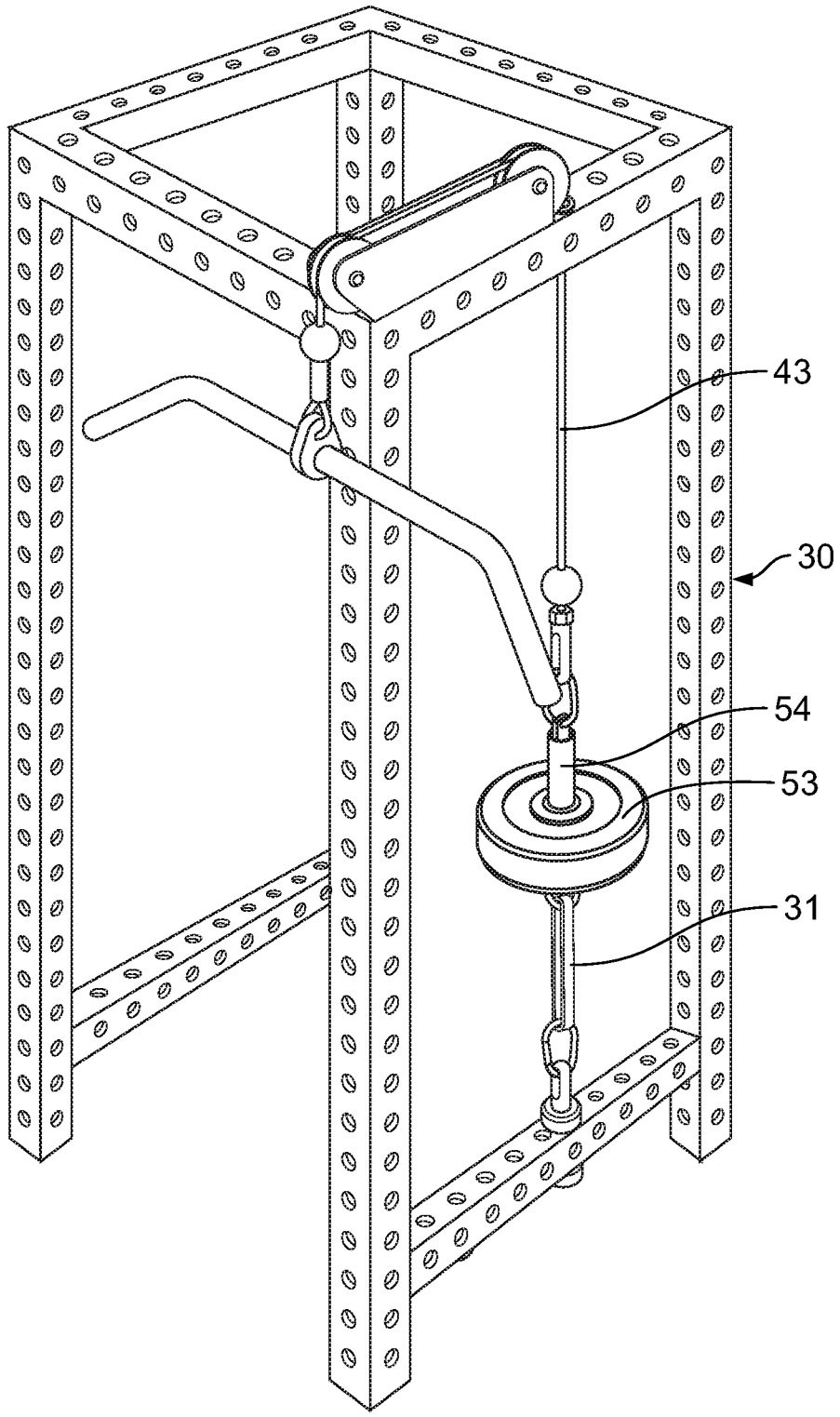
FIG. 34 illustrates a perspective view of another embodiment of a weightlifting machine connected to a weight rack assembly, in accordance with aspects of the disclosure.
Figure 35:
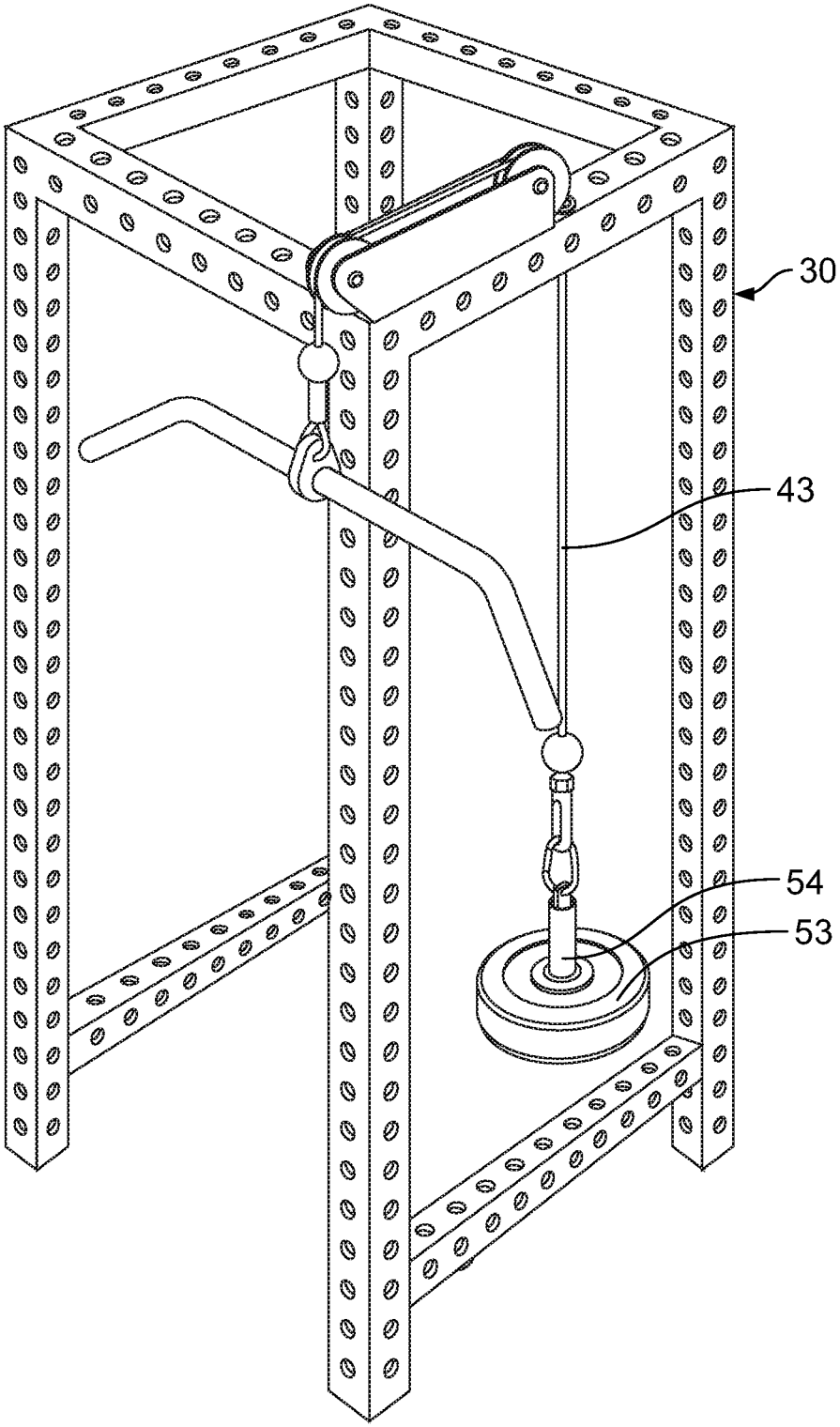
FIG. 35 illustrates a perspective view of another embodiment of a weightlifting machine connected to a weight rack assembly, in accordance with aspects of the disclosure.
Figure 36:
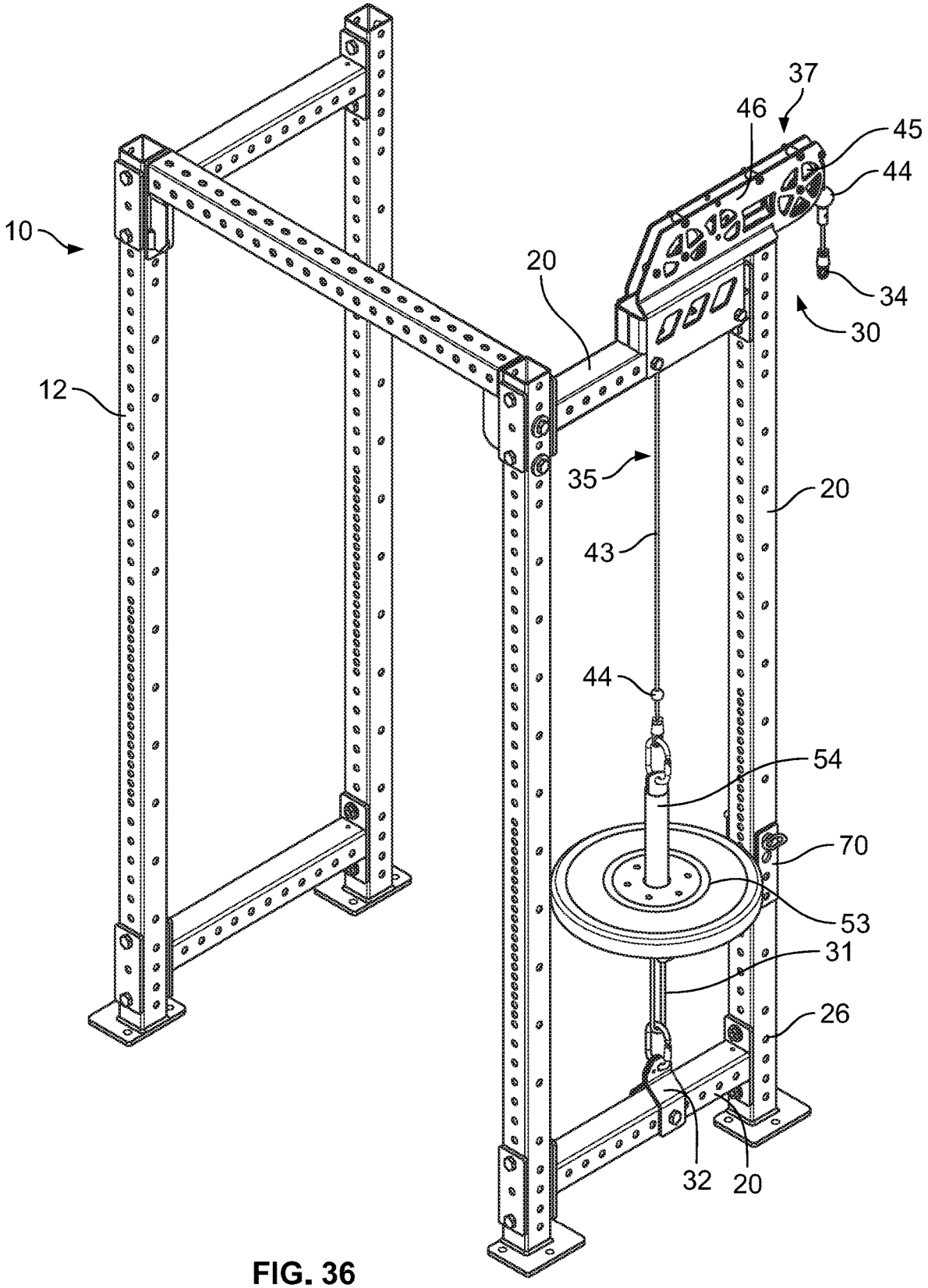
FIG. 36 illustrates a rear top perspective view of another embodiment of a weightlifting machine that connects to a weight rack assembly, in accordance with aspects of the disclosure.
Figure 37:
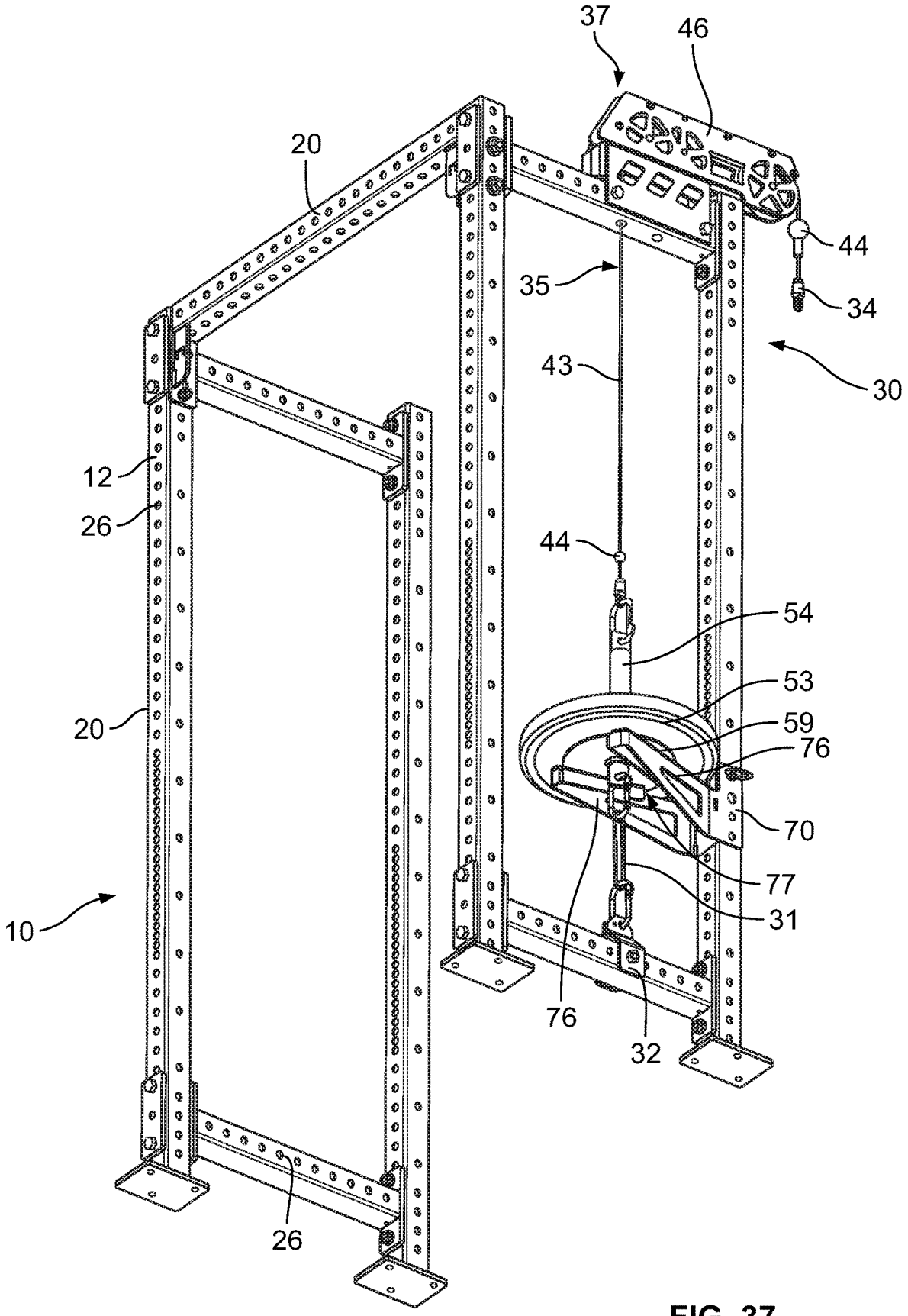
FIG. 37 illustrates a rear bottom perspective view the weightlifting machine of FIG. 36, in accordance with aspects of the disclosure.

FIGS. 34-35 illustrate further embodiments of a weightlifting machine 30 that include many of the features of the weightlifting machines 30 of FIGS. 1-33. Such common features may not be described herein in great detail for the sake of brevity, and it is understood that similar reference numbers may be used to refer to components of FIGS. 34-35 that are similar to components of the embodiments shown in FIGS. 1-33. In FIGS. 34-35, the movable connection 33 attached to the cable system 35 may be connected to a weight support 54 supporting a free weight in the form of a weight plate 53 for added resistance. For example, in FIG. 34, the cable system 35 is connected to a weight support 54 that is configured to support one or more weight plates 53 such that the one or more weight plates 53 rest on the support plate 59 of the weight support 54. In addition, the weight support 54 may also connect to a resistance band 31 such that the weight plate 53, the weight support 54, and the resistance band 31 provides the resistance for the weightlifting exercise. Thus, when a user moves the grip 36 away the pulley 45 or moves the grip 36 vertically (or substantially vertically) or downward the movable connection 33 and the weight support 54 move upward away from the fixed connection 33. Similarly, as the movable connection 33 moves away from the fixed connection 32, the resistance band 31 may be held in tension and stretched as the grip 36 moves away from the pulley 45. In some embodiments, the resistance band 31 may be in tension when the stop 44 is engaged with the pulley 45 to help stabilize the weight support 54. In another embodiment shown in FIG. 35, the movable connection 33 attached to cable system 35 is connected to a weight support 54 for supporting a weight 53 without the use of the resistance band 31 such that the weight 53 and the weight support 54 provide the resistance for the weightlifting exercise.

Figure 62:
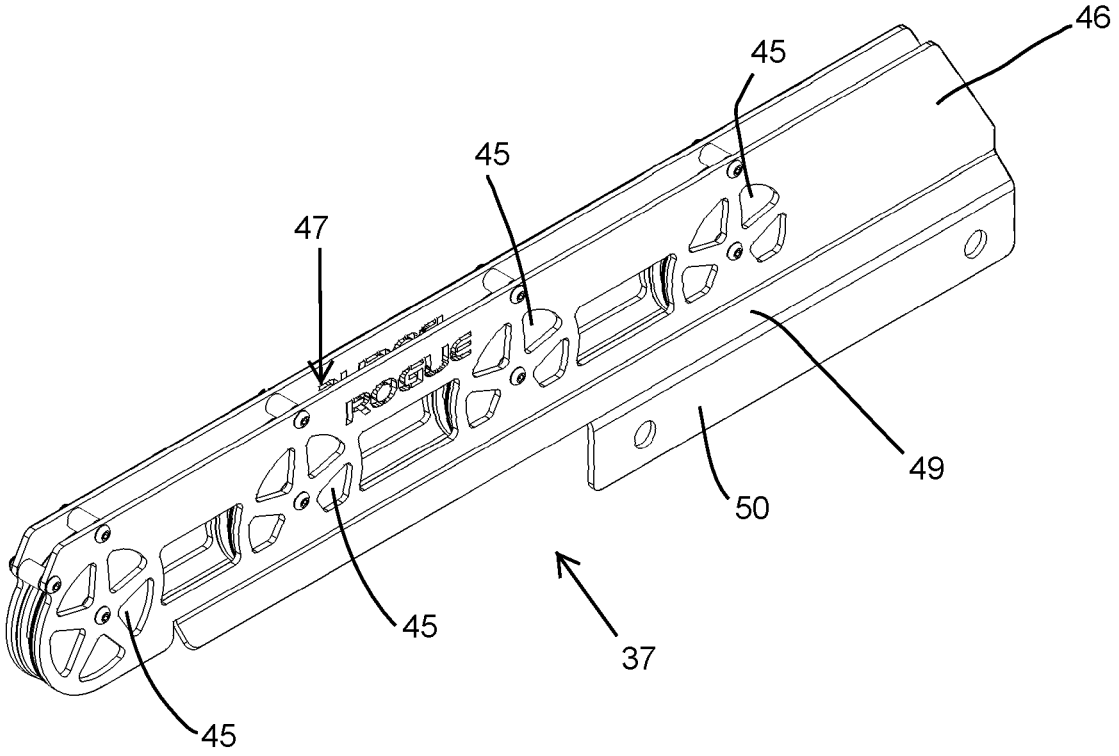
FIG. 62 illustrates a front perspective view of another the pulley assembly of a weightlifting machine in accordance with aspects of the disclosure.
Figure 63:
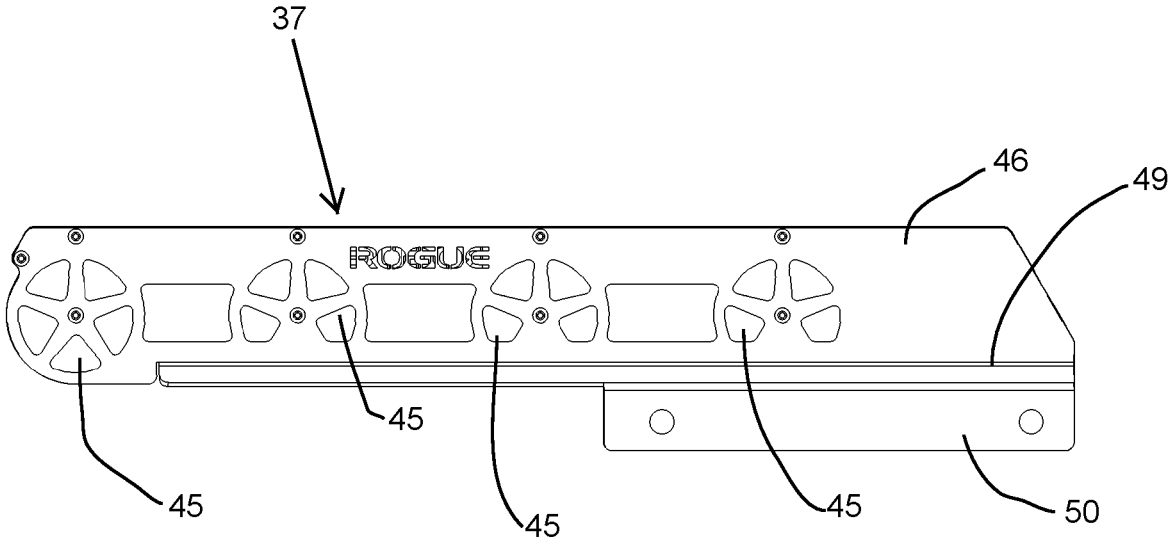
FIG. 63 illustrates a side view of the pulley assembly of FIG. 62.

FIGS. 62-63 illustrate another embodiment of a pulley assembly 37 for a weightlifting machine 30 that includes many of the features of the pulley assembly 37 of FIGS. 15-33. Such common features may not be described herein in great detail for the sake of brevity, and it is understood that similar reference numbers may be used to refer to components of FIGS. 62-63 that are similar to components of the embodiments shown in FIGS. 15-33. In the embodiment of FIGS. 62-63, the mount 46 has connections for four different pulleys 45, and the pulley assembly 37 in FIGS. 62-63 has four pulleys 45 connected to the mount 46. This configuration may be used in more complicated or circuitous cable routing configurations. Additionally, fewer than four pulleys 45 may be connected to the mount 46 in one embodiment, permitting greater customizability of the pulley assembly 37.

FIGS. 36-45 illustrate another embodiment of a weightlifting machine 30 that includes many of the features of the weightlifting machines 30 of FIGS. 1-35. Such common features may not be described herein in great detail for the sake of brevity, and it is understood that similar reference numbers may be used to refer to components of FIGS. 36-45 that are similar to components of the embodiments shown in FIGS. 1-35.

The weightlifting machine 30 in FIGS. 36-45 may be configured for use of free weight plates 53 alone or in combination with a resistance band 31, similar to the embodiment of FIGS. 34 and 35. In this embodiment, the machine 30 includes a weight support 54 that is connected to the cable system 35 in a similar manner to the weight support 54 in FIGS. 34 and 35 and a base support 70 configured for holding the weight(s) 53 and the weight support 54 while mounting the weight plates 53 on the support 54. The machine 30 also has a cable system 35 and a pulley system 37 that includes a mount 46, as well as a fixed connection 32 for fixing the resistance band 31 to the rack assembly 10. The fixed connection 32 in this embodiment may include a clevis structure 63 for connection to a lateral frame member 20B of the rack assembly 10 and a connection hole 64 for connection to the resistance band 31 (e.g., via a karabiner clip). It is understood that the machine 30 in FIGS. 36-45 may be configured for use in a vertical or angled downward pulling exercise, such as a lat pull or a triceps extension, and the cable system 35 may have a suitable grip connected to the grip attachment 34. It is also understood that the cable system 35 may be routed differently in order to configure the machine 30 for use in a different exercise using a different movement pattern.

The weight support 54 is shown in FIGS. 34-37, 40, 41, and 45 and generally includes a support plate 59 configured to support the weight plate(s) 53 from below at a resting position and during a lifting exercise, a shaft 60 extending upward from the support plate 59, a first connection 61 at the top end of the shaft 60 for connection to the cable system 35, and a second connection 62 beneath the support plate 59 for connection to a first end 31C of the resistance band 31. The connections 61, 62 in FIGS. 34-37, 40, 41, and 45 are made using karabiner clips, and it is understood that both of the connections 61, 62 may be configured to be removable connections. The shaft 60 in FIGS. 34-37, 40, 41, and 45 may be a hollow tube that extends through the support plate 59 and may be fixed to the support plate 59 (e.g., by welding), such that portions of the shaft 60 are positioned above and below the support plate 59. The upper portion of the shaft 60 may extends upward from the support plate 59 and be configured for extending through holes in the weight plate(s) 53 to mount the weight plate(s) 53 on the weight support 54. The connections 61, 62 are fixedly connected to the top and bottom ends of the shaft 60, respectively (e.g., by welding), and each connection 61, 62 extends across the hollow center of the shaft 60. It is understood that the weight support 54 may be configured differently in other embodiments, and the embodiment in FIGS. 34-37 and 45 provides durable and effective function with acceptable weight and simple construction.

Figure 42:
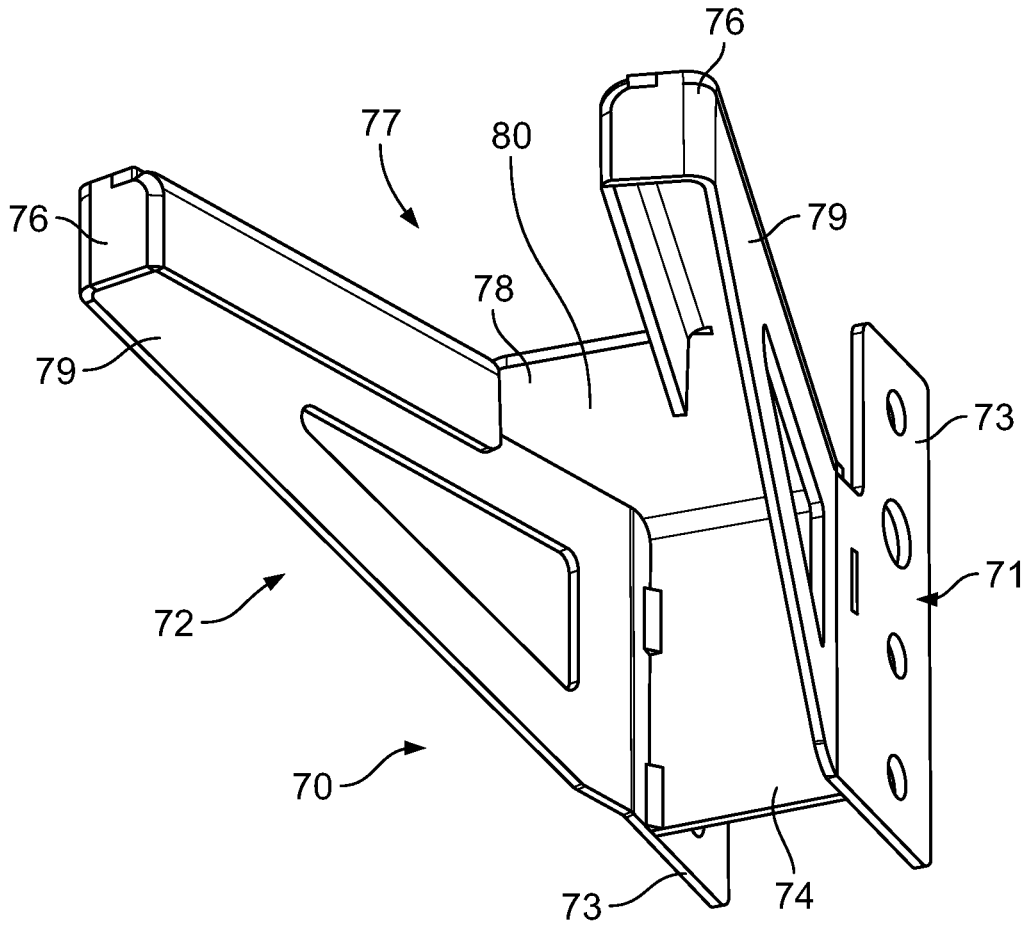
FIG. 42 illustrates a bottom perspective view of a weight supporting base of the weightlifting machine of FIG. 36, in accordance with aspects of the disclosure.
Figure 43:
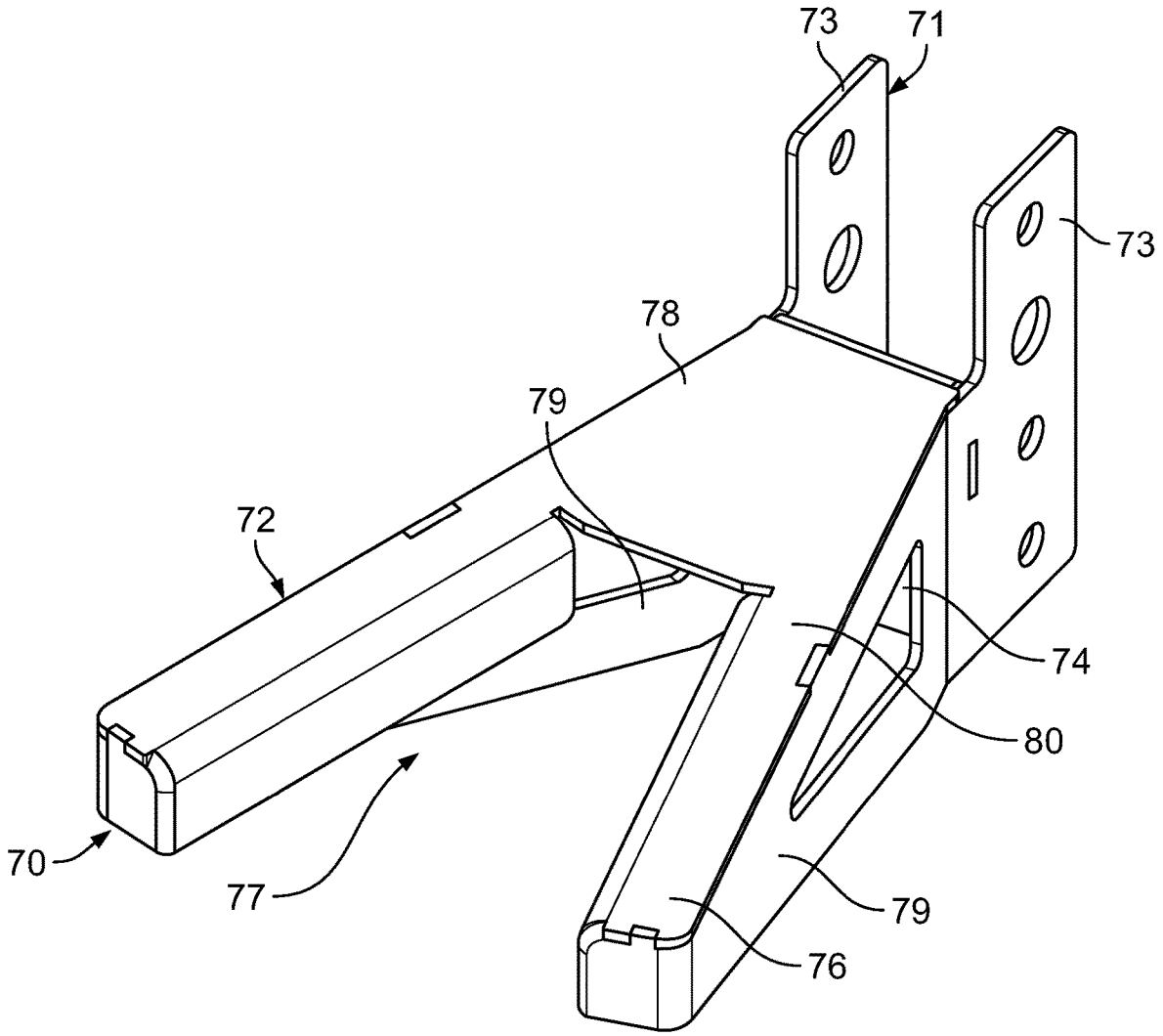
FIG. 43 illustrates a top perspective view of the weight supporting base of FIG. 42, in accordance with aspects of the disclosure.
Figure 44:
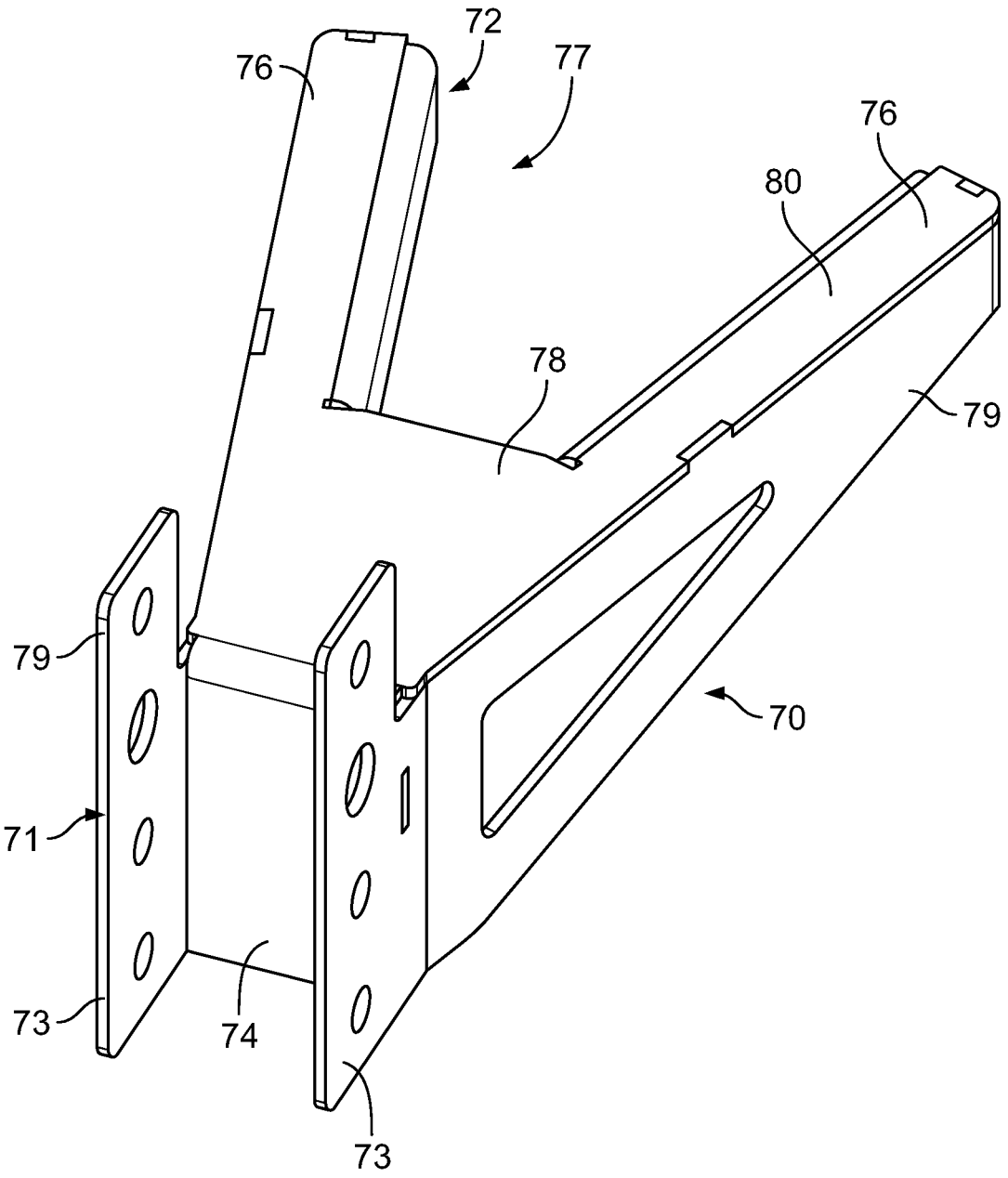
FIG. 44 illustrates a rear perspective view of the weight supporting base of FIG. 42, in accordance with aspects of the disclosure.
Figure 45:
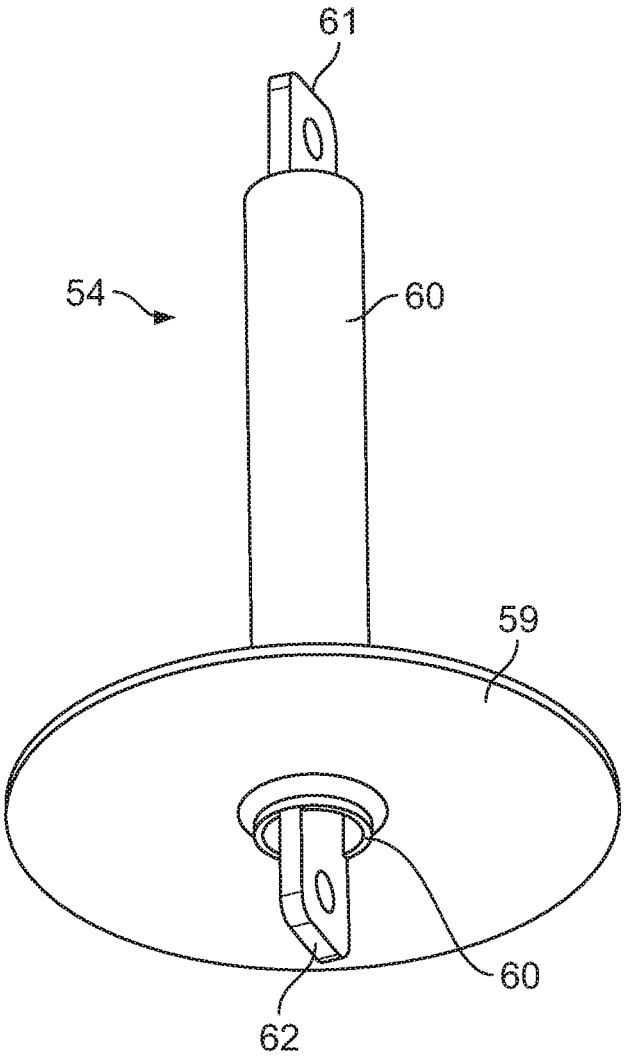
FIG. 45 is a bottom perspective of a weight support of the weightlifting machine of FIG. 36, in accordance with aspects of the disclosure.

The base support 70 in FIGS. 36, 37, 40, and 41 is shown alone in detail in FIGS. 42-44. The base support 70 generally has a mounting structure 71 for releasable connection to a vertical frame member 20A of the weight rack assembly 10 and a supporting member 72 configured to engage and support the weight support 54 and the weight plate(s) 53 at an elevated position. The base support 70 may be used during the exercise to limit a range of motion, to support the weight support 54 between sets or while mounting the weight plate(s) 53 on the weight support 54. The weight support 54 as configured in FIGS. and 34 and 35 must be disconnected from the cable system 35 for mounting or dismounting the weight plate(s) 53, leaving the weight support 54 and the weight plate(s) 53 unsupported. This makes mounting the weight plate(s) 53 and reconnecting the weight support 54 to the cable system 35 difficult, as the user must support the weight of both the support 54 and the weight plate(s) 53 (along with potentially experiencing the additional resistance of the resistance band 31) during some or all of this procedure. The support member 72 of the base support 70 may extend into a movement path of the weight support 54 defined by a range of motion of the cable 43, such that the support member 72 of the base support 70 is configured to engage and support the weight support 54 at the elevated position within the movement path of the weight support 54. The base support 70 supports the weight support 54 in a position where the cable system 35 can be easily connected to and disconnected from the weight support 54, and further permits the weight plate(s) 53 to be mounted on the weight support 54 without disconnecting the weight support 54 from the resistance band 31. The mounting structure 71 may be configured for mounting at various heights along the length of the vertical frame member 20A, so that a suitable height for mounting and dismounting the weight plate(s) 53 can be reached, depending on the configuration of the machine 30 and the cable system 35. The base support 70 may further form a bottom limit to the range of motion of the weight plate(s) 53 during exercise.

The mounting structure 71 of the base support 70 in FIGS. 36, 37, and 40-44 includes two spaced mounting plates 73 connected to a base plate 74 and extending rearward from the base plate 74, such that the frame member 20A is received between the mounting plates 73 and a fastener 75 (e.g., a removable pin) can be inserted through holes in the mounting plates 73 and holes 26 in the frame member 20A to fix the base support 70 in position. The support member 72 of the base support 70 in FIGS. 36, 37, and 40-44 may include two legs 76 extending forward from the base portion 74 to define a space 77 there between and a bridge plate 78 connected to the legs 76 and covering a portion of the space 77. The legs 76 in this embodiment extend forward and angle away from each other, such that the space 77 is widest at the distal ends of the legs 76. Alternatively, in some embodiments, the legs may extend forward substantially parallel to each other. The legs 76 as illustrated in FIGS. 36, 37, and 40-44 are formed in a triangular shape, such that the heights of the legs 76 are greatest proximate the base plate 74 and the legs 76 taper toward the distal ends thereof. For example, each leg has a first height proximate the base portion 74 and a second height proximate a distal end of each leg 76, wherein the first height is greater than the second height. In one embodiment, the side surfaces of the legs 76 are made by two plates 79 that are connected to the base plate 74 and extend outwardly and forwardly therefrom. In one embodiment, each of the plates 79 may be formed as an integral plate structure with one of the mounting plates 73 by an integral joining technique. Additionally, the bridge plate 78 and the top surfaces of the legs 76 may also be formed together as a single plate member 80 that is bent downward along the inner sides of the legs 76 to open the space 77. The base plate 74 may be a separate plate member, or may be an integral portion of the plate member 80 forming the bridge plate 78 and the top and inner surfaces of the legs 76. These plate structures may be formed from metallic materials and be connected together by welding and/or other joining techniques, and the plate members may include some mechanical interlocking structures to assist this connection.

In use, the weight support 54 sits on top of the supporting member 72 such that the underside of the support plate 59 rests on the legs 76 and, optionally, also on the bridge plate 78. The legs 76 are spaced a distance that is smaller than the width of the support plate 59 to permit this supporting configuration. The components of the weight support 54 beneath the support plate 59, e.g., the bottom end of the shaft 60 and the second connection 62, extend into the space 77 between the legs 76, to enable connection with the resistance band 31 to be retained such that the resistance band 31 extends through the space 77. The base plate 74 in this configuration may engage the vertical frame member 20A to resist rotation of the base support 70 due to the weight exerted on the supporting member 72. It is understood that the base support 70 may have a different configuration in other embodiments. For example, in one embodiment, the space 77 may be enclosed by the legs (e.g., a hole/aperture), and in another embodiment, the space 77 may not be present, such as if the weight support 54 does not include any structure beneath the support plate 59 for connection to a resistance band 31.

Figure 38:
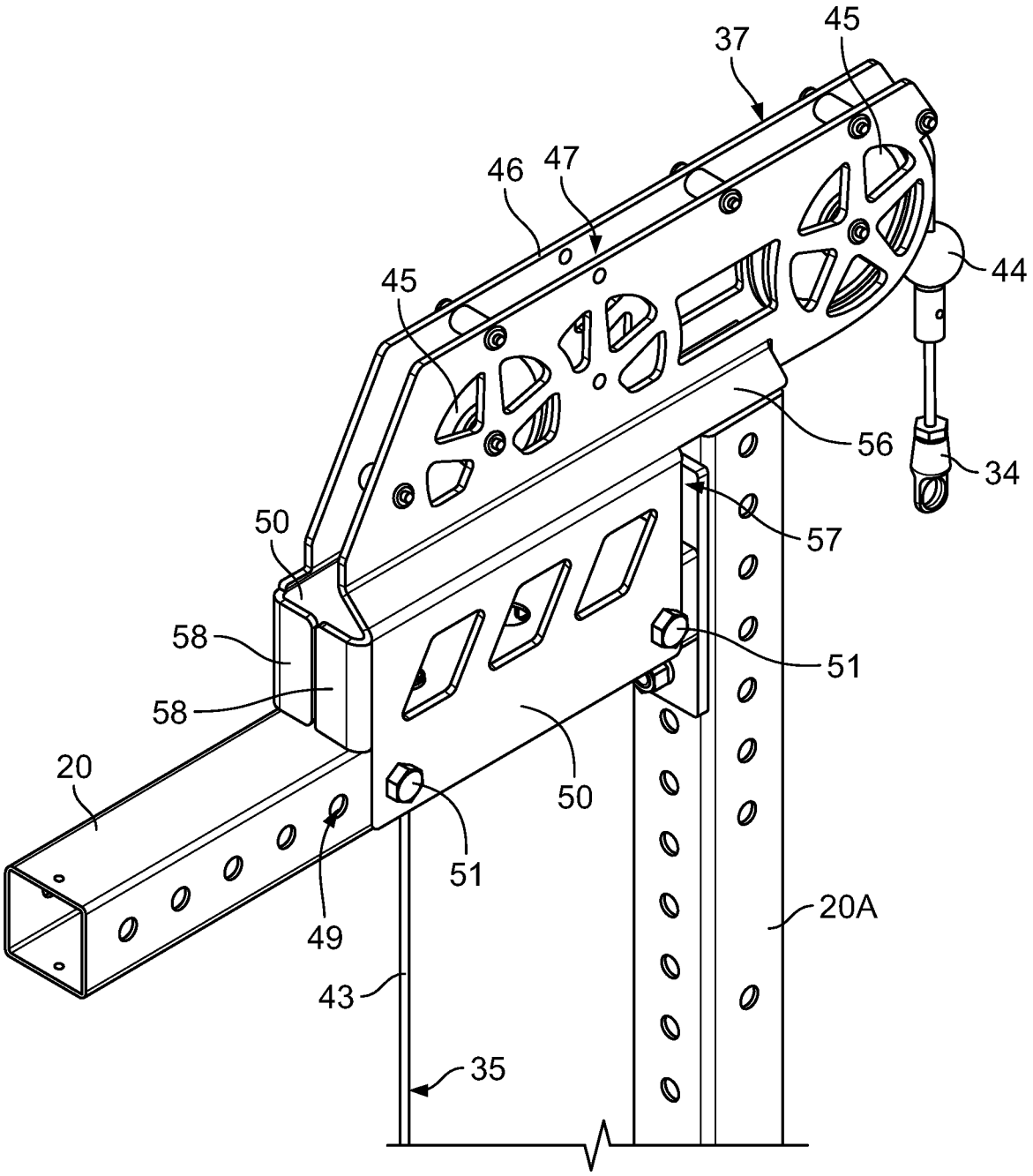
FIG. 38 illustrates a perspective view of a portion of the weightlifting machine of FIG. 36, in accordance with aspects of the disclosure.
Figure 39:
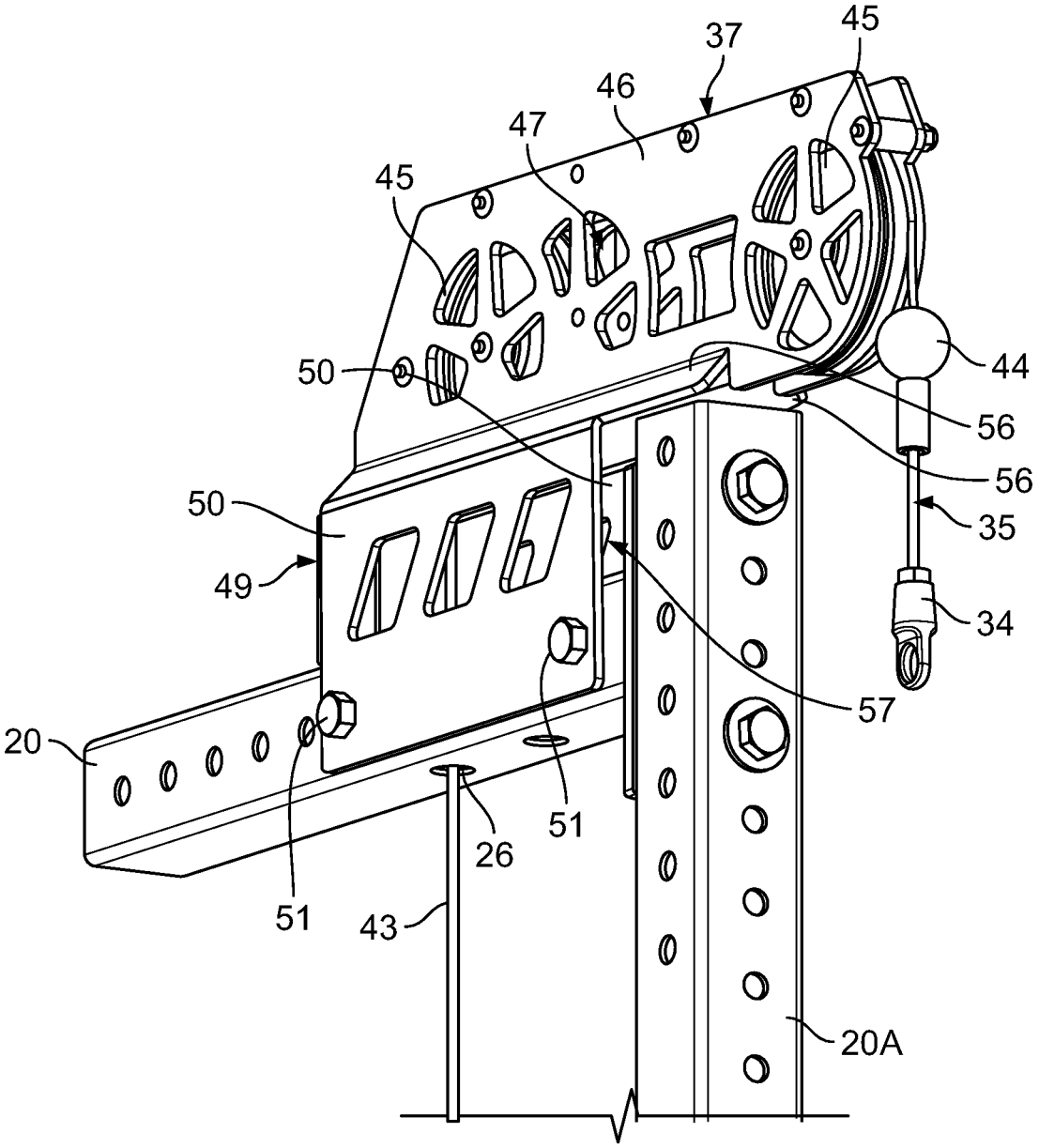
FIG. 39 illustrates a perspective view of a portion of the weightlifting machine of FIG. 36, in accordance with aspects of the disclosure.
Figure 40:
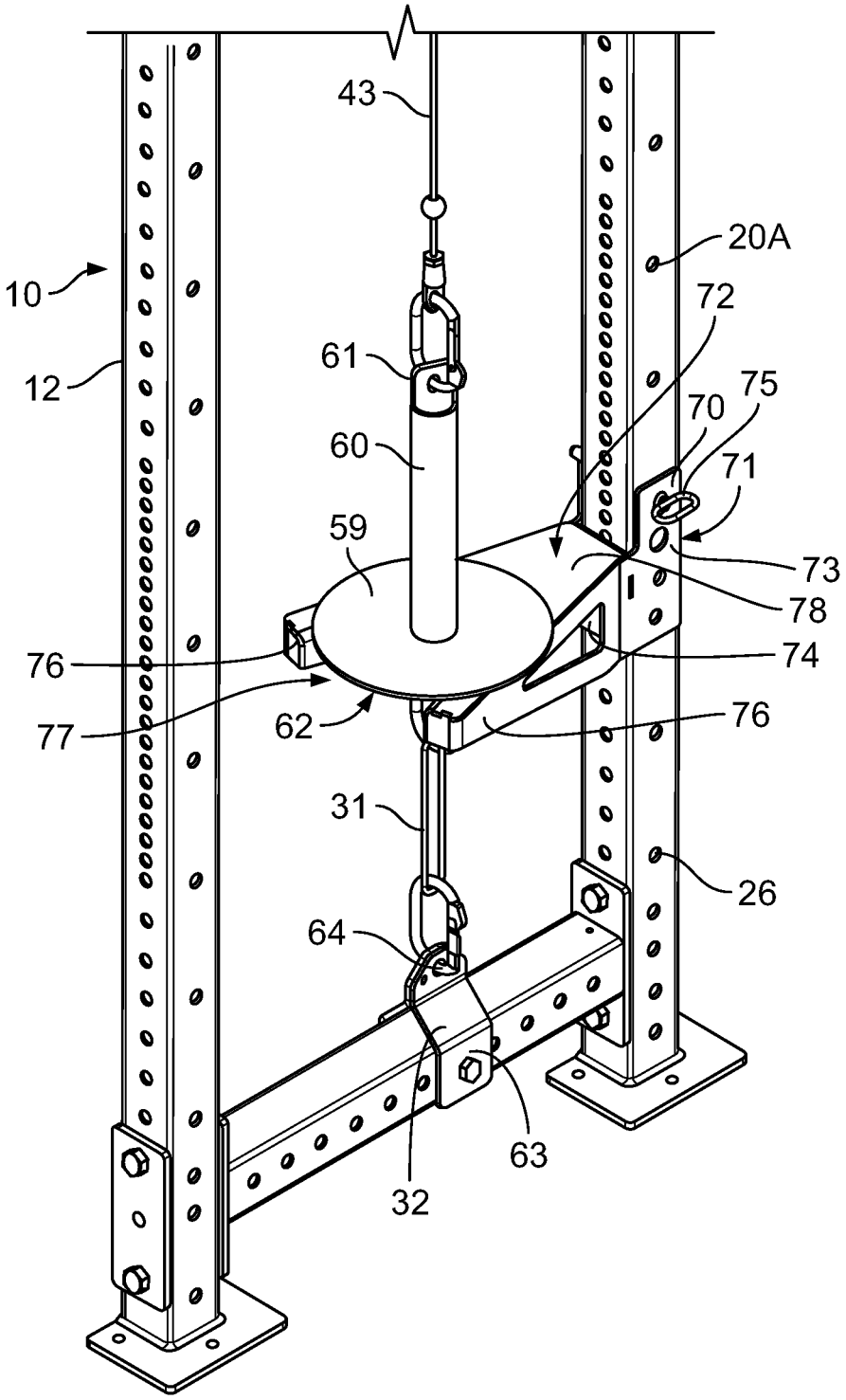
FIG. 40 illustrates a perspective view of a portion of the weightlifting machine of FIG. 36, in accordance with aspects of the disclosure.
Figure 41:
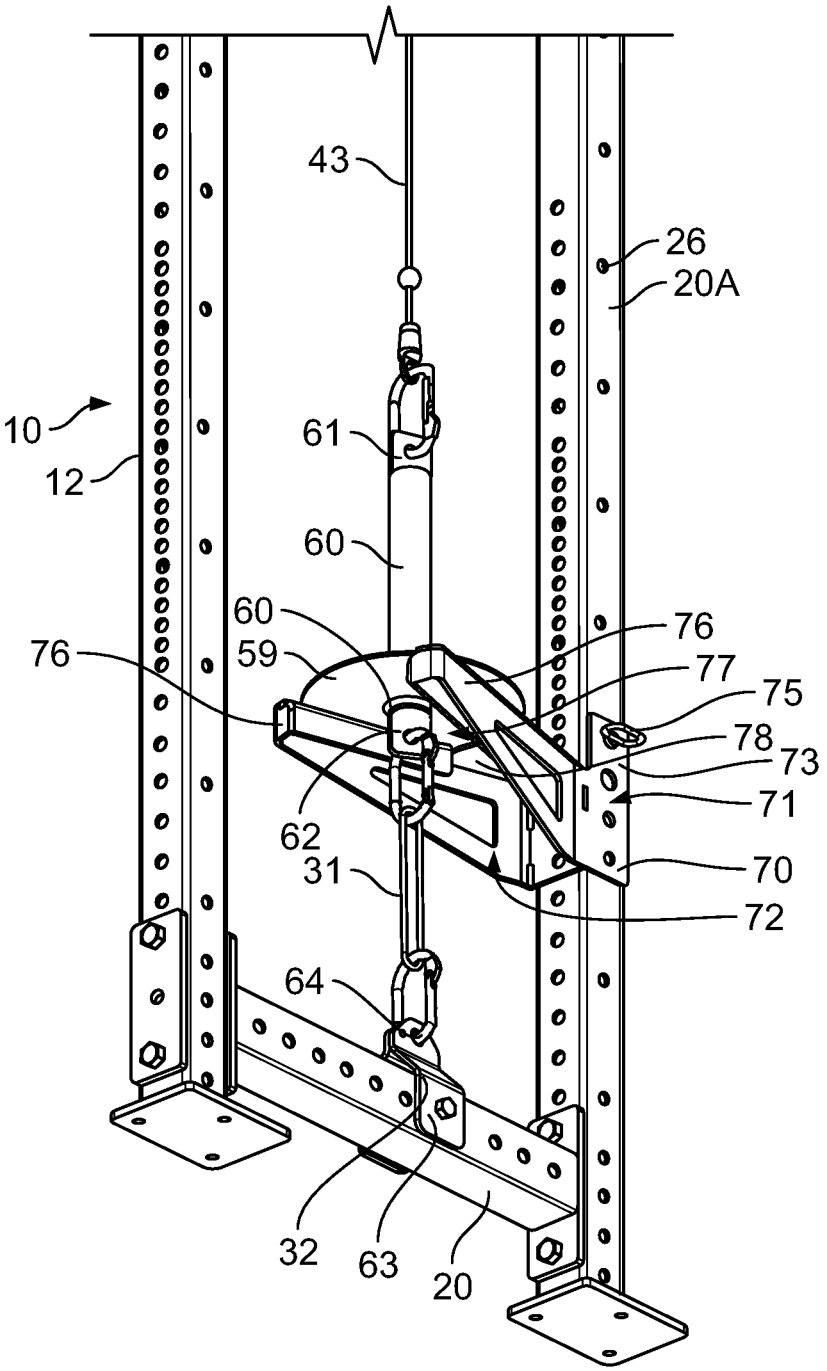
FIG. 41 illustrates a bottom perspective view of a portion of the weightlifting machine of FIG. 36, in accordance with aspects of the disclosure.

The pulley system 37 in FIGS. 36-45 may include a mount 46 connected to the frame 12 and having two pulleys 45 that engage and guide the cable(s) 43. The pulley mount 46 in this embodiment is shown in greater detail in FIGS. 25-26. The pulley mount 46 in FIGS. 38 and 39 may include a mounting structure 49 that includes two mounting plates 50 extending on opposite sides of the frame member 20 to receive the frame member 20 between. The mounting structure 49 is connected to the frame member 20 by receiving fasteners 51 connected to both mounting plates 50 and extending through the frame member 20. The mounting plates 50 both extend outward at an angle to the mount 46, and then vertically downward for connection to and engagement with the frame member 20. The mount 46 may also have wings 56 that extend outwardly and downwardly proximate the mid-length of the mount 46 to engage an adjacent vertical frame member 20A by fasteners 51 in this configuration, to support the front of the mount 46. The wings 56 are contiguous with the outwardly extending portions of the mounting plates 50 in this configuration. The vertical frame member 20A in FIGS. 25-26 extends above the top of the horizontal frame member 20, and the body of the mount 46 is mounted level with the top of the vertical frame member 20A. In this configuration, the mounting plates 50 extend downward further than the mounting plates 50 in FIGS. 1-35, such that a gap 57 is defined between the underside of the body of the mount 46 and the top surface of the horizontal frame member 20. The mount 46 further includes one or more bracing members 58 that engage the top of the horizontal member 20 to brace and stabilize the mount 46. The bracing members as shown in FIG. 38 are in the form of rigid tabs that are bent inward from the mounting plates 50.

In the embodiment of FIGS. 36-45, the mount 46 is connected to a horizontal or lateral frame member 20B by fasteners 51 such as pins (including cotter pins or other locking pins), bolts and other threaded connectors, clamps, and other types of fasteners. The mount 46 supports both pulleys 45 at opposite ends of the mount 46, and the mount 46 includes a central slot 47 that receives a portion of both pulleys 45.

Figure 46:
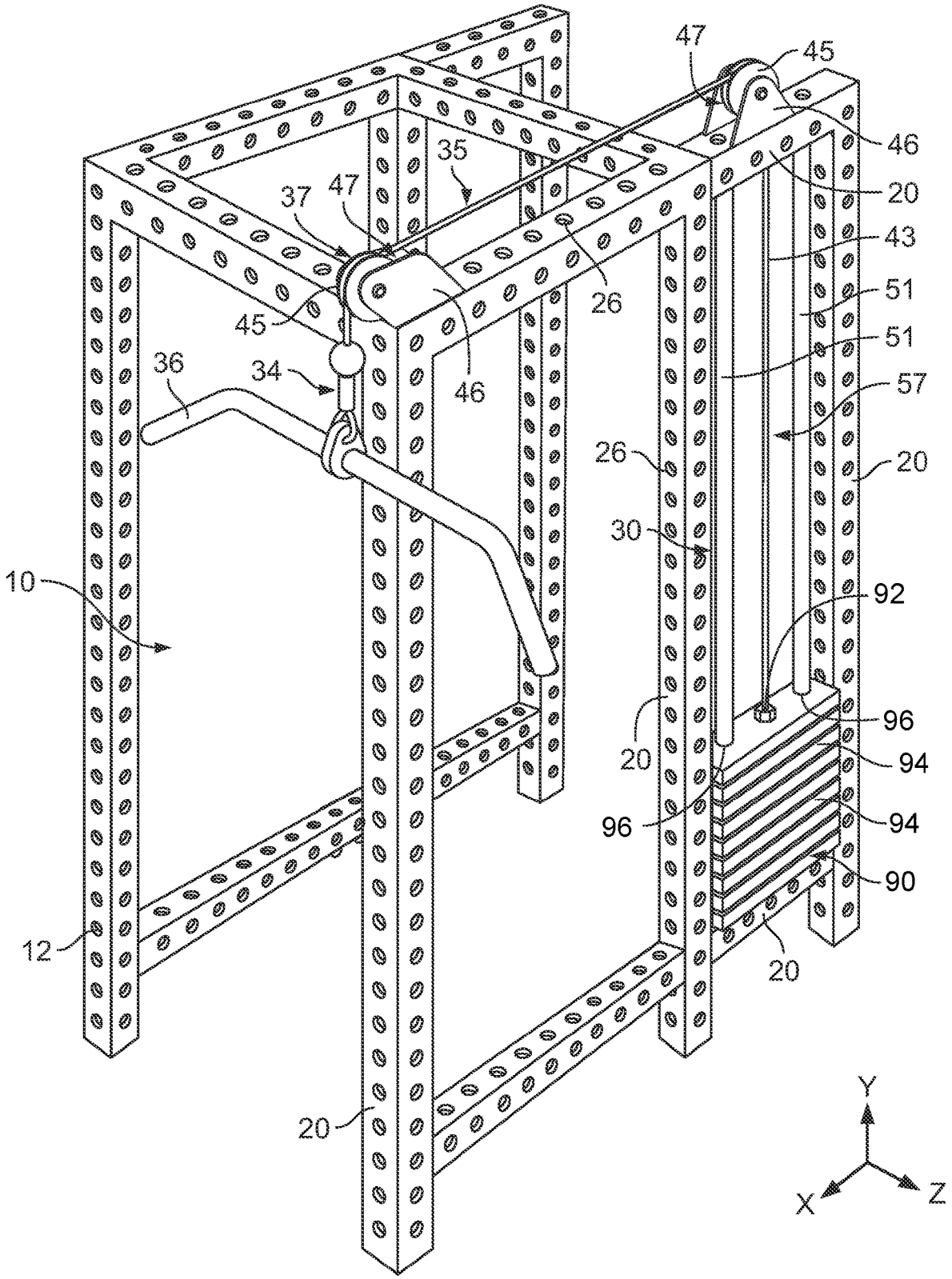
FIG. 46 illustrates a perspective view of a weightlifting machine, in accordance with aspects of the disclosure.
Figure 47:
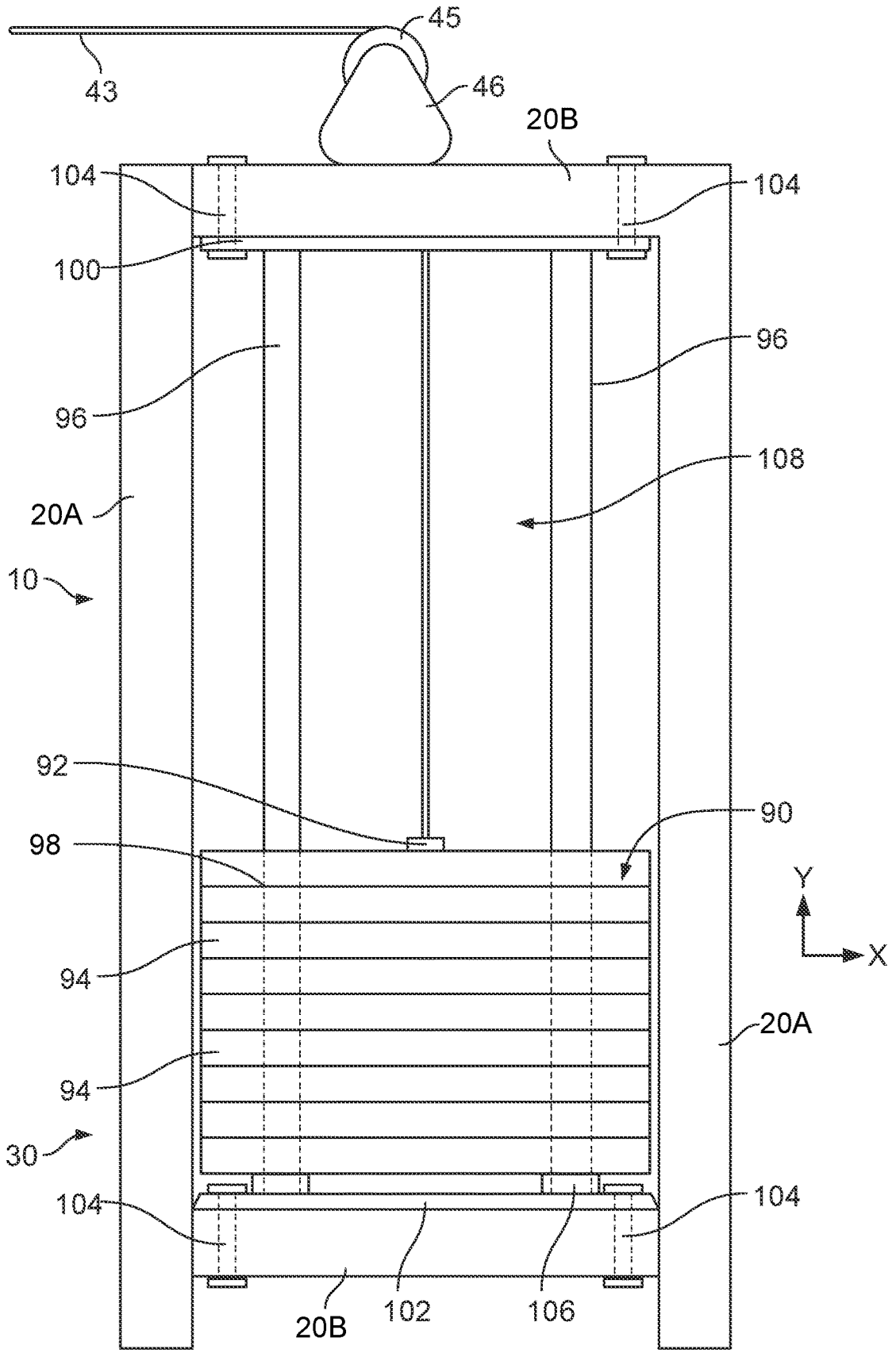
FIG. 47 illustrates a side view of a portion of the weightlifting machine of FIG. 46, in accordance with aspects of the disclosure.
Figure 48:
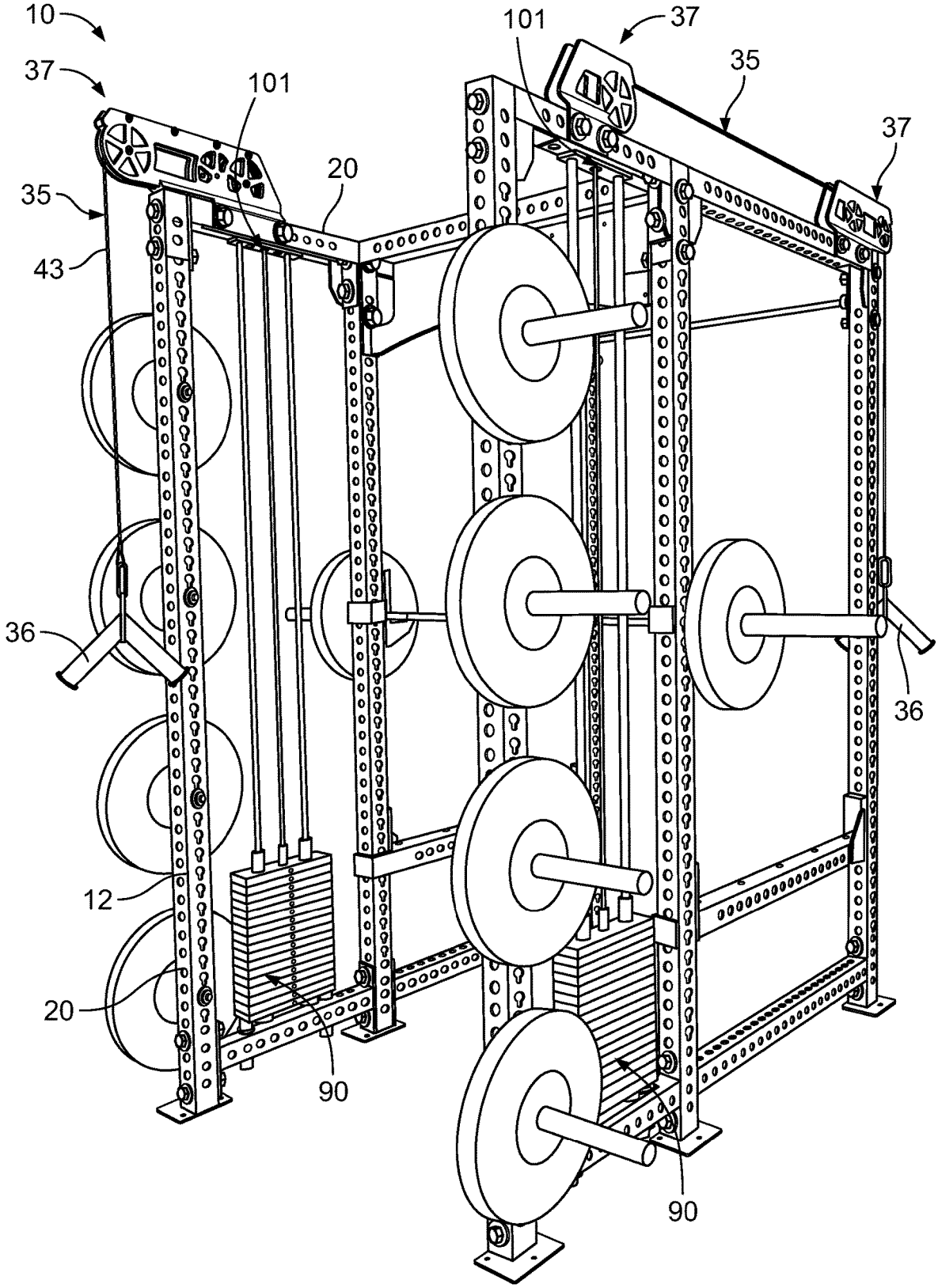
FIG. 48 illustrates a perspective view of another weightlifting machine with a plurality of pulley assemblies, in accordance with aspects of the disclosure.

Referring to FIG. 46, an example embodiment of a weight rack assembly 10 is shown that includes a frame 12 and one or more weightlifting structures connected to and/or supported by the frame 12, including one or more shelves, barbell racks, and body weight exercise supports (e.g., bars, handles, and other structures for use in body weight exercises such as chin-ups, climbing, and others), and weightlifting accessories and mechanisms. FIGS. 46-48 illustrate further embodiments of a weightlifting machine 30 that include many of the features of the weightlifting machines 30 of FIGS. 1-45. Such common features may not be described herein in great detail for the sake of brevity, and it is understood that similar reference numbers may be used to refer to components of FIGS. 46-48 that are similar to components of the embodiments shown in FIGS. 1-45. The frame 12 in this embodiment is primarily formed by a plurality of structural support members or frame members 20 in the form of metal bars, which may be arranged and connected to each other as vertical beams, horizontal or lateral cross-beams, and angular beams to support the various structures of the rack assembly 10 as described above in the embodiments illustrated in FIGS. 1-45.

Figure 49:
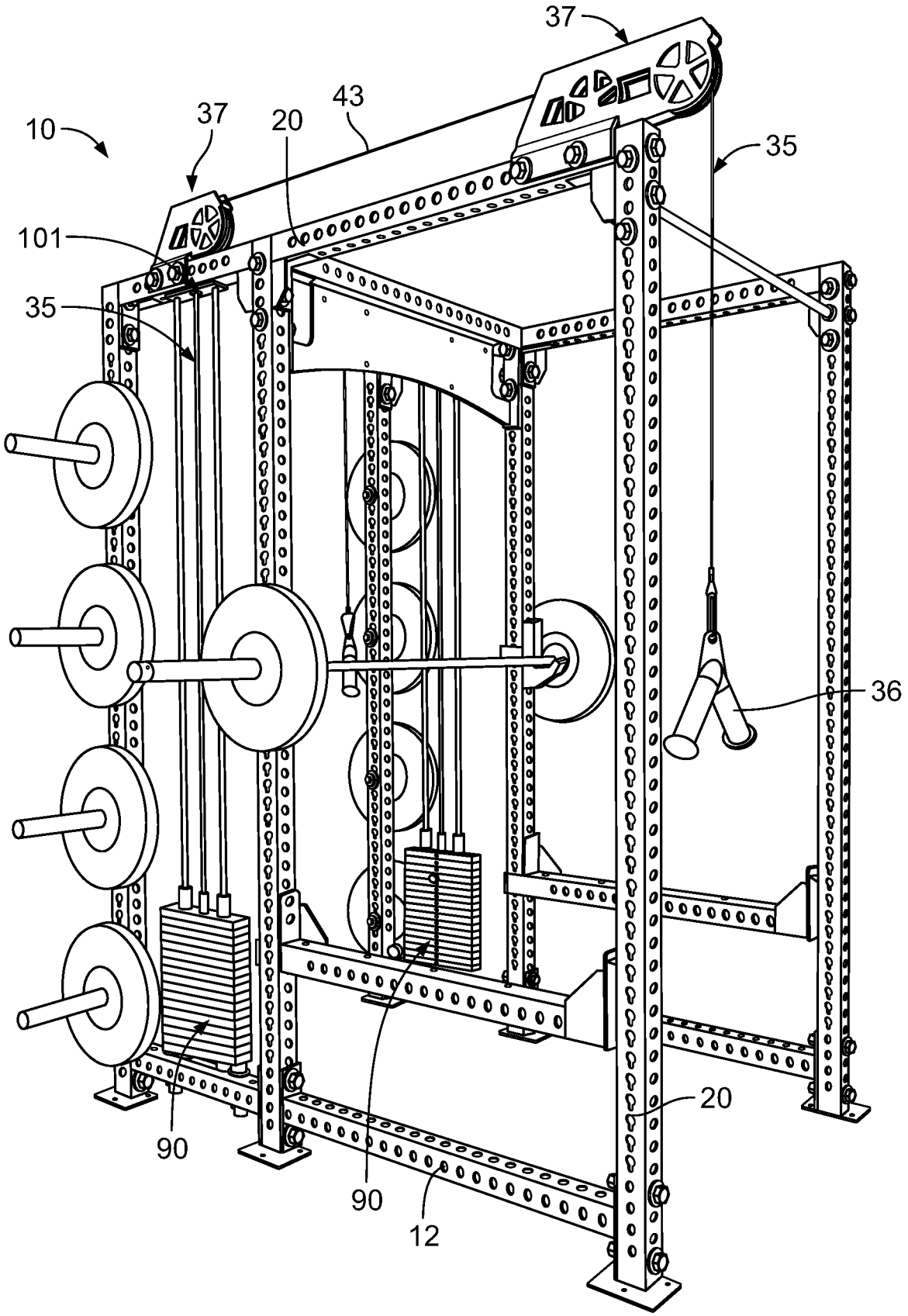
FIG. 49 illustrates a perspective view of another weightlifting machine, in accordance with aspects of the disclosure.

The rack assembly 10 in FIG. 46 includes a weightlifting machine 30 that includes a movable weight plate assembly 90 configured for installation on an existing rack assembly 10, for use in a weightlifting exercise. FIG. 47 illustrates a portion of a rack assembly 10 with a weightlifting machine 30 similar to those of FIG. 46 and described above in the previous embodiments, and FIGS. 48 and 49 illustrate additional embodiments of rack assemblies 10 with weightlifting machines 30 with components similar to the components described herein with respect to FIGS. 46 and 47. The weightlifting machine 30 generally includes a weight-engaging member 92 configured to selectively engage one or more weights 94, a grip attachment 34, a cable system 35 connecting the weight-engaging member 92 to the grip attachment 34, a grip 36 connected to the grip attachment 34, and a pulley system 37 guiding the cable system 35.

The weight-engaging member 92 in this embodiment includes an elongated member that extends through aligned holes (not shown) in a plurality of weights 94 stacked on top of each other. The weight-engaging member 92 may be fixedly connected to one or more of the top weights 94 in the stack or to none of the weights 94, and a plurality of the lower weights 94 in the stack are not fixedly engaged with the weight-engaging member 92. A releasable or removable engaging member (not shown), such as a removable pin, engages at least one of the weights 94 to fix the respective weight 94 to the weight-engaging member 92, such that lifting the weight-engaging member 92 causes the weight 94 to move upward, carrying all additional weights 94 located above the engaged weight 94 as well. This configuration allows selection of the total amount of weight engaged by the weight-engaging member 92.

Similar to the embodiments described above, the grip attachment 34 may be connected to the cable system 35 and also attached to a grip 36 for engagement by the user to perform the weightlifting exercise. The grip 36 shown in FIGS. 46 and 47 is a lat pull grip configured for gripping by the user's hands, but other grips may be used in other embodiments. It is understood that the grip attachment 34 may also be connectable to other user engagement devices, such as a belt or harness. The grip attachment 34 may include a removable connector for attachment to different grips 36 or other devices, such as a karabiner. The grip attachment 34 may be configured for free rotation, e.g., by having internal bearings.

The cable system 35 in FIGS. 46 and 47 may be include a single cable 43 connected at one end to the weight-engaging member 92 and at the other end to the grip attachment 34. Similar to the other embodiments, the cable 43 may pass through one or more of the frame members 20, such as through one or more fastener holes 26 and/or through the central passage of the frame member(s) 20. In addition, the cable 43 may pass through one or more protectors 48 that are secured within the one or more fastener holes 26.

The weight plate assembly 90 of the weightlifting machine 30 in FIGS. 46 and 47 may also include weight guides 96 that are spaced from each other, which extend through aligned apertures 98 in the weights 94, such that the weights 94 can move vertically along the guides 96. The guides 96 may be mounted on horizontal or lateral frame members 20B of the frame 12 and extend between an upper horizontal frame member and a lower horizontal frame member 20. As shown in FIG. 47, the weight plate assembly 90 may include a top mount 100 and/or a bottom mount 102 to mount the guides 96 to the frame members 20, where the guides 96 extend vertically and linearly from the top mount 100 to the bottom mount 102. The top and bottom mounts 100, 102 in FIG. 47 may be fixedly connected to the frame members 20 by fasteners 104 such as bolts, and the guides 96 are fixedly connected to the mounts 100, 102. The top mount 100 in this configuration may also include an opening 101 for the cable 43 to pass through, where the opening 101 is aligned with the hole(s) 26 in the frame member 20 through which the cable 43 passes (See FIGS. 48-49). In another embodiment, the guides 96 may be directly connected to the frame members 20 at one or both ends. The weight plate assembly 90 in FIG. 47 further includes bumpers or stops 106 positioned around the guides 96 to define the bottom end of the range of movement of the weights 94 and protect the mount 102 and/or the frame 12 from impact by the weights 94. The assembly 90 may also include bumpers or other stops above the top weight 94 to limit upward movement of the weights 94, such as stops 106 positioned around the guides 96 or a stop 44 positioned on the cable 43.

The weights 94 and all other components of the weight plate assembly 90 in FIGS. 46 and 47 may be configured to be mounted within a space 108 defined by frame members 20 of a frame 12 of a weight rack assembly 10. In the embodiment of FIGS. 46 and 47, the space 108 is a rectangular space bounded by two vertical frame members 20A (extending in a Y-direction) and two horizontal frame members 20 (extending in an X-direction). The X, Y, and Z directions are labeled in FIG. 46, and the X and Y directions are labeled in FIG. 47, with the understanding that the Z-direction extends perpendicular to the plane of view. The weights 94 are dimensioned to fit horizontally between the vertical frame members 20A with space to move vertically, and the guides 96 are dimensioned to be fixed vertically between the horizontal frame members 20B. As shown in FIGS. 46-49, the entire weight plate assembly 90 or the weightlifting machine 30 may be supported by the pre-existing frame 12 of the rack assembly 10, without any external structures that are not connected to one of the four frame members 20 defining the space 108. None of the components of the weight plate assembly 90 in this embodiment, including the guides 96, the weights 94, the weight-engaging member 92, the mounts 100, 102, etc., extend horizontally (in the X-direction) or vertically (in the Y-direction) outside of the space 108. Some components (e.g., the weights 94) may extend longitudinally (in the Z-direction) outside the space 108. Additionally, no portion of the weight plate assembly 90 or the weightlifting machine 30 in this embodiment contacts the ground in the mounted position in this embodiment.

Figure 50:
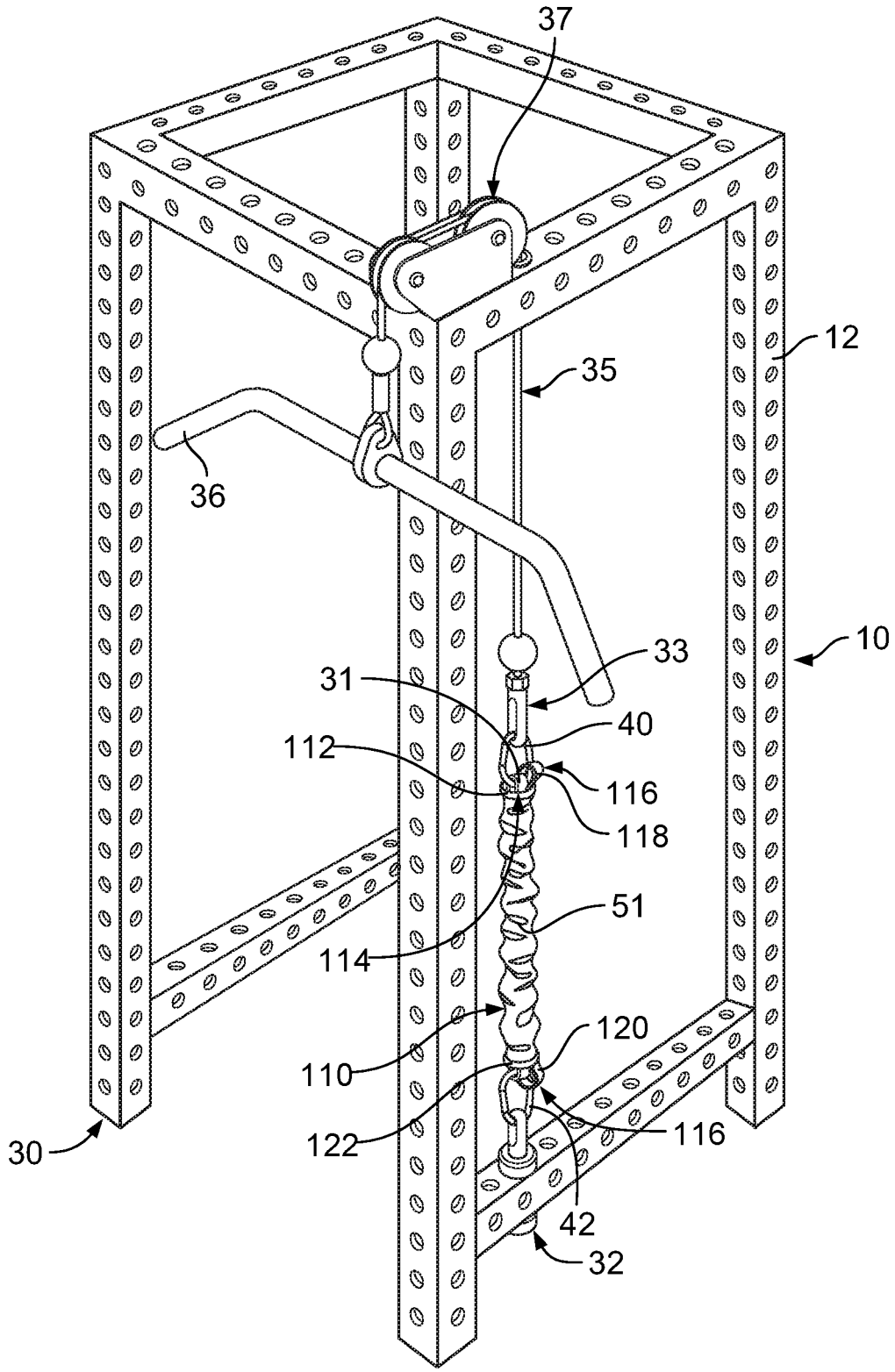
FIG. 50 illustrates a perspective view of another weightlifting machine, in accordance with aspects of the disclosure.
Figure 51:
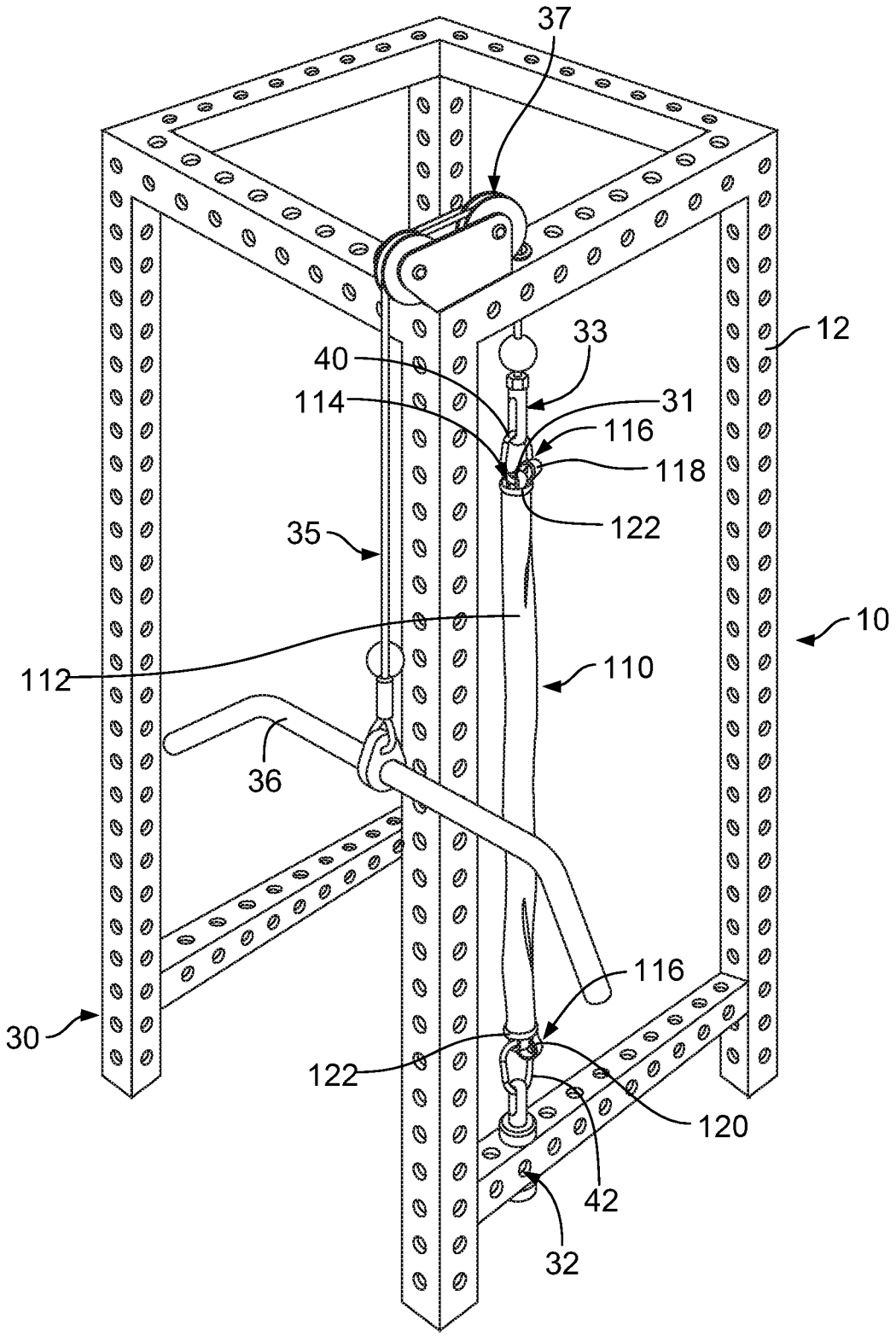
FIG. 51 illustrates a perspective view of another weightlifting machine, in accordance with aspects of the disclosure.

As another embodiment, FIGS. 50 and 51 illustrate the weightlifting machine 30 of FIG. 1 with a sheath or cover 110 that at least partially covers the resistance band 31 to protect the resistance band 31 from cuts, abrasions, wear, and other potential damage. The cover 110 in this embodiment includes an elongated, flexible tubular body 112 having an internal passage 114 receiving at least a portion of the band 31 therethrough, with a connecting structure 116 for connecting the cover 110 to the weightlifting machine 30. The tubular body 112 completely encircles the band 31 over the substantial entirety of the length of the band 31 in the embodiment of FIGS. 50 and 51. The connecting structure 116 in FIGS. 50 and 51 may include two connectors in the form of first and second loops 118, 120 connected to the tubular body 112 at or proximate opposite ends 122 of the tubular body. The loops 118, 120 may be directly connected both to the attachment 40 at movable connection 33 and the connector 42 (e.g., karabiners) at the fixed connection 32 to which the band 31 is also connected in the embodiment of FIGS. 50 and 51. Optionally, the loops 118, 120 may be configured for connection to a different structure or structures in other embodiments. The loops 118, 120 are connected to the tubular body 112 by stitching and/or adhesive, such as by connecting the loops 118, 120 to the inner surface of the tubular body 112 such that the loops 118, 120 extend out of the ends 122 of the tubular body 112 for connection to the karabiners 40, 42. In another embodiment, the cover 110 may be configured for direct connection to the band 31 rather than to the machine 30.

The tubular body 112 in one embodiment is formed of a nylon-based fabric (e.g., Cordura®), but other flexible materials may be used in other embodiments, including other durable, abrasion-resistant fabrics. It is understood that non-flexible materials that are formed into a flexible structure may be used in another embodiment. The tubular body 112 in FIGS. 50 and 51 is formed of a lightweight, low-stretch material that collapses and/or folds as the band 31 contracts (FIG. 50) and extends as the band 31 is stretched (FIG. 51), which does not exert significant additional force on the cable system 35 during use. In another embodiment, the tubular body 112 may be at least partially formed of an elastic or stretchable material that stretches and contracts with the band 31. The tubular body 112 may have reinforcing structures near the ends 122, such as hems at the ends 122 of the tubular body 112 and/or separate reinforcing structures connected to the tubular body 112. As discussed above, the band 31 may be formed as a complete loop in one embodiment, such that two substantially parallel segments 31A, 31B extend between the attachment 40 and the connector 42 and are joined at the ends 31C, 31D of the band 31. In the embodiment of FIGS. 50 and 51, both of these segments 31A, 31B extend through the internal passage 114 of the cover 110. In other embodiments, the cover 110 may be configured to cover the segments 31A, 31B separately. For example, in one embodiment, the tubular body 112 may be formed as a tubular loop that covers both of the segments 31A, 31B separately, as well as the ends 31C, 31D of the band 31, such that the karabiners 40, 42 contact the cover 110 directly, rather than contacting the band 31 inside the tubular body 112. This configuration may offer additional protection against abrasion or other damage caused by contact with the karabiners 40, 42. The tubular body 112 may be formed as a substantially complete loop with two ends 122 that are separate and positioned adjacent each other or the tubular body 112 may be formed as a complete loop, in various embodiments.

FIGS. 52-61 illustrate additional example embodiments of a weight rack assembly 10, each of which includes further embodiments of a weightlifting machine 30 that include many of the features of the weightlifting machines 30 of FIGS. 1-51. Such common features may not be described herein in great detail for the sake of brevity, and it is understood that similar reference numbers may be used to refer to components of FIGS. 52-61 that are similar to components of the embodiments shown in FIGS. 1-51.

Figure 53:
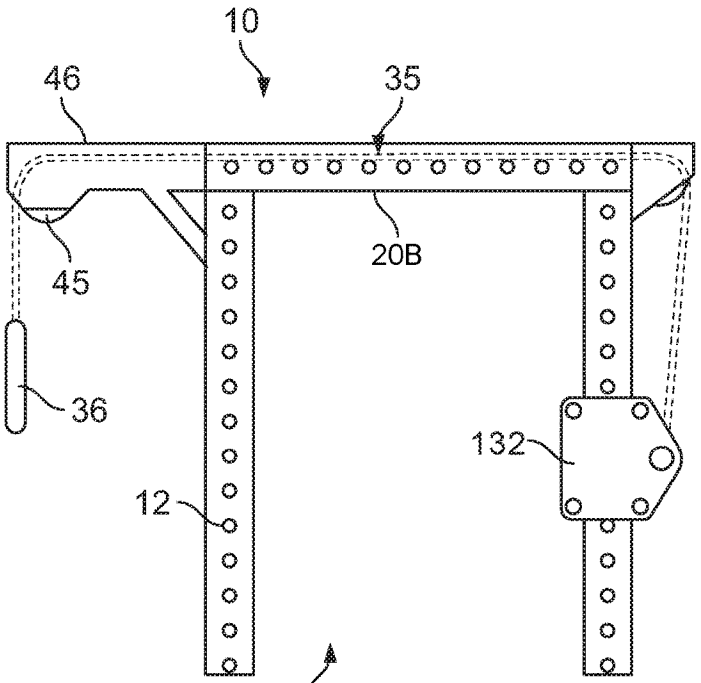
FIG. 53 illustrates a side view of the weightlifting machine of FIG. 52, in accordance with aspects of the disclosure.
Figure 52:
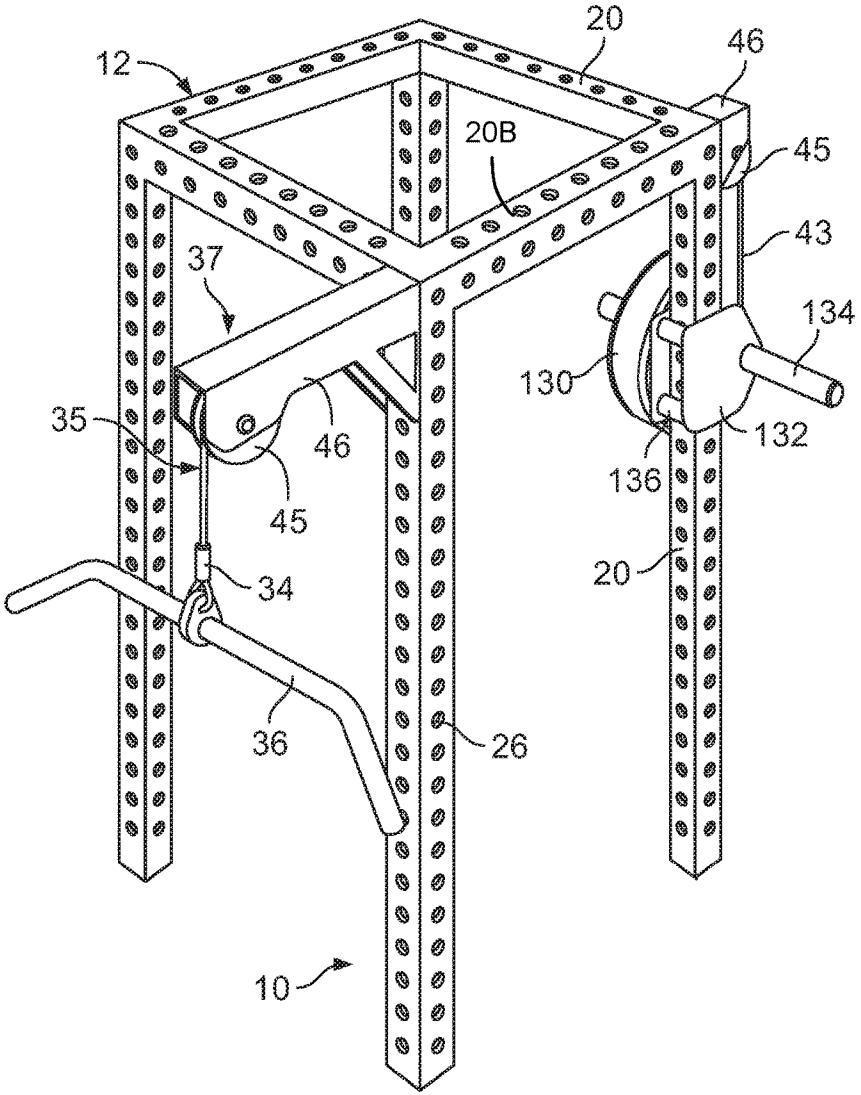
FIG. 52 illustrates a perspective view of another weightlifting machine, in accordance with aspects of the disclosure.
Figure 55:
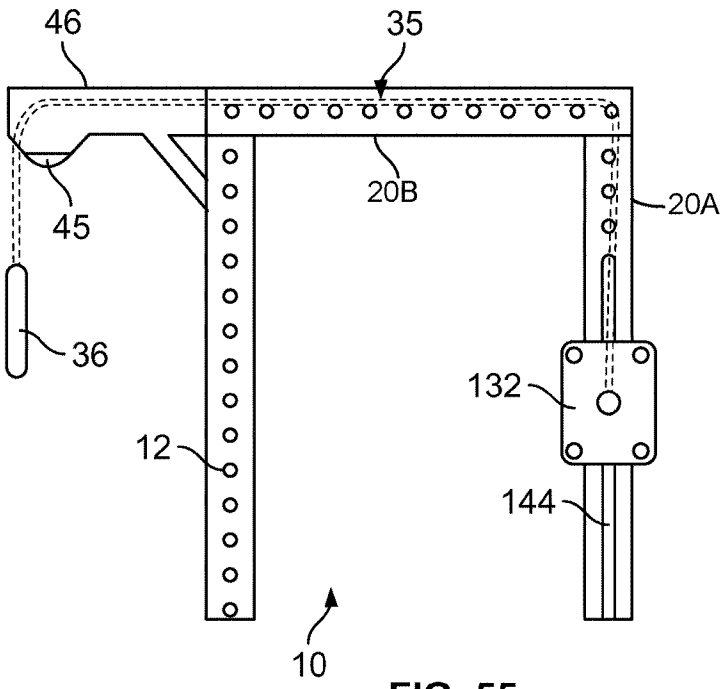
FIG. 55 illustrates a side view of the weightlifting machine of FIG. 54, in accordance with aspects of the disclosure.
Figure 54:
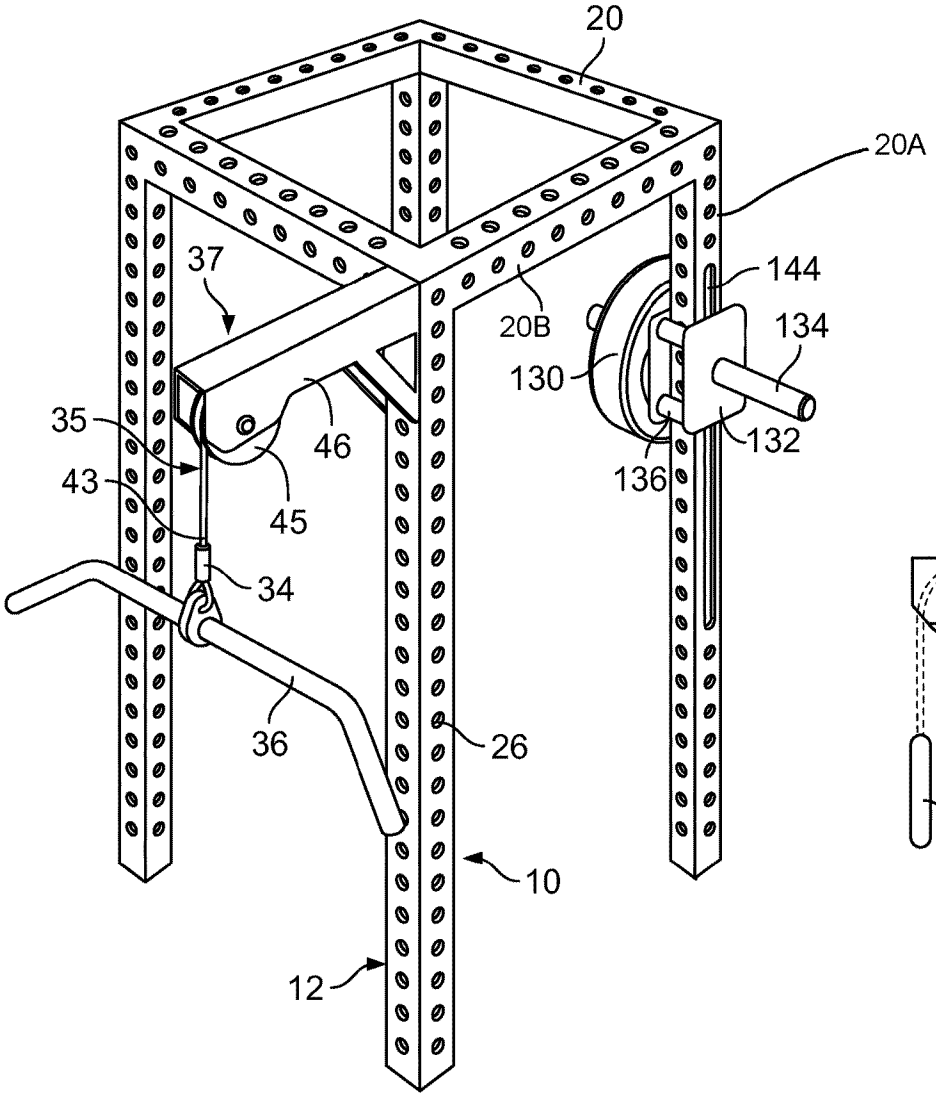
FIG. 54 illustrates a perspective view of another weightlifting machine, in accordance with aspects of the disclosure.
Figure 56:
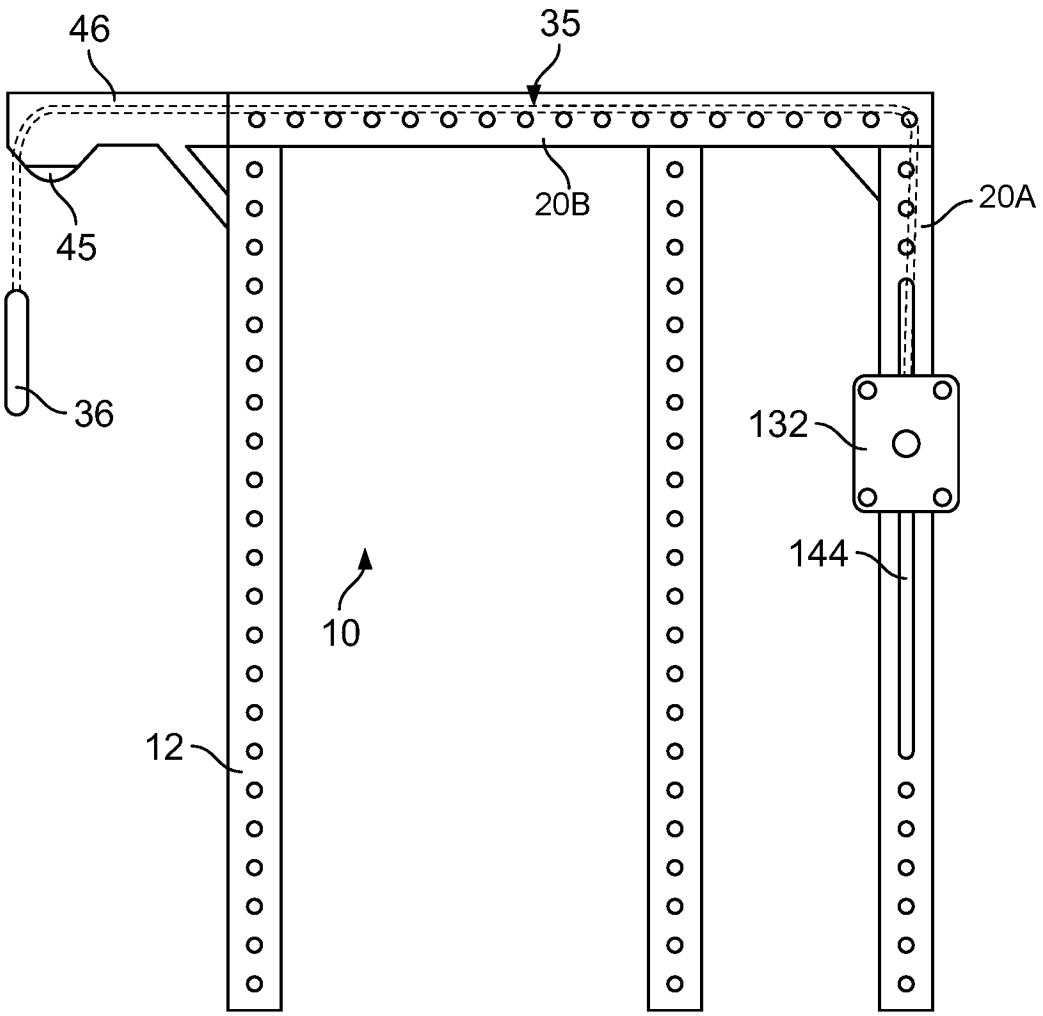
FIG. 56 illustrates a side view of an alternate embodiment of the weightlifting machine of FIG. 54, in accordance with aspects of the disclosure.
Figure 57:
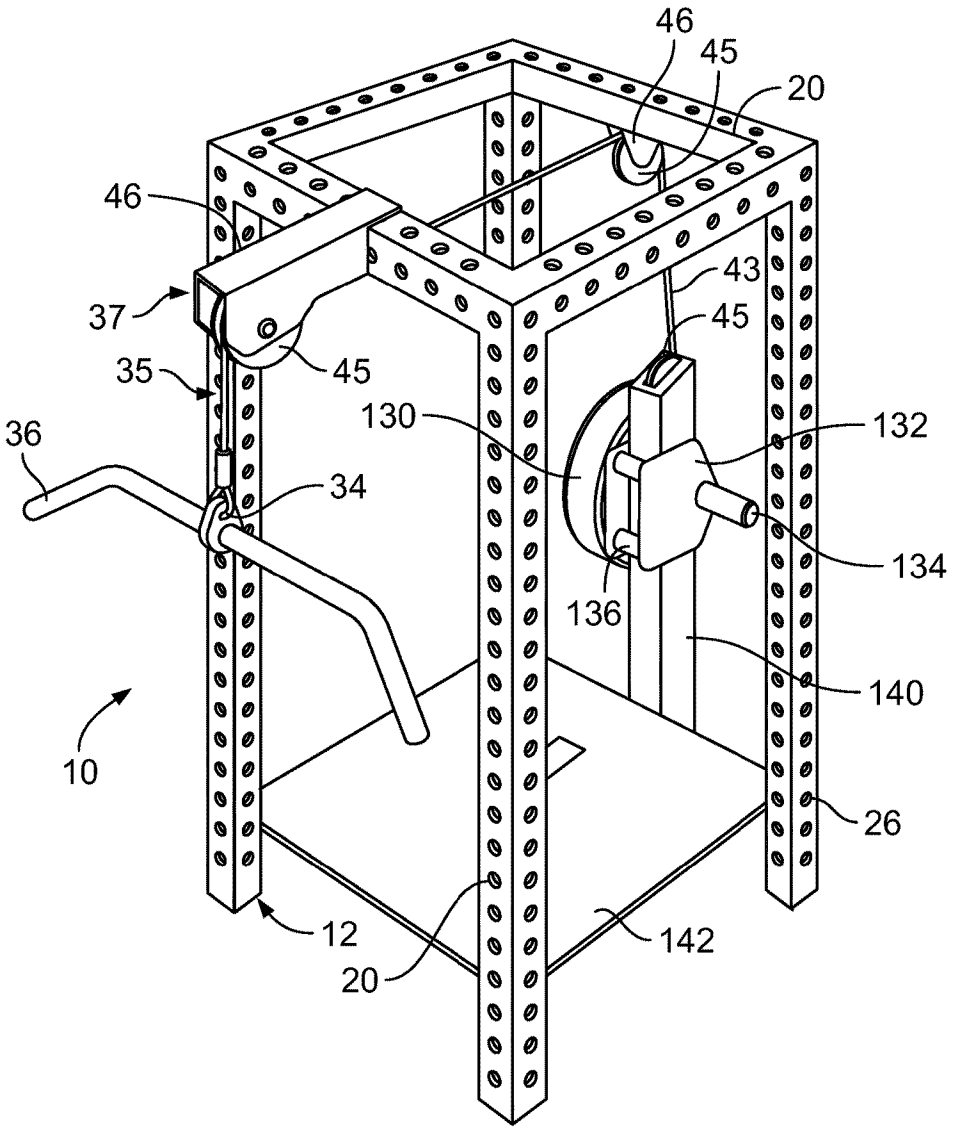
FIG. 57 illustrates a perspective view of another weightlifting machine, in accordance with aspects of the disclosure.
Figure 58:
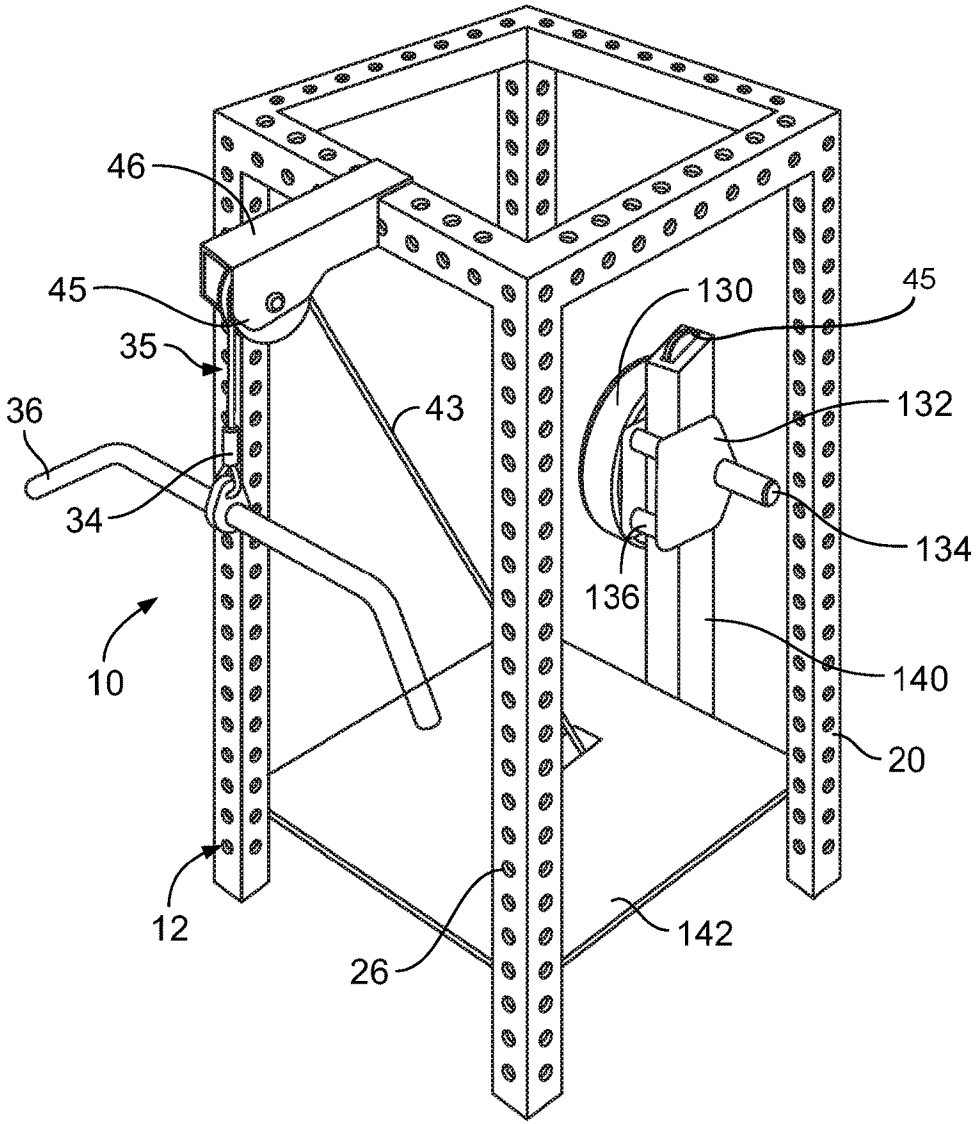
FIG. 58 illustrates a perspective view of another weightlifting machine, in accordance with aspects of the disclosure.
Figure 59:
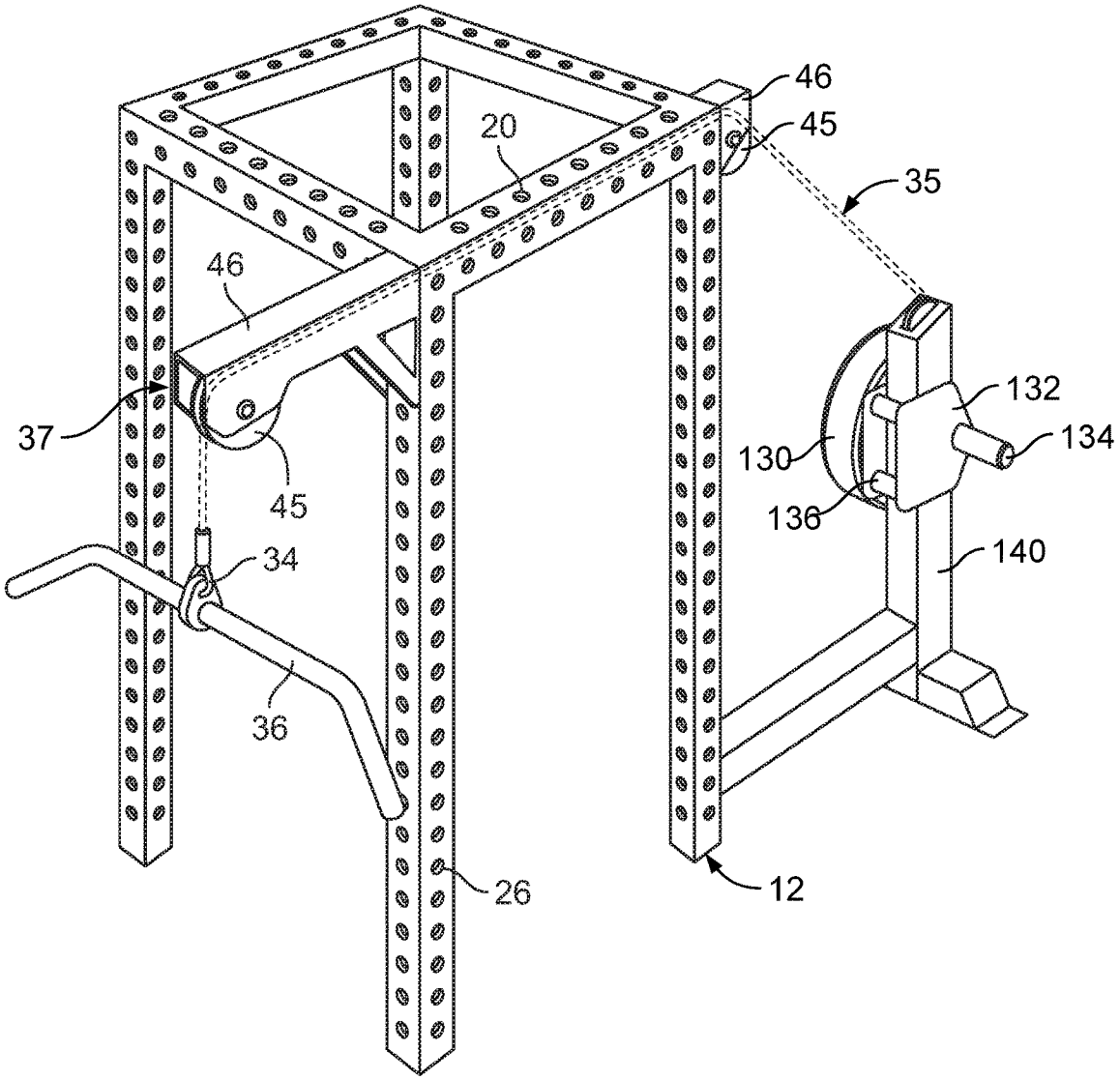
FIG. 59 illustrates a perspective view of another weightlifting machine, in accordance with aspects of the disclosure.
Figure 60:
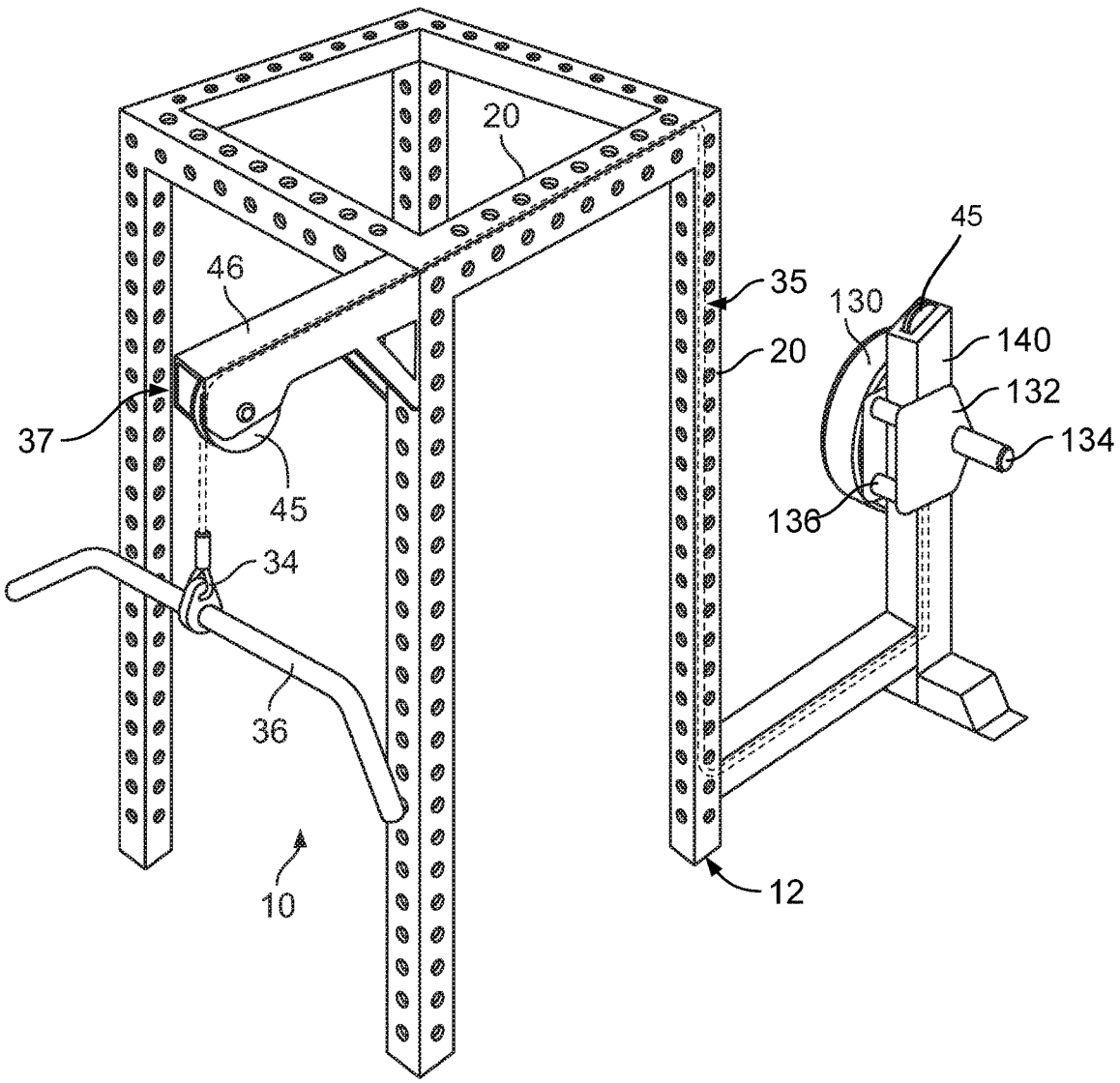
FIG. 60 illustrates a perspective view of another weightlifting machine, in accordance with aspects of the disclosure.

Each rack assembly 10 in FIGS. 52-61 may include a weightlifting machine 30 for use with a weight 130 to provide resistance for a weightlifting exercise. The weightlifting machine 30 may generally include a movable trolley or carriage 132 having a weight holder 134, a grip attachment 34, a cable system 35 connecting the carriage 132 to the grip attachment 34, a grip 36 connected to the grip attachment 34, and a pulley system 37 guiding the cable system 35. The various embodiments of rack assemblies 10 in FIGS. 52-61 may have the cable system 35 routed through one or more of the frame members 20, as well as portions of the pulley system 37 located at least partially within one or more frame members 20. For example, the cable system 35 in FIGS. 52-53 is routed longitudinally through a lateral frame member 20B and exits the lateral frame member 20B to connect to the carriage 132 outside the frame 12. As another example, the cable system 35 in FIGS. 54-56 is routed longitudinally through a lateral frame member 20B, then longitudinally through a vertical frame member 20A to connect to the carriage 132 at a location within the vertical frame member 20A. The carriage 132 in FIGS. 54-56 is moveably mounted on the vertical frame member 20A and has a member (not shown) such as a peg or beam that is received in a vertical channel 144 and extends through the vertical frame member 20A. This member slides within the channel 144 as the carriage 132 moves along the vertical frame member 20A, and the cable system 35 in FIGS. 54-56 is connected to this member within the frame member 20A.

The grip attachment 34, cable system 35 with cable 43, and pulley system 37 may be similar to the other embodiments described herein. As such, these elements are not described in detail as it pertains to the embodiments shown in FIGS. 52-61.

The cable system 35 may be similar to the other embodiments described herein. In addition, the cable system 35 may be configured so that the cable(s) 43 pass through one or more of the frame members 20, such as through one or more fastener holes 26, one or more longitudinal ends of the frame members 20, and/or through the central passage of the frame member(s) 20 longitudinally or transversely (i.e., across the width). For example, FIGS. 52-56 illustrate cables 43 that are routed longitudinally through the central passage of one or more frame members 20.

The pulley system 37 may be similar to the other embodiments described herein. In addition, the pulley system 37 may also include one or more mounts 46 configured for mounting the pulley(s) 45 to the frame 12. Each mount 46 may be configured to support a single pulley 45 or multiple pulleys 37. It is understood that each of the embodiments of FIGS. 52-61 may include additional pulleys that are not specifically shown, e.g., at any point where the cable(s) 43 of the cable system 35 change direction.

Each of the embodiments in FIGS. 52-61 uses a carriage 132 that is mounted either on a frame member 20 (as in FIGS. 52-56) or on a specially configured carriage mount 140 (as in FIGS. 57-61) that may be connected to the frame 12 or separate from the frame 12. The carriage 132 and/or carriage mount 140 may be provided in a configuration of a trolley, carriage, or carriage support or as described in U.S. Provisional Application No. 62/639,392, filed Mar. 6, 2018; U.S. Provisional Application No. 62/725,048, filed Aug. 30, 2018; U.S. Provisional Application No. 62/723,200, filed Aug. 27, 2018; U.S. Provisional Application No. 62/668,005, filed May 7, 2018; U.S. Provisional Application No. 62/723,107, filed Aug. 27, 2018; U.S. patent application Ser. No. 16/294,664 filed on Mar. 6, 2019; and U.S. patent application Ser. No. 16/405,611 filed on May 7, 2019. All of these above referenced prior applications are incorporated by reference herein in their entireties. Other structures from these prior applications may be incorporated herein, such as the platform 142 in FIGS. 57-58, which illustrate alternate routing configurations for a cable 43 to make use of a carriage 132 and a carriage mount 140 with a platform 142 configured for use in a belt squat exercise. It is understood that the carriage 132 in FIGS. 52-61 may include rollers 136 for engaging the outer surfaces of the carriage mount 140 or the frame member 20 and/or may include other movable engaging structure, such as one or more pins or posts (not shown) that slide within a track 144 in the frame member 20 (see FIGS. 54-56).

Figure 61:
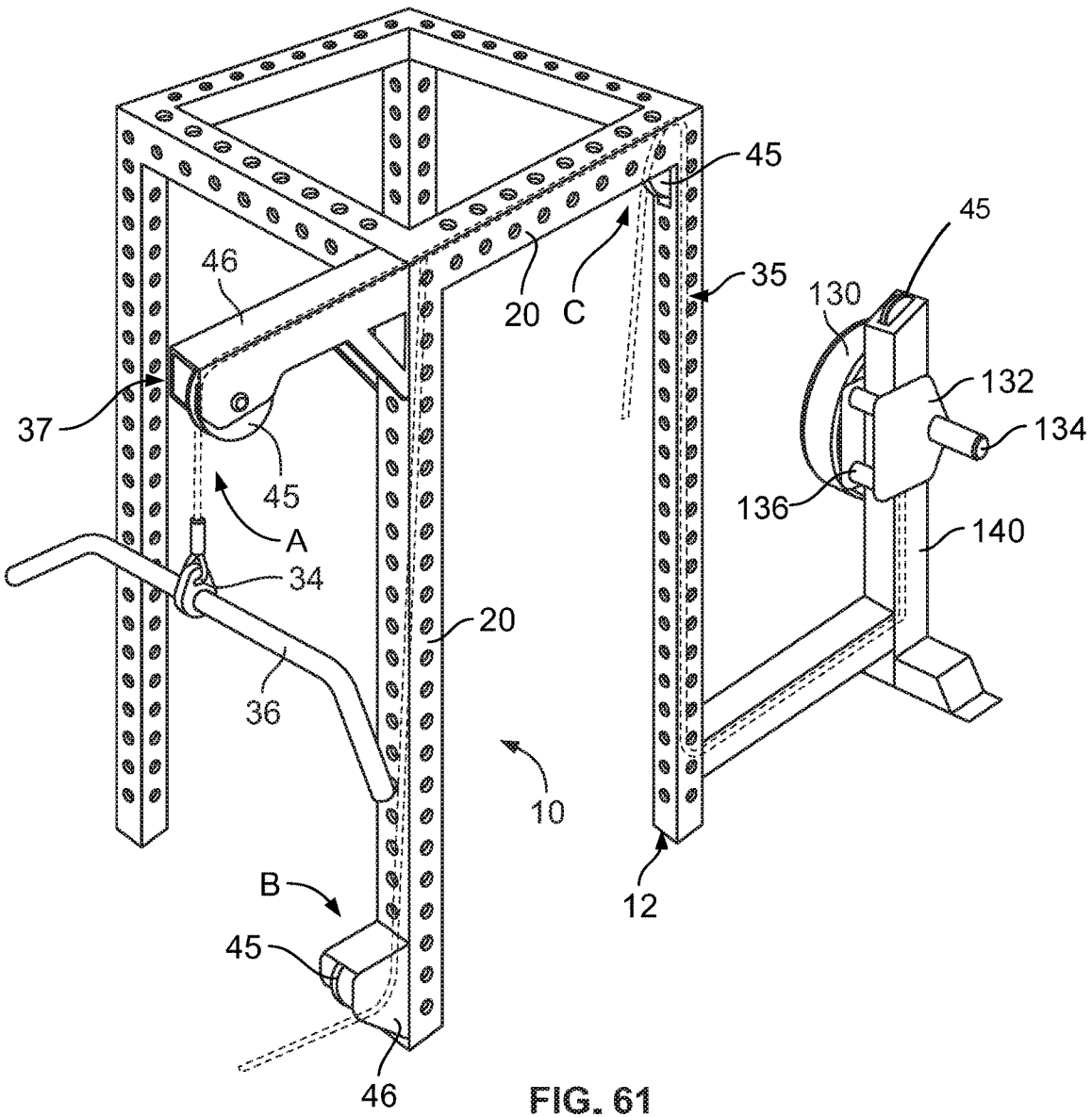
FIG. 61 illustrates a perspective view of another weightlifting machine, in accordance with aspects of the disclosure.

The weightlifting machines 30 in the embodiments of FIGS. 52-61 are configured for use as a lat pull mechanism, but it is understood that the weightlifting machines 30 can be modified for use with other weightlifting exercises, such as through attachment of a different grip, re-arrangement of components, and/or addition of additional pulleys 45 to the pulley assembly 37. Additionally, any of the carriages, or trolleys, 132 in these embodiments may be configured for use with resistance bands for resistance in addition to or in place of the weights 130. For example, the embodiment in FIG. 61 is configured to permit at least three different routings of the cable system 35, including a first routing A for vertical pulling (e.g., lat pulls), a second routing B for horizontal pulling (e.g., rows), and a third routing C for vertical or diagonal pulling (e.g., triceps extensions). The weight rack 10 and the pulley system 37 in FIG. 61 may include pulleys 45 positioned to enable all of these routings. It is understood that, while not shown in the FIGS., the routing of the cable 43 in FIGS. 58, 60, and 61 extends 180° over the pulley 45 at the top of the carriage support 140 and vertically down the rear of the carriage support 140 to connect to the rear of the carriage 132. It is also understood that the routing of the cable 43 in all of FIGS. 52-61 may utilize additional pulleys 45 that are not illustrated, for example, at any location where the direction of the cable 43 route is changed.

FIGS. 64-65 schematically illustrate embodiments of weightlifting machines 30 that include cable systems 35 with multiple cables 43A,B and cable routing that provides a mechanical advantage. The cable system 35 of FIG. 64 includes two cables 43, with one cable 43A having an end fixed to the frame 12 and routed through a travelling pulley 45 on a travelling pulley mount 46A. The second cable 43B is fixed to the travelling pulley mount 46A and has the moveable connection 33 of the cable system 35 connected to a resistance element 11. The cable system 35 of FIG. 65 includes two cables 43, with one cable 43A having an end fixed to the frame 12 and routed through a travelling pulley 45 mounted on a travelling pulley mount 46A. The second cable 43B is also fixed to the frame 12 and routed through another travelling pulley 45 mounted on the same travelling pulley mount 46A and has the moveable connection 33 of the cable system 35 connected to a resistance element 11. It is understood that the other end of the cable 43A in both FIGS. 64-65 is directly or indirectly connected to the grip attachment 34 and/or the grip 36. More complicated or circuitous routing configurations for the cable system 35 may be used in other embodiments, which may include the use of additional cables 43.

The embodiments of weightlifting machines 30 described herein are generally illustrated for use in a lat pull weightlifting exercise, but these machines 30 may be modified for use in a different weightlifting exercise by modifying the weightlifting machine 30 and/or the weight rack assembly 10 to which the machine 30 is connected, such as by using a different grip 36 and/or a different cable routing as shown in FIG. 61 and described herein. Additionally, the weightlifting machines 30 described herein may be used in a method for modifying or retrofitting an existing weight rack assembly 10 for use in one or more specific weightlifting exercises. In general, the method includes connecting at least one pulley assembly 37 to the weight rack frame 12, connecting any additional components of the weightlifting machine 30 to the weight rack frame 12 as appropriate, routing the cable system 35 as appropriate (including through the pulley assembly 37), and then connecting a grip 36 to one end of the cable system 35 and connecting the other end of the cable system 35 to a resistance element. The pre-existing weight rack assembly 10 may already be configured for use in one or more weightlifting exercises, and the connection of the weightlifting machine 30 configures the weight rack assembly 10 for use in one or more additional weightlifting exercises.

The various embodiments described herein enable connection of a cable-based weightlifting machine to a traditional weight rack assembly in a time-efficient and cost-efficient manner. The components of the weightlifting machine are easily and quickly connectable to a weight rack assembly using the existing connections of the weight rack assembly. Several embodiments of weightlifting machines 30 and weight rack assemblies 10 incorporating such machines have been described herein, which include various components and features. In other embodiments, the machine 30 and/or the weight rack assembly 10 may be provided with any combination of such components and features. It is also understood that in other embodiments, the various devices, components, and features of the weightlifting machines 30 and weight rack assemblies 10 described herein may be constructed with similar structural and functional elements having different configurations, including different ornamental appearances. Still other benefits may be recognized by those skilled in the art. Accordingly, while the specific embodiments have been illustrated and described, numerous modifications come to mind without significantly departing from the spirit of the invention and the scope of protection is only limited by the scope of the accompanying claims.

What is claimed is:

1. A weight rack system, comprising:

a frame including an arrangement of a plurality of vertical frame members that are connected together with a plurality of lateral frame members extending between the plurality of vertical frame members;

a pulley assembly attached to the frame, wherein the pulley assembly comprises a pulley and a mount connected to the frame, wherein the pulley is rotatably mounted on the mount;

a cable system connected at a first end to a movable connection and at a second end to a grip attachment, wherein the cable system extends from the grip attachment to the pulley and engages the pulley to redirect the cable system, and the cable system further extends from the pulley to the movable connection;

a weight support attached to the movable connection, wherein the weight support comprises a support plate with a shaft extending upward from the support plate, wherein the weight support has a connection beneath the support plate and is configured to support one or more weight plates such that the one or more weight plates rest on the support plate, and the shaft is configured to extend through a hole in each of the one or more weight plates, and wherein the movable connection is configured to raise the weight support when the grip attachment is moved in a direction away from the pulley, via the cable system; and a resistance band, wherein the resistance band is attached to the connection and to a fixed connection attached to the frame, such that the resistance band extends between the connection beneath the support plate and the fixed connection in tension, and the resistance band is configured to be stretched when the weight support is raised via movement of the grip attachment.

2. A weight rack system, comprising:

a frame including an arrangement of a plurality of vertical frame members that are connected together with a plurality of lateral frame members extending between the plurality of vertical frame members;

a pulley assembly attached to the frame, wherein the pulley assembly comprises a pulley and a mount connected to the frame, wherein the first pulley is rotatably mounted on the mount;

a cable system connected at a first end to a movable connection and at a second end to a grip attachment, wherein the cable system extends from the grip attachment to the pulley and engages the pulley to redirect the cable system, and the cable system further extends from the pulley to the movable connection;

a weight support attached to the movable connection, wherein the weight support comprises a support plate with a shaft extending upward from the support plate, wherein the weight support is configured to support one or more weight plates such that the one or more weight plates rest on the support plate, and the shaft is configured to extend through a hole in each of the one or more weight plates, and wherein the movable connection is configured to raise the weight support when the grip attachment is moved in a direction away from the pulley, via the cable system; and a base support attached to a first vertical frame member of the plurality of vertical frame members, wherein the base support includes a mounting structure configured to releasably attach to the first vertical frame member and a support member fixedly connected to the mounting structure and configured to engage and support the weight support at an elevated position within a movement path of the weight support.

3. The weight rack system of claim 2, wherein the support member comprises two legs extending from a base portion thereby creating a space between the two legs.

4. The weight rack system of claim 3, wherein a resistance band attached to the weight support and the frame extends between the weight support and the frame, and wherein the resistance band extends between the space between the two legs.

5. The weight rack system of claim 3, wherein the two legs extend away from each other.

6. The weight rack system of claim 3, wherein the mounting structure further comprises a bridge member connected to the two legs.

7. The weight rack system of claim 3, wherein each of the two legs has a height that tapers from a first end proximate the base portion to a second end distal the base portion.

8. The weight rack system of claim 2, wherein the support member of the base support extends into the movement path of the weight support defined by a range of motion of the cable system, such that the support member of the base support is configured to engage and support the weight support at the elevated position within the movement path of the weight support.

9. A weight rack assembly, comprising:

a frame comprising a plurality of interconnected vertical frame members and lateral frame members;

a pulley assembly connected to the frame, wherein the pulley assembly comprises a pulley and a mount rotatably supporting the pulley, wherein the pulley assembly is attached to the frame by attaching the mount to the frame;

a cable system engaged with the pulley assembly, wherein the cable system engages the pulley to redirect the cable system;

a first end of the cable system connected to a weight support, wherein the weight support comprises a support plate with a shaft extending upward from the support plate, wherein the weight support is configured to support one or more weight plates such that the one or more weight plates rest on the support plate and the shaft is configured to extend through a hole in each of the one or more weight plates;

a second end of the cable system connected to a grip attachment;

a base support attached to a first vertical frame member of the plurality of interconnected vertical frame members and lateral frame members, wherein the base support is configured to hold the weight support, wherein the base support includes a mounting structure that is releasably attached to the first vertical frame member and a support member configured to engage and support the weight support at an elevated position, wherein the support member of the base support extends into a movement path of the weight support defined by a range of motion of the cable system, such that the support member of the base support is configured to engage and support the weight support at the elevated position within the movement path of the weight support;

a first end of a resistance band connected to the weight support; and a second end of the resistance band connected to the frame at a location spaced from the weight support, such that the resistance band extends between the weight support and the frame in tension.

10. The weight rack assembly of claim 9, wherein the support member includes two legs extending from a base portion thereby creating a space between the two legs.

11. The weight rack assembly of claim 10, wherein the resistance band extends between the space between the two legs.

12. The weight rack assembly of claim 9, wherein the cable system extends through a hole located in an upper surface of a first lateral frame member of the plurality of interconnected vertical frame members and lateral frame members.

13. The weight rack assembly of claim 12, further comprising a first protector in the hole in the upper surface of the first lateral frame member, wherein the cable system extends through an aperture of the first protector.

14. The weight rack assembly of claim 9, wherein the support plate includes a lower connection on a bottom surface that attaches to the first end of the resistance band.

* * * * *